US008989636B2

(12) United States Patent
Hori et al.

(10) Patent No.: US 8,989,636 B2
(45) Date of Patent: Mar. 24, 2015

(54) TONER CONTAINER AND IMAGE FORMING APPARATUS

(75) Inventors: Eisuke Hori, Tokyo (JP); Noriyuki Kimura, Kanagawa (JP); Nobuo Takami, Kanagawa (JP); Yuji Suzuki, Tokyo (JP); Hideki Kimura, Kanagawa (JP); Kenji Kikuchi, Kanagawa (JP); Junji Yamabe, Shizuoka (JP); Masato Suzuki, Shizuoka (JP)

(73) Assignee: Ricoh Company, Limited, Tokyo (JP)

( * ) Notice: Subject to any disclaimer, the term of this patent is extended or adjusted under 35 U.S.C. 154(b) by 182 days.

(21) Appl. No.: 13/581,704

(22) PCT Filed: Mar. 1, 2011

(86) PCT No.: PCT/JP2011/055177

§ 371 (c)(1),
(2), (4) Date: Aug. 29, 2012

(87) PCT Pub. No.: WO2011/108741

PCT Pub. Date: Sep. 9, 2011

(65) Prior Publication Data

US 2012/0321341 A1 Dec. 20, 2012

(30) Foreign Application Priority Data

| | | |
|---|---|---|
| Mar. 1, 2010 | (JP) | 2010-044045 |
| Mar. 10, 2010 | (JP) | 2010-052559 |
| Mar. 10, 2010 | (JP) | 2010-052625 |
| Jun. 11, 2010 | (JP) | 2010-134325 |
| Jun. 11, 2010 | (JP) | 2010-134524 |
| Jan. 20, 2011 | (JP) | 2011-009782 |
| Jan. 20, 2011 | (JP) | 2011-009849 |

(51) Int. Cl.
*G03G 15/08* (2006.01)

(52) U.S. Cl.
CPC ..... *G03G 15/0837* (2013.01); *G03G 15/0872* (2013.01); *G03G 15/0881* (2013.01); *G03G 2215/0668* (2013.01)
USPC ..... 399/262; 399/106

(58) Field of Classification Search
CPC ..... G03G 15/0837; G03G 15/0872; G03G 15/0832; G03G 15/0834; G03G 15/0836; G03G 15/0867; G03G 15/0868; G03G 15/087; G03G 2215/066; G03G 2215/0663; G03G 2215/0668; G03G 2215/0675
USPC ..... 399/262, 263
See application file for complete search history.

(56) References Cited

U.S. PATENT DOCUMENTS 4,937,628 A * 6/1990 Cipolla et al. ..... 399/106
5,565,973 A 10/1996 Fujishiro et al.

(Continued)

FOREIGN PATENT DOCUMENTS

CN 2741075 Y 11/2005
JP H04-001681 1/1992

(Continued)

OTHER PUBLICATIONS

International Search Report issued Apr. 5, 2011 in PCT/JP2011/055177 filed Mar. 1, 2011.

(Continued)

*Primary Examiner* — Benjamin Schmitt
(74) *Attorney, Agent, or Firm* — Oblon, McClelland, Maier & Neustadt, L.L.P.

(57) ABSTRACT

A toner container that is detachably attached to a main body of an image forming apparatus such that a longitudinal direction of the toner container is parallel to a horizontal direction is provided. The toner container includes: a cylindrical container body that has an opening on one end, and is configured to convey toner inside the body toward the opening; a cap portion into which the opening of the container body is inserted, and which includes a toner outlet at a bottom portion for discharging toner discharged from the opening of the container body to the outside of the toner container in a vertically downward direction; and a shutter member that is held on the bottom portion of the cap portion, and moves along an outer periphery of the cap portion to open and close the toner outlet. The cap portion is formed by integral molding.

15 Claims, 39 Drawing Sheets

(56) References Cited

U.S. PATENT DOCUMENTS

| | | | | |
|---|---|---|---|---|
| 6,298,208 | B1 | 10/2001 | Kawamura et al. | |
| 2003/0215267 | A1 | 11/2003 | Kita | |
| 2003/0235435 | A1 | 12/2003 | Muramatsu et al. | |
| 2005/0117936 | A1 | 6/2005 | Takami | |
| 2005/0196198 | A1 | 9/2005 | Kawamura et al. | |
| 2006/0002743 | A1 | 1/2006 | Katsuyama et al. | |
| 2006/0034642 | A1 | 2/2006 | Taguchi et al. | |
| 2006/0182468 | A1 | 8/2006 | Takami | |
| 2007/0077100 | A1 | 4/2007 | Suzuki et al. | |
| 2007/0122205 | A1* | 5/2007 | Taguchi et al. | 399/258 |
| 2007/0212119 | A1 | 9/2007 | Kurenuma et al. | |
| 2008/0025743 | A1 | 1/2008 | Hori | |
| 2008/0240771 | A1 | 10/2008 | Kurita et al. | |
| 2009/0123192 | A1 | 5/2009 | Taguchi et al. | |
| 2009/0180817 | A1 | 7/2009 | Taguchi et al. | |
| 2009/0279916 | A1 | 11/2009 | Naito et al. | |
| 2009/0279921 | A1 | 11/2009 | Naito et al. | |
| 2010/0003055 | A1 | 1/2010 | Kikuchi et al. | |
| 2010/0034557 | A1 | 2/2010 | Arai et al. | |
| 2010/0129118 | A1 | 5/2010 | Kimura et al. | |
| 2010/0254732 | A1 | 10/2010 | Taguchi et al. | |
| 2010/0296847 | A1 | 11/2010 | Kurenuma et al. | |
| 2011/0038647 | A1 | 2/2011 | Kawamura et al. | |
| 2012/0141171 | A1 | 6/2012 | Taguchi et al. | |

FOREIGN PATENT DOCUMENTS

| | | |
|---|---|---|
| JP | 2000-214669 | 8/2000 |
| JP | 2002-268344 | 9/2002 |
| JP | 2005-292630 | 10/2005 |
| JP | 2006-047811 | 2/2006 |
| JP | 2006-071762 | 3/2006 |
| JP | 2006-208574 | 8/2006 |
| JP | 2009-223047 | 10/2009 |
| JP | 2009-271279 | 11/2009 |
| JP | 2009-271280 | 11/2009 |

OTHER PUBLICATIONS

Chinese Office Action issued in Patent Application No. 201180021749.9 on Jun. 18, 2014 (w/ English translation).

* cited by examiner

TONER CONTAINER AND IMAGE FORMING APPARATUS

TECHNICAL FIELD

The present invention relates to an approximately cylindrical toner container set in a copier, a printer, a facsimile machine, and an image forming apparatus such as a multifunction peripheral that has functions of the copier, the printer, and the facsimile machine, and relates to an image forming apparatus including the toner container.

BACKGROUND ART

In conventional image forming apparatuses such as copiers, a cylindrical toner container (toner bottle) that is detachably attached to a main body of an image forming apparatus has been widely used (see, for example, Patent Document 1: Japanese Patent Application Laid-open No. H4-1681 and Patent Document 2: Japanese Patent Application Laid-open No. 2002-268344)

Patent Documents 1 and 2 disclose a toner container (toner bottle) that is set in an image forming apparatus body in a replaceable manner and that mainly includes a container body (bottle body) and a cap portion (held portion).

In a conventional toner container, when an opening area of a toner outlet of the cap portion and/or a flow passage area of a toner conveying path communicating with the toner outlet is increased, it may be possible to configure a shutter member of the cap portion so that the shutter member can slide in a longitudinal direction to open and close the toner outlet in synchronization with attachment/detachment operation of the toner container to/from an image forming apparatus body in a longitudinal direction, in order to attach/detach the toner container to/from the apparatus body with only a few actions.

In this case, however, the structure of the cap portion becomes complicated, and if the cap portion is formed by boding or welding two or more molded components together, the dimension of the cap portion itself may be deviated from a desired dimension due to variation in bonding or welding accuracy. Therefore, sealing capability between the container body and the cap portion may be reduced due to variation in a gap between the container body and the cap portion, or toner may be scattered due to positional deviation between the toner outlet and a toner supply port of the image forming apparatus body, which is a problem. Furthermore, when the cap portion is formed by bonding or welding two or more molded components together, mechanical strength of the cap portion may be reduced or costs for molds may be increased, which is another problem.

The present invention has been made to solve the above problems, and it is an object of the present invention to provide a toner container and an image forming apparatus capable of allowing for good operability of the toner container, ensuring adequate dimensional accuracy and mechanical strength of a cap portion even when the cap portion has a complicated structure, and relatively reducing costs.

DISCLOSURE OF INVENTION

According to an aspect of the present invention, there is provided a toner container that is detachably attached to a main body of an image forming apparatus such that a longitudinal direction of the toner container is parallel to a horizontal direction. The toner container includes: a cylindrical container body that has an opening on one end thereof in the longitudinal direction and is configured to convey toner contained therein toward the opening; a cap portion into which the opening of the container body is inserted, and which includes a toner outlet at a bottom portion thereof for discharging toner, which has been discharged from the opening of the container body, to the outside of the toner container in a vertically downward direction; and a shutter member that is held on the bottom portion of the cap portion, and moves along an outer periphery of the cap portion to thereby open and close the toner outlet, wherein the cap portion is formed by integral molding.

According to still another aspect of the present invention, there is provided a toner container that is detachably attached to a main body of an image forming apparatus such that a longitudinal direction of the toner container is parallel to a horizontal direction. The toner container includes: a cylindrical container body that has an opening on one end thereof in the longitudinal direction, and is configured to convey toner contained therein toward the opening; a cap portion into which the opening of the container body is inserted, and which includes a toner outlet at a bottom portion thereof for discharging toner, which has been discharged from the opening of the container body, to the outside of the toner container in a vertically downward direction; and a shutter member that is held on the bottom portion of the cap portion, and moves along an outer periphery of the cap portion to thereby open and close the toner outlet, wherein the cap portion includes a plurality of claw members engaged with the container body, and the claw members and a portion of the cap portion, the portion being at an opposed position to a circumference of the opening of the container body, are formed by integral molding.

BRIEF DESCRIPTION OF DRAWINGS

FIGS. 58A-1 to 58A-4 are schematic front views of how the stirring member illustrated in FIG. 55 rotates;

FIGS. 58B-1 to 58B-4 are schematic front views of how a stirring member of the toner container according to the first embodiment rotates;

BEST MODE(S) FOR CARRYING OUT THE INVENTION

Figure 1:
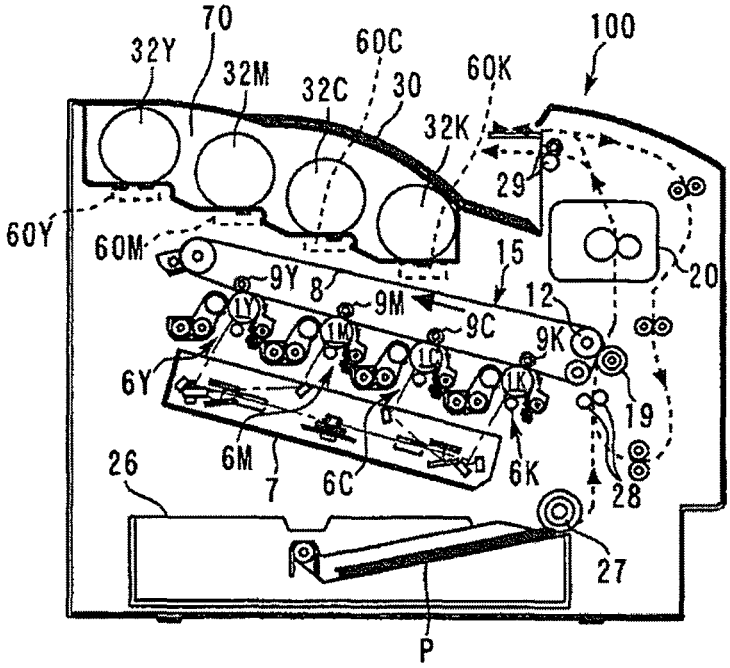
FIG. 1 an overall configuration diagram of an image forming apparatus according to a first embodiment.

Exemplary embodiments of the present invention will be described in detail below with reference to the accompanying drawings. In the drawings, the same or equivalent components are denoted by the same reference letters or numerals, and explanation thereof will be appropriately simplified or omitted.

First Embodiment

A first embodiment will be described in detail below with reference to FIGS. 1 to 46.

The configuration and operation of the overall image forming apparatus are described first.

Figure 3:
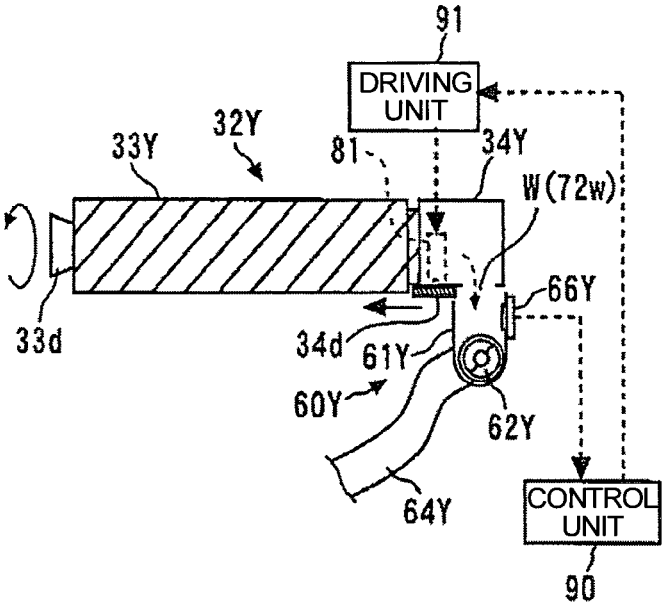
FIG. 3 is a schematic diagram of how a toner container is set in a toner supply device.
Figure 4:
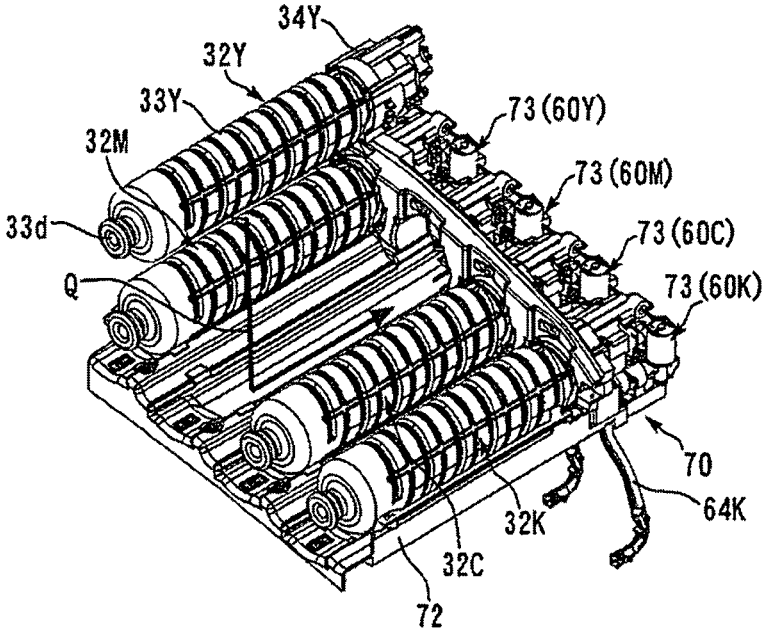
FIG. 4 is a schematic perspective view of how toner containers are set in a toner-container holder.
Figure 36:
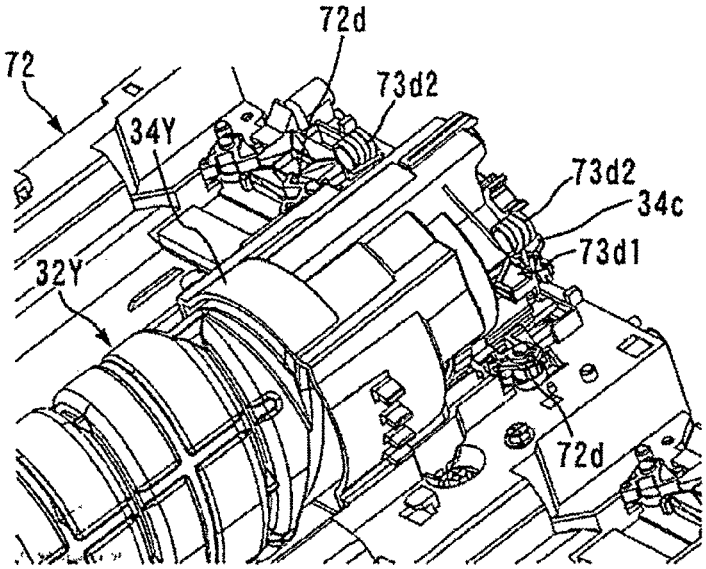
FIG. 36 is a diagram illustrating a state following the state illustrated in FIG. 35.

As illustrated in FIG. 1, four toner containers 32Y, 32M, 32C, and 32K corresponding to respective colors (yellow, magenta, cyan, and black) are detachably (replaceably) arranged in a toner-container holder 70 provided in the upper side of an image forming apparatus body 100 (also see FIGS. 3, 4, and 36).

An intermediate transfer unit 15 is arranged below the toner-container holder 70. Image forming units 6Y, 6M, 6C, and 6K corresponding to the respective colors (yellow, magenta, cyan, and black) are arranged in a tandem manner so as to face an intermediate transfer belt 8 of the intermediate transfer unit 15.

Toner supply devices 60Y, 60M, 600, and 60K are arranged below the toner containers 32Y, 32M, 32C, and 32K, respectively. The toner supply devices 60Y, 60M, 60C, and 60K supply (feed) toner contained in the toner containers 32Y, 32M, 32C, and 32K to developing devices in the image forming units 6Y, 6M, 6C, and 6K, respectively.

Figure 2:
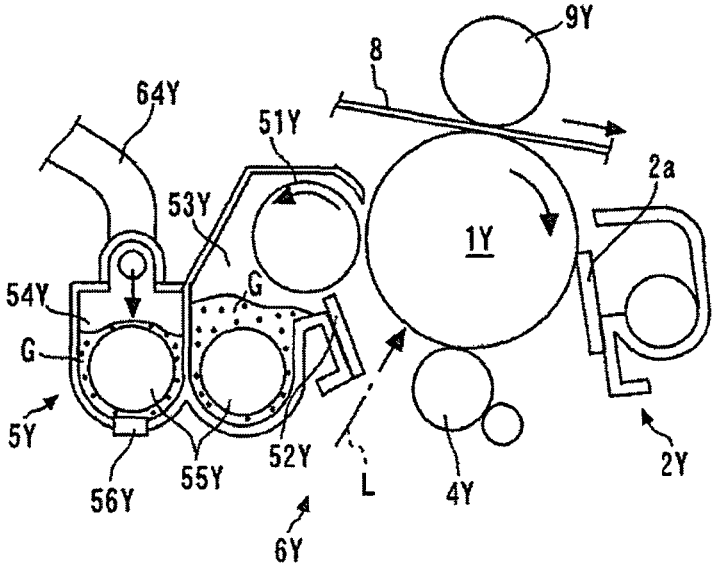
FIG. 2 is a cross-sectional view of an image forming unit.

Referring to FIG. 2, the image forming unit 6Y for yellow includes a photosensitive drum 1Y, and also includes a charging unit 4Y, a developing device 5Y (developing unit), a cleaning unit 2Y, and a neutralizing unit (not illustrated), which are arranged around the photosensitive drum 1Y. Image forming processes (charging process, exposing process, developing process, transfer process, and cleaning process) are preformed on the photosensitive drum 1Y, so that a yellow image is formed on the photosensitive drum 1Y.

The other three image forming units 6M, 6C, and 6K have almost the same configurations as the image forming unit 6Y for yellow except that colors of toner to be used are different and images corresponding to the respective toner colors are formed. In the following, explanation of the other three image forming units 6M, 6C, and 6K will be appropriately omitted, and explanation of only the image forming unit 6Y for yellow will be given.

Referring to FIG. 2, the photosensitive drum 1Y is rotated clockwise in FIG. 2 by a drive motor (not illustrated). The surface of the photosensitive drum 1Y is uniformly charged at the position of the charging unit 4Y (charging process).

The surface of the photosensitive drum 1Y then reaches a position of radiating a laser light L emitted from an exposing device 7 (see FIG. 1), where an exposing light is scanned to form an electrostatic latent image for yellow (exposing process)

The surface of the photosensitive drum 1Y then reaches a position of facing the developing device 5Y, where the electrostatic latent image is developed and a yellow toner image is formed (developing process).

The surface of the photosensitive drum 1Y then reaches a position of facing the intermediate transfer belt 8 and a primary-transfer bias roller 9Y, where the toner image on the photosensitive drum 1Y is transferred to the intermediate transfer belt 8 (primary transfer process). At this time, a slight amount of non-transferred toner remains on the photosensitive drum 1Y.

The surface of the photosensitive drum 1Y then reaches a position of facing the cleaning unit 2Y, where the non-transferred toner remaining on the photosensitive drum 1Y is mechanically collected by a cleaning blade 2*a* (cleaning process).

The surface of the photosensitive drum 1Y finally reaches a position of facing the neutralizing unit (not illustrated), where the residual potential on the photosensitive drum 1Y is removed.

In this manner, a series of the image forming professes performed on the photosensitive drum 1Y is complete.

The image forming processes are performed on the other image forming units 6M, 6C, and 6K in the same manner as the yellow image forming unit 6Y. Specifically, the exposing device 7 arranged below the image forming units emits a laser light L based on image information toward each photosensitive drum of the image forming units 6M, 6C, and 6K. More specifically, the exposing device 7 emits the laser light L from a light source, and radiates the laser light L onto the photosensitive drum through a plurality of optical elements while scanning the laser light L by a polygon mirror being rotated.

Subsequently, color toner images formed on the respective photosensitive drums through the developing process are superimposed and transferred onto the intermediate transfer belt 8. In this manner, a color image is formed on the intermediate transfer belt 8.

Referring to FIG. 1, the intermediate transfer unit 15 includes the intermediate transfer belt 8, four primary-transfer bias rollers 9Y, 9M, 9C, and 9K, a secondary-transfer backup roller 12, a plurality of tension rollers, an intermediate-transfer cleaning unit, and the like. The intermediate transfer belt 8 is stretched and supported by a plurality of rollers, and is endlessly moved in the arrow direction in FIG. 1 along with rotation of the roller 12.

The four primary-transfer bias rollers 9Y, 9M, 9C, and 9K sandwich the intermediate transfer belt 8 with the photosensitive drum 1Y and photosensitive drums 1M, 1C, and 1K, respectively, so that primary transfer nips are formed. A transfer bias opposite to the polarity of toner is applied to the primary-transfer bias rollers 9Y, 9M, 9C, and 9K.

The intermediate transfer belt 8 moves in the arrow direction and sequentially passes through the primary transfer nips of the primary-transfer bias rollers 9Y, 9M, 9C, and 9K. Accordingly, the toner images for respective colors on the photosensitive drums 1Y, 1M, 1C, and 1K are superimposed on the intermediate transfer belt 8 as primary transfer.

The intermediate transfer belt 8 carrying the superimposed and transferred toner images of a plurality of colors reaches a position of facing a secondary transfer roller 19. At this position, the secondary-transfer backup roller 12 sandwiches the intermediate transfer belt 8 with the secondary transfer roller 19, so that a secondary transfer nip is formed. The four-color toner image formed on the intermediate transfer belt 8 is transferred to a recording medium P, such as a transfer sheet, conveyed to the position of the secondary transfer nip. At this time, non-transferred toner which has not been transferred to the recording medium P remains on the intermediate transfer belt 8.

The intermediate transfer belt 8 then reaches the position of the intermediate-transfer cleaning unit (not illustrated), where the non-transferred toner on the intermediate transfer belt 8 is collected.

In this manner, a series of the transfer process performed on the intermediate transfer belt 8 is complete.

The recording medium P is conveyed to the position of the secondary transfer nip from a feed unit 26, which is disposed in the lower side of the apparatus body 100, via a feed roller 27 and a registration roller pair 28.

More specifically, a plurality of recording media P, such as transfer sheets, is stacked in the feed unit 26. When the feed roller 27 is rotated counterclockwise in FIG. 1, the topmost recording medium P is fed to a nip between rollers of the registration roller pair 28.

The recording medium P conveyed to the registration roller pair 28 temporarily stops at the position of the nip between the rollers of the registration roller pair 28, the rotation of which is being stopped. The registration roller pair 28 is rotated in synchronization with the color image on the intermediate transfer belt 8, and the recording medium P is conveyed toward the secondary transfer nip. Then, a desired color image is transferred to the recording medium P.

The recording medium P to which the color image is transferred at the position of the secondary transfer nip is conveyed to the position of a fixing unit 20, where the color image transferred to the surface of the recording medium P is fixed to the recording medium P by heat and pressure applied by a fixing roller and a pressing roller.

The recording medium P is then discharged to the outside of the apparatus through a nip between rollers of a discharging roller pair 29. The recording medium P discharged to the outside of the apparatus by the discharging roller pair 29 is sequentially stacked on a stack portion 30, as an output image.

In this manner, a series of the imaging forming processes in the image forming apparatus is complete.

The configuration and operation of the developing device in the image forming unit are described in detail below with reference to FIG. 2.

The developing device 5Y includes a developing roller 51Y facing the photosensitive drum 1Y, a doctor blade 52Y facing the developing roller 51Y, two conveyor screws 55Y disposed in developer storage units 53Y and 54Y, and a density detection sensor 56Y for detecting toner density in developer. The developing roller 51Y includes a magnet fixed inside thereof and a sleeve that rotates around the magnet. Two-component developer G formed of carrier and toner is stored in the developer storage units 53Y and 54Y. The developer storage unit 54Y communicates with a toner conveying pipe 64Y (toner conveying path) via an opening formed on the upper side of the developer storage unit 54Y.

The developing device 5Y configured as above operates as follows.

The sleeve of the developing roller 51Y rotates in the arrow direction in FIG. 2. The developer G, which is carried on the developing roller 51Y by a magnetic field formed by the magnet, moves along the developing roller 51Y along with rotation of the sleeve.

The developer G in the developing device 5Y is controlled so that the proportion (toner density) of toner in the developer is in a predetermined range. More specifically, toner contained in the toner container 32Y is supplied to the developer storage unit 54Y via the toner supply device 60Y (see FIG. 3) according to toner consumption in the developing device 5Y. The configuration and operation of the toner supply device will be described in detail below.

The toner supplied to the developer storage unit 54Y circulates in the two developer storage units 53Y and 54Y while being mixed and stirred together with the developer G (movement in the vertical direction on the sheet of FIG. 2) by the two conveyor screws 55Y. The toner in the developer G adheres to the carrier by triboelectric charging with the carrier, and is carried on the developing roller 51Y together with the carrier due to the magnetic force formed on the developing roller 51Y.

The developer G carried on the developing roller 51Y is conveyed in the arrow direction in FIG. 2 and reaches the position of the doctor blade 52Y. At this position, the amount of the developer G on the developing roller 51Y is made appropriate, and then the developer G is conveyed to the position (development area) of facing the photosensitive drum 1Y. The toner adheres to a latent image formed on the photosensitive drum 1Y by an electric field formed in the development area. The developer G remaining on the developing roller 51Y reaches the upper side of the developer storage unit 53Y along with rotation of the sleeve, where the developer G is separated from the developing roller 51Y.

Referring to FIGS. 3 and 4, the toner supply devices 60Y, 60M, 60C, and 60K are described in detail below.

Referring to FIG. 3, toner in the toner containers 32Y, 32M, 32C, and 32K arranged in the toner-container holder 70 of the apparatus body 100 is appropriately supplied to the respective developing devices by the toner supply devices 60Y, 60M, 60C, and 60K, which are arranged for the respective toner colors, according to toner consumption in the developing devices for the respective colors.

The four toner supply devices 60Y, 60M, 600, and 60K have almost the same configurations and the four toner containers 32Y, 32M, 32C, and 32K have almost the same configurations, except that colors of toner used for the image forming processes are different from each other. Therefore, explanation will be given of only the toner supply device 60Y and the toner container 32Y for yellow, and explanation of the toner supply devices 60M, 60C, and 60K and the toner containers 32M, 32C, and 32K for the other three colors will be omitted appropriately.

As illustrated in FIG. 4, when the toner containers 32Y, 32M, 32C, and 32K are attached to the toner-container holder 70 of the apparatus body 100 (movement along an arrow Q), a shutter member 34*d* of each of the toner containers 32Y, 32M, 32C, and 32K moves in synchronization with the attachment operation. Accordingly, a toner outlet W is opened and a toner supply port 72*w* (see FIGS. 3 and 37 to 39) of the toner-container holder 70 (the toner supply devices 60Y, 60M, 60C, and 60K) and the toner outlet W communicate with each other. Consequently, toner contained in the toner containers 32Y, 32M, 32C, and 32K is discharged from the toner outlet W and is accumulated in a toner tank 61Y through the toner supply port 72*w* of the toner-container holder 70 (the toner supply devices 60Y, 60M, 60C, and 60K).

Referring to a schematic diagram of FIG. 3, the toner container 32Y is an approximately cylindrical toner bottle, and mainly includes a cap portion 34Y that is non-rotatably held by the toner-container holder 70 and a container body (bottle body) 33Y that has an integrally-formed gear 33*c*. The container body 33Y is held so as to rotate relative to the cap portion 34Y, and is rotated in the arrow direction in FIG. 3 by a driving unit 91 (which includes a drive motor, a drive gear 81, and the like, see FIG. 42). With the rotation of the container body 33Y, toner contained in the toner container 32Y (the container body 33Y) is conveyed in a longitudinal direction (conveyed from left to right in FIG. 3) by a spiral-shaped projection 33*b* formed on the inner circumferential surface of the container body 33Y, and the toner is discharged from the toner outlet W of the cap portion 34Y. That is, the driving unit 91 appropriately rotates the container body 33Y of the toner container 32Y, so that toner is appropriately supplied to the toner tank 61Y. The toner containers 32Y, 32M, 32C, and 32K are replaced with new ones at the end of their lifetimes (when almost all of toner contained is consumed and the container becomes empty).

Referring to FIG. 3, each of the toner supply devices 60Y, 60M, 60C, and 60K includes the toner-container holder 70, the toner tank 61Y, a toner conveyor coil 62Y, a toner end sensor 66Y, and the driving unit 91.

The toner tank 61Y is arranged below the toner outlet W of the toner container 32Y for accumulating toner discharged from the toner outlet W of the toner container 32Y. The bottom portion of the toner tank 61Y is connected to an upstream portion of the toner conveying pipe 64Y. The toner end sensor 66Y for detecting that the amount of toner accumulated in the toner tank 61Y becomes equal to or smaller than a predetermined amount is set on a wall surface of the toner tank 61Y (at a position with a predetermined height from the bottom portion). A piezoelectric sensor or the like may be used as the toner end sensor 66Y. When a control unit 90 detects, by using the toner end sensor 66Y, that the amount of toner accumulated in the toner tank 61Y becomes equal to or smaller than the predetermined amount (toner end detection), the control unit 90 controls the driving unit 91 (the drive gear 81) to rotate the container body 33Y of the toner container 32Y for a predetermined time in order to supply toner to the toner tank 61Y. When the toner end detection by the toner end sensor 66Y is not cancelled even after the above control is repeated, information for urging replacement of the toner container 32Y is displayed on a display unit (not illustrated) of the apparatus body 100 on the presumption that the toner container 32Y is empty of toner.

The toner conveyor coil 62Y is arranged inside the toner conveying pipe 64Y, and conveys toner accumulated in the toner tank 61Y toward the developing device 5Y via the toner conveying pipe 64Y, although the details are not illustrated in the figures. More specifically, the toner conveyor coil 62Y conveys toner from the bottom portion (a bottommost point) of the toner tank 61Y toward the upper side of the developing device 5Y along the toner conveying pipe 64Y. The toner conveyed by the toner conveyor coil 62Y is supplied into the developing device 5Y (the developer storage unit 54Y).

Referring to FIG. 4, the toner-container holder 70 mainly includes a cap holding portion 73 for holding the cap portion 34Y of the toner container 32Y, and a bottle holding portion 72 (container-body holding portion) for holding the container body 33Y of the toner container 32Y. The configuration and operation of the toner-container holder 70 (the bottle holding portion 72 and the cap holding portion 73) will be described later with reference to FIGS. 29 to 46.

Referring to FIG. 1, when a body cover (not illustrated) arranged in the upper portion of a front side (a front side in a direction normal to the sheet of FIG. 1) of the apparatus body 100 is opened, the toner-container holder 70 is exposed. While each of the toner containers 32Y, 32M, 32C, and 32K is oriented so that its longitudinal direction is parallel to the horizontal direction, attachment/detachment operation of each of the toner containers 32Y, 32M, 32C, and 32K is performed from the upper front side of the apparatus body 100 (the attachment/detachment operation using the longitudinal direction of the toner container as an attachment/detachment direction).

More specifically, when attached to the apparatus body 100, each of the toner containers 32Y, 32M, 32C, and 32K is placed on the toner-container holder 70 from the upper side of the apparatus body 100 with the body cover open, and then pushed into the toner-container holder 70 in the horizontal direction (movement in the direction of the arrow Q of FIG. 4) with the cap portion 34Y positioned at the leading end. On the other hand, when detached from the apparatus body 100, each of the toner containers 32Y, 32M, 32C, and 32K is detached in reverse order of the attachment operation.

Figure 30:
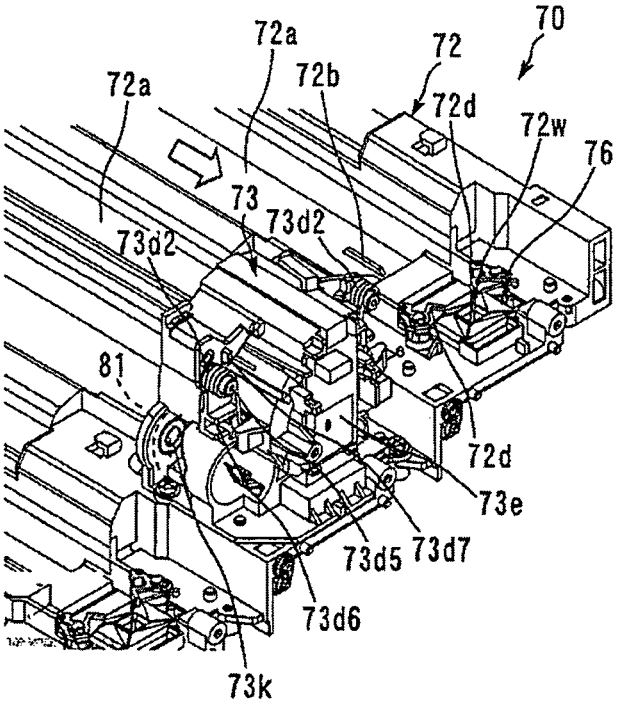
FIG. 30 is another perspective view of the vicinity of the bottle holding portion in the toner-container holder.
Figure 31:
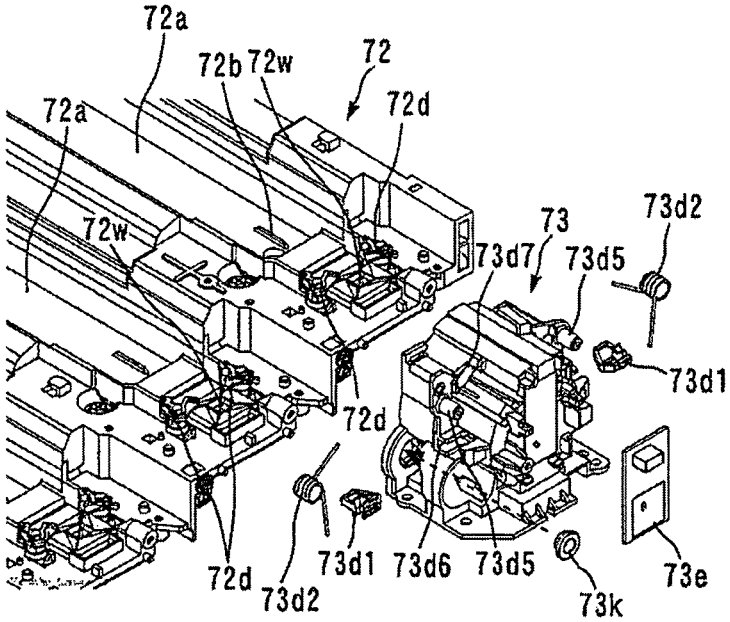
FIG. 31 is an exploded perspective view of a part of the toner-container holder.

In the first embodiment, an antenna 73*e* (RFID antenna) is mounted on the cap holding portion 73 of the toner-container holder 70 in which the toner containers 32Y, 32M, 32C, and 32K are detachably mounted in a tandem manner (see FIGS. 30 and 31). More specifically, the antenna 73*e* is used for performing non-contact radio communication with an RFID chip 35 (see FIGS. 5 and 9) that is an electronic-information storage member mounted on an end face of the cap portion 34Y of the toner container 32Y.

The RFID chip 35 (electronic-information storage member) of each of the toner containers 32Y, 32M, 32C, and 32K exchanges necessary information with the antenna 73*e* (RFID antenna) of the apparatus body 100. Examples of the information exchanged between the chip and the antenna include information on a manufacturing number of the toner container and the number of times of recycles, information on the amount of toner, a lot number of toner, and toner color, and information on usage of the image forming apparatus body 100. The above electronic information is stored in the RFID chip 35 (electronic-information storage member) in advance before the RFID chip 35 is mounted on the image forming apparatus body 100 (or information received from the apparatus body 100 after the chip is mounted is stored).

Referring to FIGS. 5 to 28, the toner containers 32Y, 32M, 32C, and 32K will be described in detail.

Figure 5:
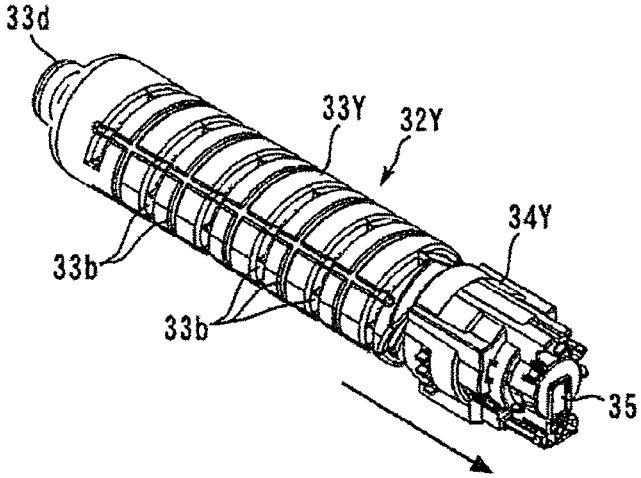
FIG. 5 is a perspective view of the toner container viewed obliquely from above.
Figure 6:
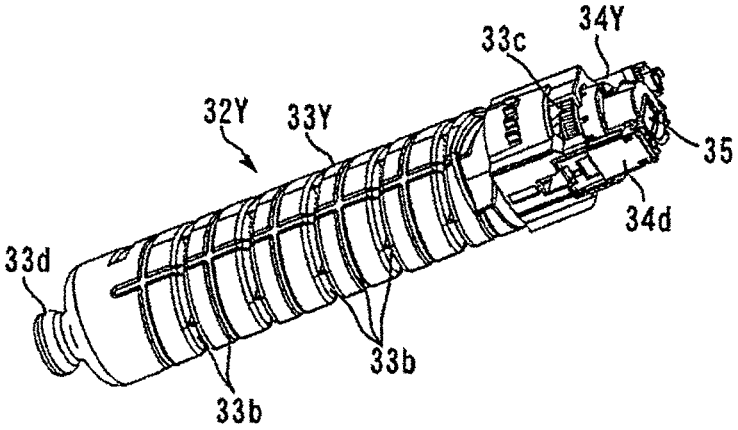
FIG. 6 is a perspective view of the toner container viewed obliquely from below.
Figure 7:
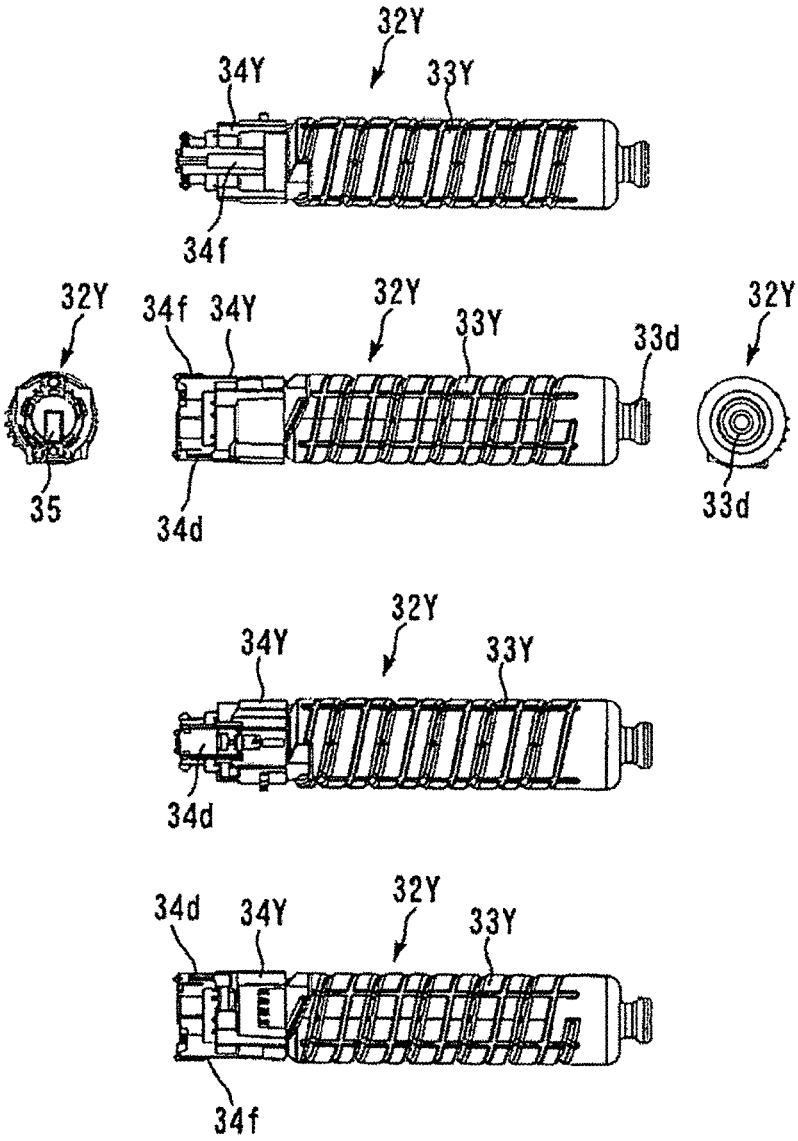
FIG. 7 illustrates six sides of the toner container.
Figure 9:
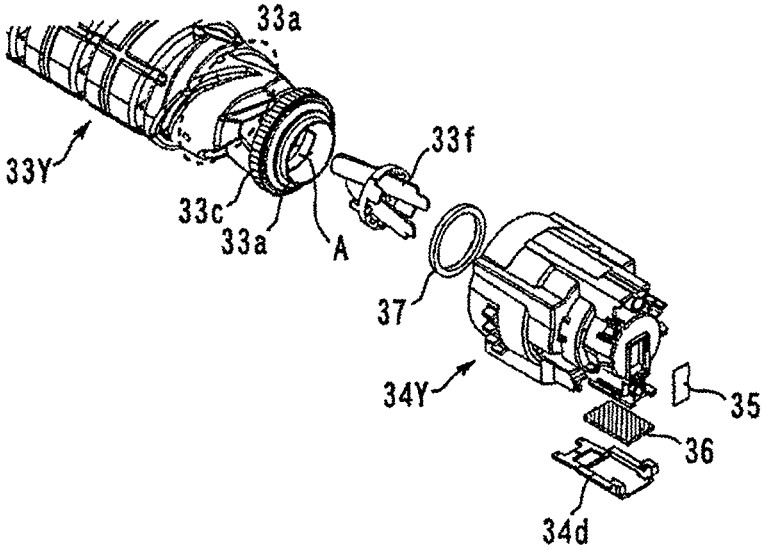
FIG. 9 is an exploded view of a part of the toner container.

As illustrated in FIGS. 5 to 7, the toner container 32Y mainly includes the container body 33Y (bottle body) and the cap portion 34Y (bottle cap) arranged on the head of the container body. Referring to FIG. 9, the toner container 32Y further includes a stirring member 33*f*, a cap seal 37 as a seal member, the shutter member 34*d*, a shutter seal 36, and the RFID chip 35 (chip used for RFID) as the electronic-information storage member, in addition to the container body 33Y and the cap portion 34Y.

The gear 33*c*, which rotates together with the container body 33Y, i.e., which rotates together with an opening, and an opening A are arranged on the head of the container body 33Y on one end of the container body 33Y in the longitudinal direction (a direction normal to the sheet of FIG. 8) (see FIG. 9). The opening A is provided on the head of the container body 33Y (front end position in the attachment operation), and is used for discharging toner contained in the container body 33Y into a space (cavity B, see FIG. 14) in the cap portion 34Y.

Toner is appropriately conveyed from the container body 33Y to the cavity B in the cap portion 34Y (the container body 33Y is rotated) to the extent that toner in the cap portion 34Y does not fall below a predetermined draft line.

The gear 33*c* engages with the drive gear 81 arranged in the toner-container holder 70 of the apparatus body 100 to thereby rotate the container body 33Y about a rotation axis. More specifically, the gear 33*c* is formed around the circumference of the opening A, and includes a plurality of teeth that are radially arranged with respect to the rotation axis of the container body 33Y. A part of the gear 33*c* is exposed from a notch portion 34*x* (see FIG. 16) formed on the cap portion 34Y, and engages with the drive gear 81 of the apparatus body 100 at an engagement position in the obliquely lower side of FIG. 8. A driving force is transmitted from the drive gear 81 to the gear 33*c*, so that the container body 33Y rotates clockwise in FIG. 8. In the first embodiment, the drive gear 81 and the gear 33*c* are spur gears.

Referring to FIGS. 5 and 6, a gripper 33*d* is arranged on the other end of the container body 33Y in the longitudinal direction (a rear end in the attachment direction) so that a user can grip it for attaching/detaching the toner container 32Y. The user attaches the toner container 32Y to the image forming apparatus body 100 by gripping the gripper 33*d* (movement of the toner container 32Y in the arrow direction in FIG. 5).

The spiral-shaped projection 33*b* is arranged on the inner circumferential surface of the container body 33Y (a spiral-shaped groove when viewed from the outer circumferential surface side). The spiral-shaped projection 33*b* is used for discharging toner from the opening A along with rotation of the container body 33Y in a predetermined direction. The container body 33Y configured as above can be manufactured by blow molding together with the gear 33*c*, which is arranged on the circumferential surface, and the gripper 33*d*.

Figure 10:
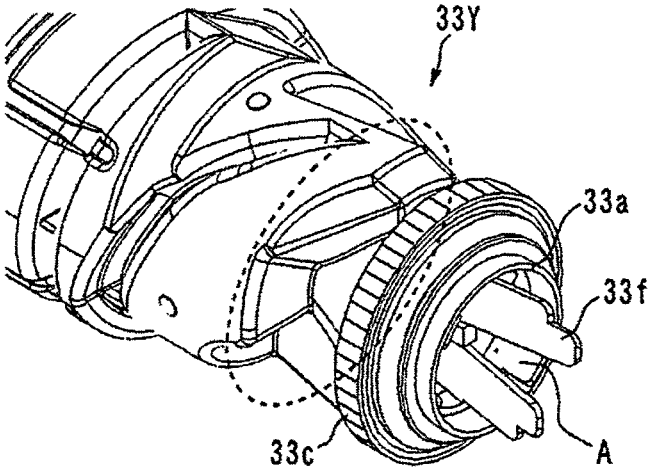
FIG. 10 is a perspective view of a head side of a container body of the toner container.

Referring to FIGS. 9 and 10, the toner container 32Y according to the first embodiment includes the stirring member 33*f* that rotates together with the container body 33Y and that is fitted to a bottle opening 33*a* (the opening A). The stirring member 33*f* is formed of a pair of plate members that extend from the cavity B in the cap portion 34Y to the inside of the container body 33Y (see FIG. 14). The stirring member 33*f* is formed such that the plate members being a pair are alternately inclined. The stirring member 33*f* is configured such that its front end reaches the upper side of the toner outlet W in the cap portion 34Y and its rear end (end on the opposite side) reaches a scooping portion (a portion surrounded by a dashed line in FIGS. 9 and 10) when the cap portion 34Y and the container body 33Y are assembled together. Rotation of the stirring member 33*f* together with the opening A of the container body 33Y allows improvement in toner discharging capability of the opening A.

Referring to FIGS. 9 and 10, engaging members (convex portions), which are engaged with claw members 34*j* (see FIGS. 14 and 19) of the cap portion 34Y in order to connect the container body 33Y and the cap portion 34Y to each other, are formed around the outer circumference of the bottle opening 33*a* of the container body 33Y. As described above, the container body 33Y is engaged with the cap portion 34Y so as to rotate relative to the cap portion 34Y. Therefore, the gear 33*c* rotates relative to the cap portion 34Y.

Figure 14:
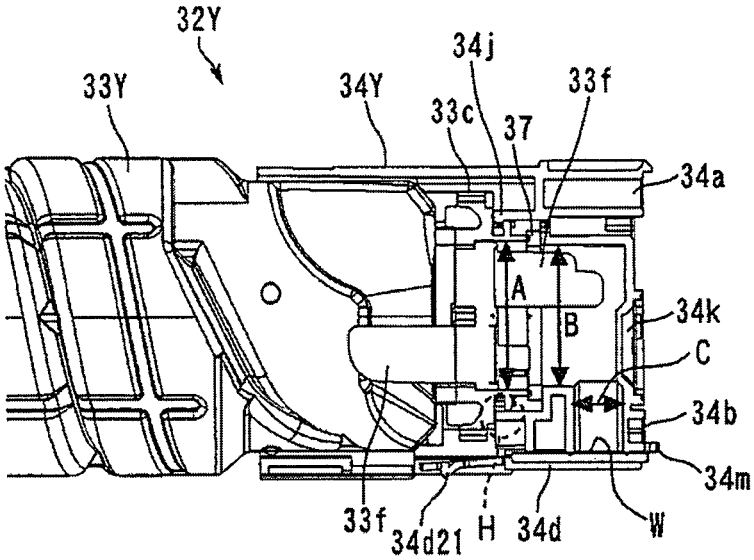
FIG. 14 is a cross-sectional view of the vicinity of the cap portion of the toner container.

The inner diameter of a head portion of the container body 33Y (near the position where the gear 33*c* is formed) is smaller than the inner diameter of a container portion containing toner (the position where the spiral-shaped projection 33*b* is formed) (see FIG. 14). The scooping portion (the portion surrounded by a dashed line in FIGS. 9 and 10), of which inner circumferential surface protrudes inward, is provided on the head of the container body 33Y. Toner conveyed toward the opening A by the spiral-shaped projection 33*b* along with the rotation of the container body 33Y is scooped, by the scooping portion (the portion surrounded by a dashed line in FIGS. 9 and 10), into a small-diameter portion of the head. The toner scooped into the small-diameter portion of the head is stirred by the stirring member 33*f*, and is discharged to the cavity B of the cap portion 34Y through the opening A.

Referring to FIGS. 11 to 14, the shutter member 34*d*, the shutter seal 36, the cap seal 37 (seal member), and the RFID chip 35 (electronic-information storage member) are arranged on the cap portion 34Y of the toner container 32Y.

Figure 13:
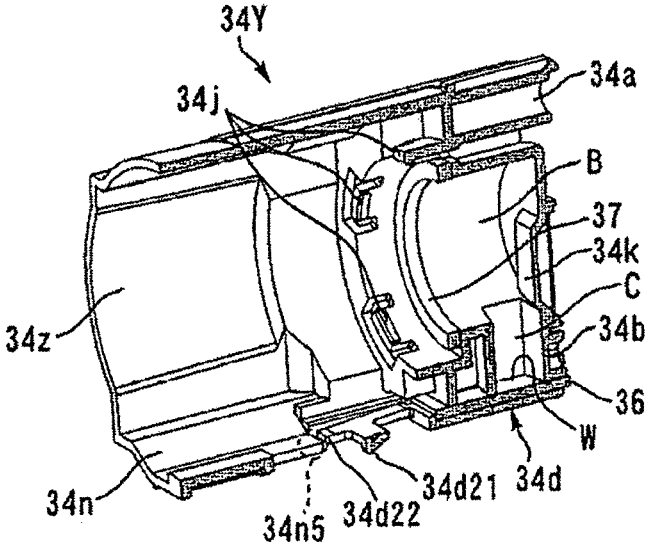
FIG. 13 is a cross-sectional perspective view of the cap portion of the toner container.
Figure 16:
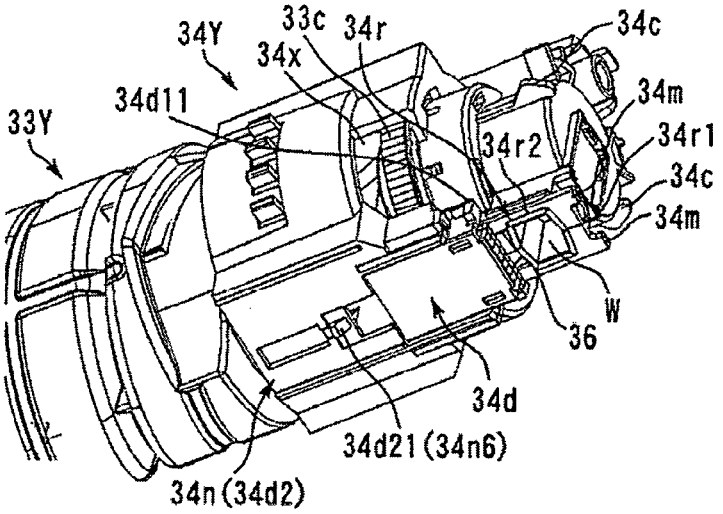
FIG. 16 is a perspective view of how the shutter member of the toner container opens the toner outlet.

The cap portion 34Y includes an insertion portion 34*z* with an inner diameter greater than the inner diameter of the cavity B (see FIG. 17), and the opening A of the container body 33Y is inserted into the insertion portion 34*z*. Referring to FIGS. 13 and 16, the toner outlet W is formed on the bottom portion of the cap portion 34Y to allow toner that has been discharged from the opening A of the container body 33Y to be discharged to the outside of the toner container in a vertically downward direction (fall by own weight). The shutter member 34*d* for opening and closing the toner outlet W is slidably held on the bottom portion of the cap portion 34Y. More specifically, the shutter member 34*d* relatively moves in the longitudinal direction from the cap portion 34Y side to the container body 33Y side (movement to the left in FIG. 14) to open the toner outlet W. Furthermore, the shutter member 34*d* relatively moves in the longitudinal direction from the container body 33Y side to the cap portion 34Y side (movement to the right in FIG. 14) to close the toner outlet W. The open/close operation of the shutter member 34*d* (the open/close operation of the toner outlet W) is performed in synchronization with the attachment/detachment operation of the toner container 32Y to the toner-container holder 70 (the apparatus body 100) in the longitudinal direction.

Figure 15:
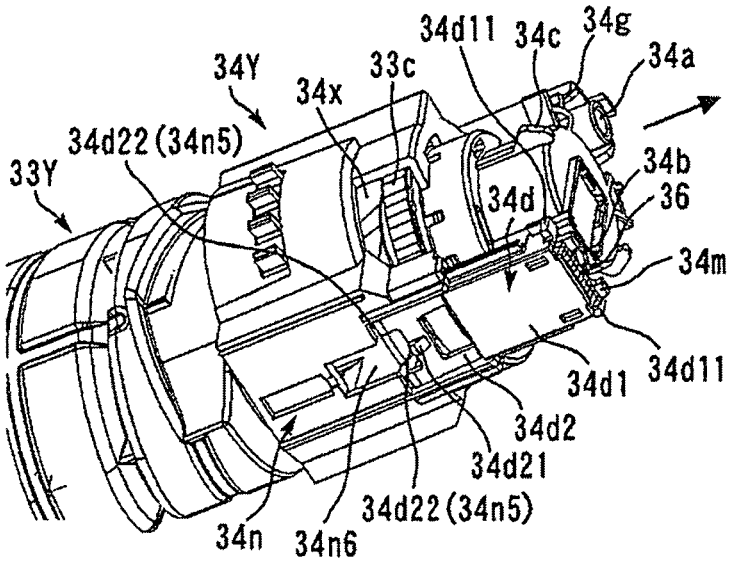
FIG. 15 is a perspective view of how a shutter member of the toner container closes a toner outlet.
Figure 18A:
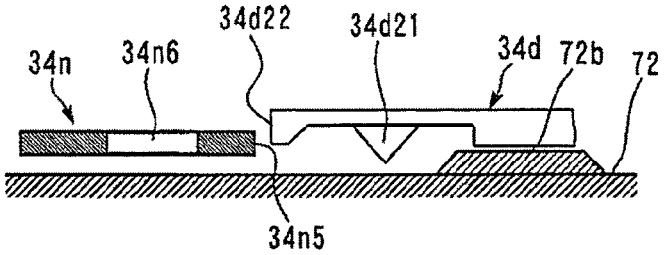
FIGS. 18A to 18C are schematic diagrams illustrating opening operation performed by the shutter member in synchronization with attachment operation of the toner container to a toner-container holder.
Figure 18B:
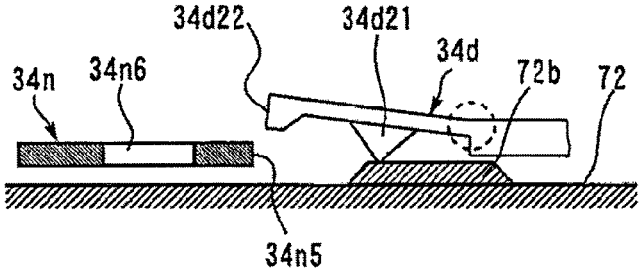
Figure 18C:
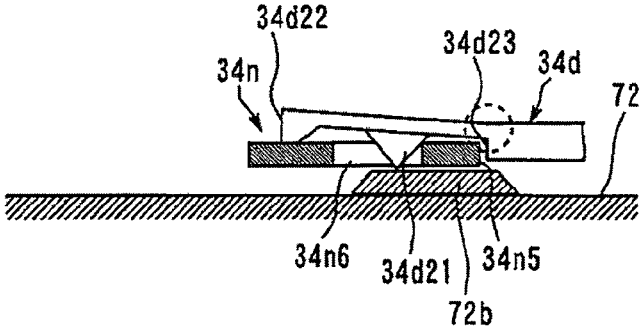
Figure 19:
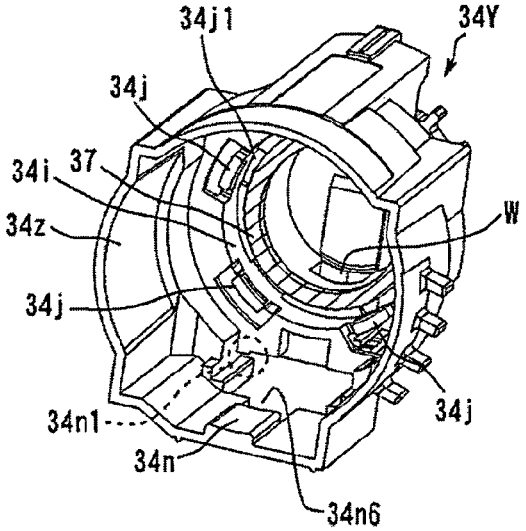
FIG. 19 is a perspective view of the cap portion from which the shutter member is detached.

FIGS. 15 and 16 illustrate operation of the shutter member 34*d* from start to completion of opening the toner outlet W. FIGS. 18A to 18C are schematic diagrams illustrating the opening operation of the shutter member 34*d* (a shutter deforming unit 34*d*2).

Figure 11:
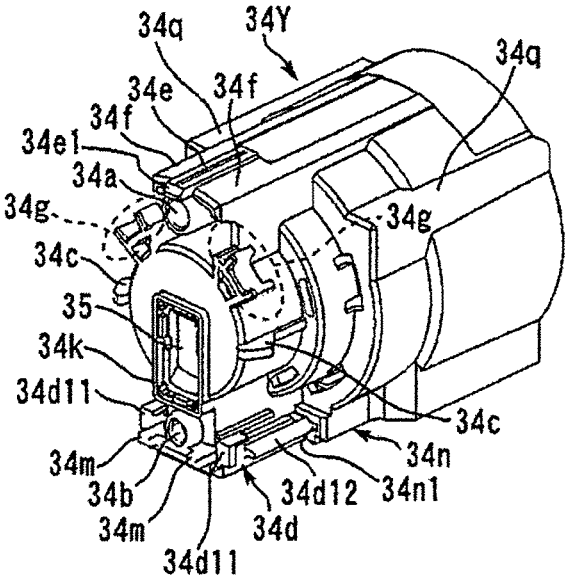
FIG. 11 is a perspective view of the cap portion of the toner container.
Figure 12:
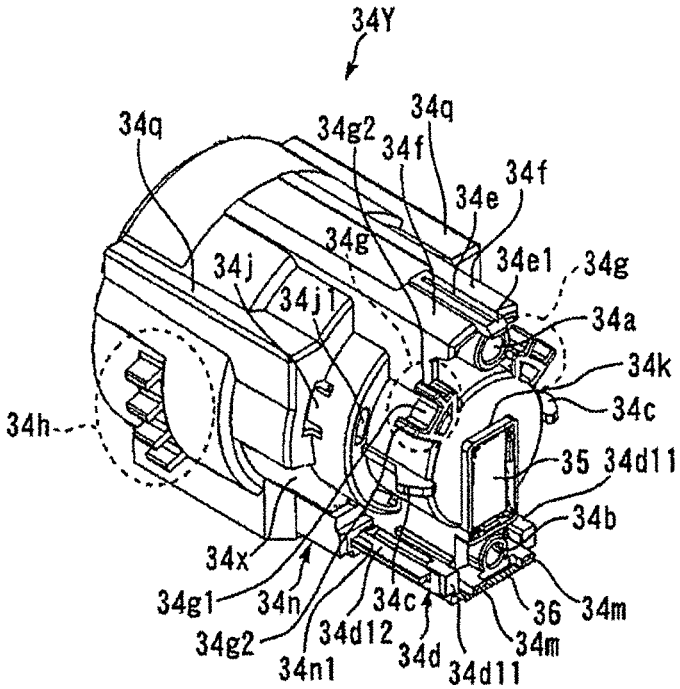
FIG. 12 is another perspective view of the cap portion of the toner container.

Referring to FIGS. 11 and 12, a first hole 34*a* (main guide hole) is formed on the upper portion (ceiling portion) of the cap portion 34Y such that the first hole 34*a* extends in the longitudinal direction from the end face of the cap portion 34Y perpendicular to the longitudinal direction. The first hole 34*a* functions as a main guide for positioning the cap portion 34Y in the image forming apparatus body 100. More specifically, the first hole 34*a* of the cap portion 34Y is engaged with a main guide pin 73*a* (see FIGS. 32 and 46) of the cap holding portion 73 in synchronization with the attachment operation of the toner container 32Y to the toner-container holder 70 in the longitudinal direction.

Figure 8:
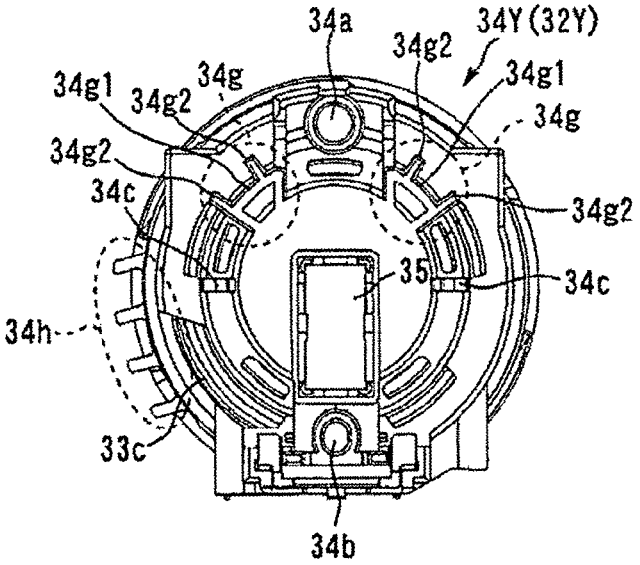
FIG. 8 is a front view of the toner container viewed from a cap portion side.

A second hole 34*b* (sub guide hole) is formed on the lower portion (bottom portion) of the cap portion 34Y such that the second hole 34*b* extends in the longitudinal direction from the end face of the cap portion 34Y perpendicular to the longitudinal direction and so as not to reach the position of the toner outlet W. The second hole 34*b* functions as a sub guide for positioning the cap portion 34Y in the apparatus body 100. More specifically, the second hole 34*b* of the cap portion 34Y is engaged with a sub guide pin 73*b* (see FIGS. 32 and 46) of the cap holding portion 73 in synchronization with the attachment operation of the toner container 32Y to the cap portion 34Y in the longitudinal direction. As illustrated in FIG. 8, the second hole 34*b* is an elongated hole of which elongated direction is parallel to the vertical direction ("the elongated direction" is different from "the longitudinal direction" of the toner container 32Y described above and below).

With use of the two holes 34*a* and 34*b* configured as above, the cap portion 34Y is positioned in the toner-container holder 70. Referring to FIG. 8, a virtual vertical line passing through the center of the first hole 34*a* and a virtual vertical line passing through the center of the second hole 34*b* are on the same straight line and pass through the center of the circle of the cap portion 34 when viewed in the plane perpendicular to the longitudinal direction.

Referring to FIG. 14, the depth of the first hole 34*a* (the length of the main guide pin 73*a* in the longitudinal direction) is greater than the depth of the second hole 34*b* (the length of the sub guide pin 73*b* in the longitudinal direction). Therefore, during the attachment operation of the toner container 32Y to the toner-container holder 70 (the cap holding portion 73) in the longitudinal direction, engagement of the main guide pin 73*a* with the first hole 34*a* as the main positioning guide is started first, and thereafter, engagement of the sub guide pin 73*b* with the second hole 34*b* as the sub positioning guide is started. This allows the toner container 32Y to be smoothly attached to the toner-container holder 70 (the cap holding portion 73). In the first embodiment, the opening of the first hole 34*a* and the opening of the second hole 34*b* are formed on the same virtual plane (a virtual plane perpendicular to the attachment direction), and a base portion of the main guide pin 73*a* and a base portion of the sub guide pin 73*b* are formed on the same virtual plane (a virtual plane perpendicular to the attachment direction). However, even if the openings or the base portions are not formed on the same virtual plane, when a distance difference between a position of the tip of the main guide pin 73*a* and a position of the tip of the sub guide pin 73*b* in the attachment direction is made longer than a distance difference between a position of the opening of the first hole 34*a* and a position of the opening of the second hole 34*b* in the attachment direction, it is possible to first start engagement of the main guide pin 73*a* with the first hole 34*a* as the main positioning guide, and thereafter start engagement of the sub guide pin 73*b* with the second hole 34*b* as the sub positioning guide, similarly to the first embodiment.

The first hole 34*a* that is long in the longitudinal direction is arranged on the ceiling portion of the cap portion 34Y (a portion that is not buried in toner), so that toner conveying capability (flowability) in the cap portion 34Y is not influenced by the first hole. The second hole 34*b* that is short in the longitudinal direction is arranged on the bottom portion of the cap portion 34Y, but the second hole can be arranged by using a small space between the end face of the cap portion 34Y and the position of the toner outlet W and can fully function as the sub positioning guide.

Referring to FIGS. 11 and 12, a first engaging portion 34*e* and second engaging portions 34*f*, which function as regulating portions for regulating the posture of the cap portion 34Y in the horizontal direction perpendicular to the longitudinal direction in the image forming apparatus body 100 (the cap holding portion 73), are formed on the ceiling portion of the cap portion 34Y. The first engaging portion 34*e* and the second engaging portions 34*f* protrude upward in the vertical direction from the outer circumferential surface of the cap portion 34Y so as to be axisymmetric with respect to a virtual vertical line passing through the center of the first hole 34*a* when viewed in the cross-section perpendicular to the longitudinal direction (a cross-section parallel to the front view of FIG. 8), and the first engaging portion 34*e* and the second engaging portions 34*f* extend in the longitudinal direction (a direction normal to the sheet of FIG. 8). The first engaging portion 34*e* and the second engaging portions 34*f* are engaged with an engaged portion 73*m* of the cap holding portion 73 illustrated in FIG. 29. Therefore, the cap portion 34Y is attached to and detached from the cap holding portion 73 while the posture of the cap portion 34Y in the horizontal direction is regulated, and also, the posture of the cap portion 34Y in the horizontal direction while the cap portion 34Y is being attached to the cap holding portion 73 is regulated.

More specifically, the first engaging portion 34*e* (regulating portion) is formed just above the first hole 34*a*, and has an approximately rectangular cross-section when viewed in the cross-section perpendicular to the longitudinal direction. The first engaging portion 34*e* includes a protrusion 34*e*1 that protrudes in the longitudinal direction (attachment direction) relative to the end face of the first hole 34*a*. A tip of the protrusion 34*e*1 has a tapered shape as illustrated in FIG. 11. The second engaging portions 34*f* (regulating portions) are formed on both sides of the first engaging portion 34*e* so as to sandwich the first engaging portion 34*e*. The first engaging portion 34*e* and the second engaging portions 34*f* are fitted into and engaged with the engaged portion 73*m* formed on the cap holding portion 73. When the cap portion 34Y is attached to the cap holding portion 73, the tapered protrusion 34*e*1 of the first engaging portion 34*e* is engaged with the engaged portion 73*m* before the second engaging portions 34*f*, so that the cap portion 34Y can be smoothly attached to the cap holding portion 73.

Referring to FIGS. 11 and 12, shoulder portions 34*q* are formed on the outer circumference of a portion where the insertion portion 34*z* is formed and on both upper sides of the cap portion 34Y. Each of the shoulder portions 34*q* has a flat top face and a flat lateral face that are approximately perpendicular to each other.

When the toner container 32Y is attached to the toner-container holder 70, the shoulder portions 34*q* come into contact with positioning members 73*q* (see FIG. 29), which are arranged on the cap holding portion 73 of the toner-container holder 70, in synchronization with the attachment operation. Accordingly, shaking of the cap portion 34Y in the cap holding portion 73 can be suppressed, so that the cap portion 34Y can be smoothly attached to the cap holding portion 73.

Referring to FIGS. 11 and 12, pressed portions 34*c* protrude on both lateral sides of the cap portion 34Y and from the outer circumferential surface of the cap portion 34Y. The pressed portions 34*c* are pressed in a direction of reaction to a force in the attachment direction (or the detachment direction) by pressing portions 73*d* of the cap holding portion 73 (see FIGS. 29 and 37 to 39) when the cap portion 34Y is attached to (or detached from) the cap holding portion 73 of the toner-container holder 70 (the image forming apparatus body 100). Therefore, during the attachment operation (or the detachment operation) of the toner container 32Y to the cap holding portion 73, a user feels a reaction force to an operating force in the attachment direction (or the detachment direction) at the position where the pressed portions 34*c* and the pressing portions 73*d* are engaged with each other, and accordingly, the user increases the operating force in the attachment direction (or the detachment direction) to complete the attachment operation (or the detachment operation) at one stroke. Thus, the user gains a good click feeling in the attachment operation (or the detachment operation) of the toner container 32Y to the cap holding portion 73.

Referring to FIG. 8, the pressed portions 34*c*, which are formed on the both lateral sides of the cap portion 34Y, are formed on a virtual horizontal plane passing through the center of a tip of the cap portion 34Y (a small-diameter portion where the pressed portions 34*c* and incompatibly-shaped portions 34*g* are formed) and on the outer circumferential surface of the tip. The pressed portions 34*c* protrude on the both sides in the horizontal direction from the outer circumferential surface of the cap portion 34Y such that the pressed portions 34*c* are disposed on a virtual horizontal line passing through the midpoint of a virtual line connecting the center of the first hole 34*a* and the center of the second hole 34*b* when viewed in the cross-section perpendicular to the longitudinal direction. Also, the pressed portions 34*c* extend in the longitudinal direction (a direction normal to the sheet of FIG. 8).

More specifically, as illustrated in FIGS. 11 and 12, the pressed portions 34*c* are formed in cone shapes along the longitudinal direction (attachment direction). The cone shapes of the pressed portions 34*c* are formed such that the slopes on the tip side become more gentle than the slopes on the container body side. Therefore, the user can smoothly perform the attachment/detachment operation with a good click feeling when performing the attachment/detachment operation of the toner container 32Y to the cap holding portion 73.

Referring to FIGS. 11 and 12, the RFID chip 35, which is an electronic-information storage member for storing various types of electronic information, is mounted on a mount portion 34*k* (surrounded by a convex portion) formed between the first hole 34*a* and the second hole 34*b* on the end face of the cap portion 34Y. The RFID chip 35 is arranged so as to face the antenna 73*e* (RFID antenna) of the cap holding portion 73 at a predetermined distance when the cap portion 34Y is attached to the toner-container holder 70 (the cap holding portion 73). The RFID chip 35 performs non-contact communication (radio communication) with the antenna 73*e* while the cap portion 34Y is being held by the cap holding portion 73.

In the first embodiment, because the RFID chip 35 is fixed between the first hole 34*a* (main guide hole) and the second hole 34*b* (sub guide hole), the position of the RFID chip 35 relative to the antenna 73*e* of the cap holding portion 73 can be fixed with high accuracy. Therefore, it is possible to prevent a communication failure due to positional deviation of the RFID chip 35 with respect to the antenna 73*e*.

The protrusion 34*e*1 and projections 34*m* are arranged so as to protrude toward the front face side (right side in FIG. 14) relative to a convex portion (rib) formed on the circumference of the mount portion 34*k*. Therefore, even when the toner container 32Y is placed with the container body 33Y side up and the cap portion 34Y side down, it is possible to prevent the RFID chip 35 held in the mount portion 34*k* from coming into direct contact with a placement surface, thereby preventing the RFID chip 35 from being damaged.

Referring to FIGS. 11 and 12, the incompatibly-shaped portions 34*g* for ensuring the incompatibility of the toner container 32Y are formed on the outer circumferential surface of the cap portion 34Y. That is, according to the present embodiment, the incompatibly-shaped portions 34*g* are arranged not on the container body 33Y but on the outer circumferential surface of the cap portion 34Y.

The incompatibly-shaped portions 34*g* are configured to engage with engagement portions 73*c* (see FIG. 32) of the cap holding portion 73 when the attachment operation of the toner container 32Y to the toner-container holder 70 is correctly performed (when the toner container 32Y is attached to a correct position in the toner-container holder 70).

Figure 27A:
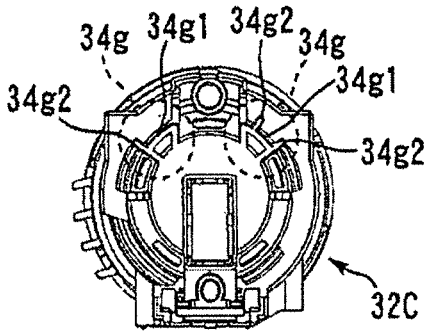
FIGS. 27A to 27C are front views of different types of toner containers viewed from the cap portion side.
Figure 27B:
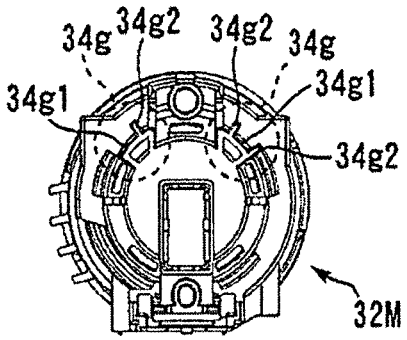
Figure 27C:
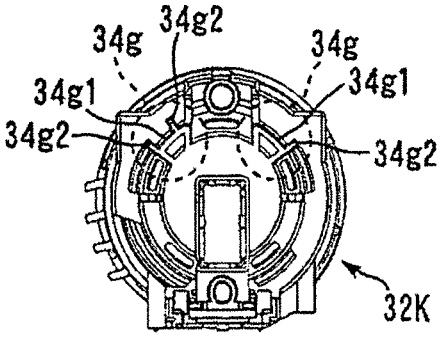
Figure 28A:
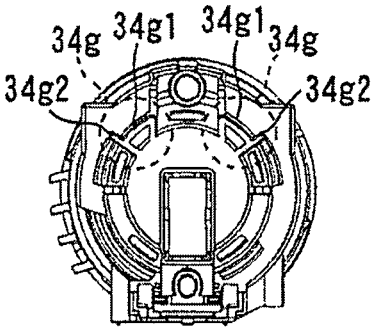
FIGS. 28A to 28E are front views of toner containers as other examples.
Figure 28B:
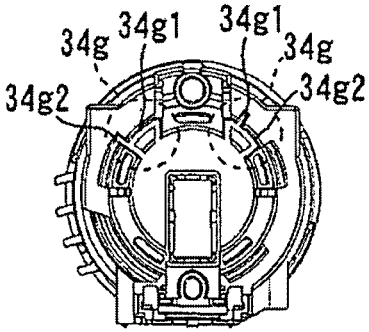
Figure 28C:
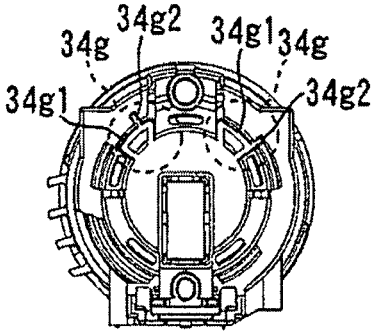
Figure 28D:
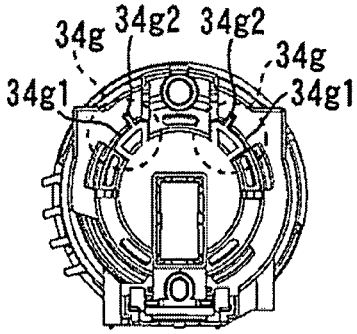
Figure 28E:
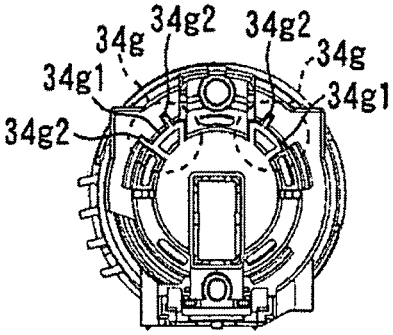

More specifically, referring to FIGS. 8 and 27A to 27C, the incompatibly-shaped portions 34*g* have different shapes depending on colors of toner contained in the toner containers (container bodies). As illustrated in FIG. 27A, the incompatibly-shaped portions 34*g* corresponding to the toner container 32C for cyan have shapes that can be engaged with only the engagement portions 73*c* for cyan in the toner-container holder 70. As illustrated in FIG. 27B, the incompatibly-shaped portions 34*g* corresponding to the toner container 32M for magenta have shapes that can be engaged with only the engagement portions 73*c* for magenta in the toner-container holder 70. As illustrated in FIG. 8, the incompatibly-shaped portions 34*g* corresponding to the toner container 32Y for yellow have shapes that can be engaged with only the engagement portions 73*c* for yellow in the toner-container holder 70. As illustrated in FIG. 27C, the incompatibly-shaped portions 34*g* corresponding to the toner container 32K for black have shapes that can be engaged with only the engagement portions 73*c* for black in the toner-container holder 70.

With the above configuration, it is possible to prevent a toner container for a certain color (for example, a toner container for yellow) from being set in a toner-container holder for a different color (for example, a toner-container holder for cyan), thereby preventing a failure to form a desired color image. That is, it is possible to prevent the toner container from being erroneously set in the toner-container holder.

The shapes of the incompatibly-shaped portions 34*g* for different toner containers are not limited to those illustrated in FIGS. 8 and 27A to 27C. For example, shapes illustrated in FIGS. 28A to 28E may be applied.

The cap portion 34Y of the first embodiment is formed such that each of the incompatibly-shaped portions 34*g* extends toward the container body 33Y side by using the position of the tip in the longitudinal direction as a base point. In addition, the incompatibly-shaped portions 34*g* are formed such that their tips (tips in the attachment direction and on the right side in FIG. 14) are positioned on the front end side in the attachment direction (on the right side in FIG. 14) relative to at least the toner outlet W.

With this configuration, when the attachment operation of the toner container 32Y is performed as illustrated in FIG. 4, and if a toner container for a different color is attached, the incompatibly-shaped portions 34*g* arranged on the tip of the cap portion 34Y are not engaged with but interfere with the engagement portions 73*c* of the cap holding portion 73 before any other portions. Therefore, it is possible to more reliably prevent the shutter member 34*d*, which is covering the toner outlet W of the cap portion 34Y, from being opened, and prevent toner of a different color from being erroneously supplied from the toner outlet W toward the image forming apparatus body 100, compared to the case where the incompatibly-shaped portions 34*g* are arranged on the container body 33Y.

In particular, as illustrated in FIG. 4, because the image forming apparatus body 100 of the first embodiment is configured such the toner container 32Y is placed on the toner-container holder 70 from the upper side and slid relatively short distance in the horizontal direction (longitudinal direction) to complete the attachment operation, if the incompatibly-shaped portions 34*g* are arranged on the container body 33Y, it is difficult to determine the incompatibility of the toner container. Therefore, when the toner container 32Y is attached in the way according to the present embodiment, it is necessary to determine the incompatibility of the toner container at the position of the cap holding portion 73 in the toner-container holder 70. Therefore, the above configuration in which the incompatibly-shaped portions 34g are formed on the tip of the cap portion 34Y is useful.

Referring to FIGS. 8 and 12, the incompatibly-shaped portions 34g are two projections that are radially formed on the upper portion of the tip of the cap portion 34Y. Each of the two projections (the incompatibly-shaped portions 34g) includes a base portion 34g1 and two incompatible claw members 34g2 projecting from the base portion 34g1. The base portion 34g1 has a trapezoidal shape that spreads out outward. The two incompatible claw members 34g2 are arranged so as to radially project outward from the top face of the base portion 34g1.

The incompatible claw members 34g2 are cut off depending on the type (color) of toner contained in the toner container in order to fulfill the incompatible function for each color. That is, as illustrated in FIG. 8, some of the incompatible claw members 34g2 are cut off with a cutting tool, such as a nipper or a cutter, from the cap portion 34Y having the four incompatible claw members 34g2 on the left and right sides, so that the incompatibly-shaped portions 34g of various shapes as illustrated in FIGS. 27A to 27C and 28A to 28E can be formed.

With the above configuration, it is not necessary to manufacture the same number of molds as the number of types of the toner containers (cap portions), and it is possible to form a plurality of types of incompatible cap portions by using one mold. Therefore, it is possible to reduce the entire manufacturing costs for the plurality of types of the toner containers.

Referring to FIGS. 8 and 12, a relatively large space is set between the two incompatible claw members 34g2 in the incompatibly-shaped portions 34g so that the incompatible claw members 34g2 can be easily cut off by using a cutting tool such as a nipper or a cutter.

Referring to FIGS. 11 and 12, the incompatibly-shaped portions 34g are arranged on the upper side of the cap portion 34Y. Accordingly, even when the toner container 32Y (the cap portion 34Y) is inserted into the cap holding portion 73 while the longitudinal direction of the toner container is inclined with respect to the horizontal direction, because the incompatibly-shaped portions 34g cause interference at the positions of the engagement portions 73c of the cap holding portion 73, it is possible to reliably determine the incompatibility of the toner container as described above.

The incompatibly-shaped portions 34g on the tip of the cap portion 34Y are extended in the longitudinal direction in a convex shape at different positions on the outer circumferential surface of the cap portion 34Y depending on each type of the toner container so that each type can be identified. The incompatibly-shaped portions 34g can be used for a purpose other than identifying color of toner contained in the toner container. In the first embodiment, the incompatibly-shaped portions 34g of the cap portion 34Y are formed in the convex shape and the engagement portions 73c of the cap holding portion 73 are formed in the concave shape. However, it is possible to form the incompatibly-shaped portions 34g of the cap portion 34Y in the concave shape and the engagement portions 73c of the cap holding portion 73 in the convex shape.

Referring to FIG. 12, the cap portion 34Y of the first embodiment includes an incompatible convex portion 34h for identifying a destination of the toner container (for example, to Japan, to North America, to Europe, and to other regions). The convex portion 34h is configured to be engaged with an engagement member (not illustrated) formed in the bottle holding portion 72 when the image forming apparatus body 100 as a setting object is compatible (when the cap portion is set in the correct apparatus body 100).

Referring to FIG. 12, the notch portion 34x (insertion port), at which a part of the gear 33c of the container body 33Y is exposed, is formed on the outer circumferential surface of the cap portion 34Y. While the toner container 32Y is being attached to the toner-container holder 70, the gear 33c exposed from the notch portion 34x of the cap portion 34Y engages with the drive gear 81 (disposed at a position indicated by a dashed line in FIG. 29, also see FIGS. 40 to 42) arranged in the cap holding portion 73, so that the drive gear 81 rotates the container body 33Y together with the gear 33c.

Referring to FIGS. 13 and 14, a shutter housing unit (housing unit) 34n is formed on the bottom portion of the cap portion 34Y in order to house a part of the shutter member 34d (the shutter deforming unit 34d2) when the shutter member 34d opens the toner outlet W. The shutter housing unit 34n is a portion in which the bottom face of the insertion portion 34z bulges downward. When viewed in the cross-section perpendicular to the attachment direction (the longitudinal direction) of the toner container 32Y, the inner circumferential surface of the insertion portion 34z is in an approximately circular shape that follows the outer circumference of the container body 33Y, but the shutter housing unit 34n is provided as a space formed of an approximately rectangular portion protruding downward. The portion (the insertion portion 34z) into which the container body 33Y is to be inserted and the shutter housing unit 34n are not specifically separated from each other by a partition, but are integrated as a continued space. Therefore, when the container body 33Y is inserted into the cap portion 34Y, a space with an approximately rectangular cross-section is empty in the lower side of the insertion portion 34z.

The shutter housing unit 34n (housing unit) holds and houses the shutter deforming unit 34d2 after the shutter member 34d opens the toner outlet W. Referring to FIGS. 11 and 12, shutter rails 34t (a second rail unit, see FIG. 20) and slide grooves 34n1 (a first rail unit), which function as a rail unit for guiding the open/close operation of the shutter member 34d, are formed on the inner surface of the shutter housing unit 34n. The slide grooves 34n1 are grooves that extend parallel to the longitudinal direction of the cap portion 34Y from the front face side of the shutter housing unit 34n (right side in FIG. 14). The slide grooves 34n1 and the shutter rails 34t are arranged parallel to each other in the longitudinal direction. The shutter rails 34t are not extended to the shutter housing unit 34n, so that a space remains between the shutter rails 34t and the shutter housing unit 34n. The configuration and operation of the shutter member 34d will be described in detail below.

The cap portion 34Y configured as above communicates with the container body 33Y via the opening A, and discharges toner, which has been discharged from the opening A, from the toner outlet W (movement in the direction of a dashed line arrow in FIG. 3).

In the first embodiment, referring to FIG. 14, the cavity B (space) in an approximately cylindrical shape is formed inside the cap portion 34Y such that the cavity B extends in the longitudinal direction (a horizontal direction in FIG. 14). The inner diameter of the cavity B is smaller than the inner diameter of the insertion portion 34z illustrated in FIG. 17 (a portion into which the head of the container body 33Y is inserted). A toner fall path C, which has a columnar shape with a constant flow passage area (cross-sectional area of the flow passage) from a lower circumferential surface of the approximately-cylindrical cavity B to the toner outlet W, is formed inside the cap portion 34Y. Therefore, toner that has been discharged from the opening A of the container body 33Y to the cavity B of the cap portion 34Y falls through the columnar toner fall path C by own weight and are smoothly discharged from the toner outlet W to the outside (the toner tank 61Y) of the container.

Figure 21:
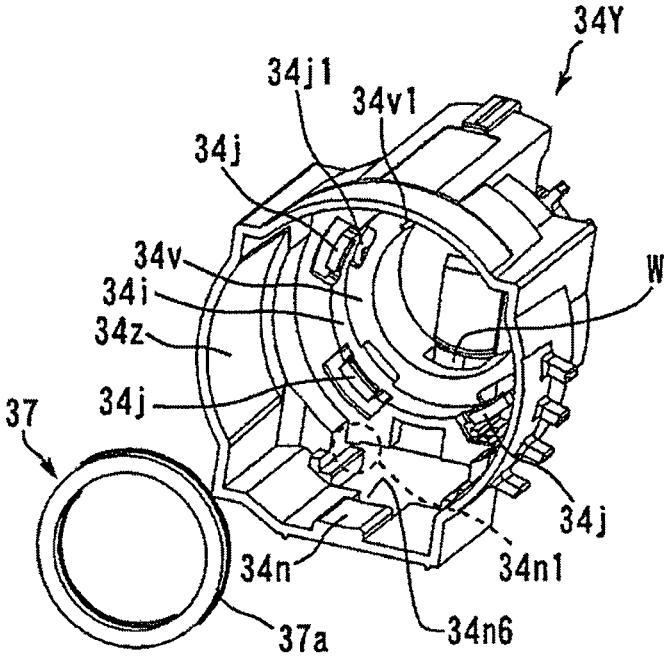
FIG. 21 is a perspective view of how a seal member is detached from the cap portion illustrated in FIG. 19.
Figure 22:
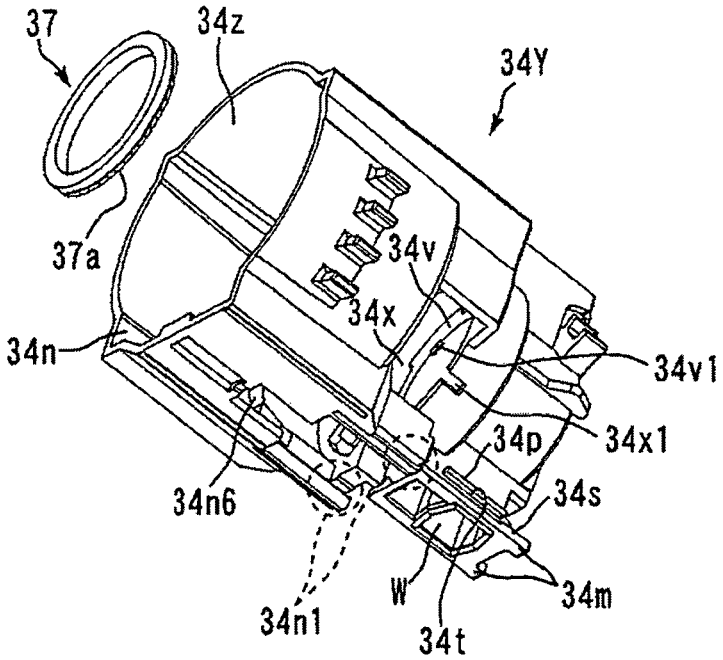
FIG. 22 is a perspective view of how the seal member is detached from the cap portion illustrated in FIG. 20.

Referring to FIGS. 21 and 22, the cap portion 34Y (from which the shutter member 34*d*, the shutter seal 36, the cap seal 37, and the RFID chip 35 are detached) is not formed by welding a plurality of molded components together, but formed by integral molding.

More specifically, the cap portion 34Y has a complicated structure with the claw members 34*j*, the incompatibly-shaped portions 34*g*, the pressed portions 34*c*, the toner outlet W, and the toner fall path C. To form the cap portion 34Y having the complicated structure by integral molding without using a plurality of pairs of molds, all of the members (such as the claw members 34*j*, a plurality of mold-processing holes 34*j*1 and 34*j*3 disposed near the claw members 34*j* for forming the claw members 34*j*, the incompatibly-shaped portions 34*g*, the pressed portions 34*c*, the toner outlet W, and the toner fall path C) need to be configured such that they do not overlap one another when the cap portion 34Y alone is viewed in a projection plane perpendicular to the longitudinal direction (when viewed in a mold separating direction). In particular, because the claw members 34*j* and the mold-processing holes 34*j*1 and 34*j*3 are arranged on the circumference when viewed in the projection plane mentioned above, they need to be formed so as not to overlap any other portions (the incompatibly-shaped portions 34*g*, the pressed portions 34*c*, the toner outlet W, and the toner fall path C).

A claw-member forming unit 34*i* for forming the claw members 34*j* is arranged between the insertion portion 34*z* and the cavity B in the cap portion 34Y. The outer diameter of the claw-member forming unit 34*i* is smaller than the outer diameter of the insertion portion 34*z* and greater than the outer diameter of the portion where the cavity B is formed. Similarly, the inner diameter of the claw-member forming unit 34*i* is smaller than the inner diameter of the insertion portion 34*z* and greater than the inner diameter of the portion where the cavity B is formed.

Figure 24A:
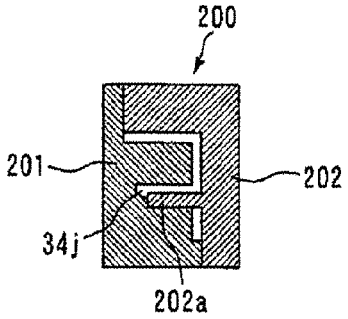
FIGS. 24A and 24B are schematic diagrams of a part of a mold for manufacturing the cap portion by blow molding.
Figure 24B:
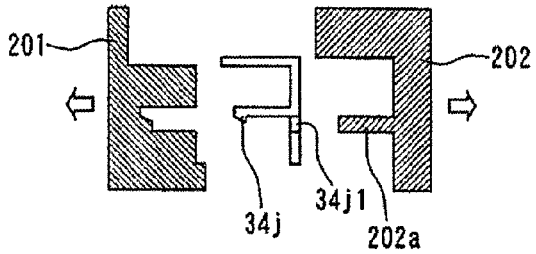

More specifically, a hook portion protruding inward is formed on the tip of each of the claw members 34*j* so as to be engaged with the bottle opening 33*a* (the opening A) of the container body 33Y. FIGS. 24A and 24B are schematic diagrams of a part of a mold 200 for manufacturing the cap portion 34Y with the claw members 34*j* by blow molding.

The mold 200 is formed of an inner mold 201 and an outer mold 202. As illustrated in FIG. 24A, molten resin material is poured between the molds 201 and 202 while the molds 201 and 202 are coupled together, and then a cooling process is performed to form the claw members 34*j* (the cap portion 34Y). Thereafter, as illustrated in FIG. 24B, the molds 201 and 202 are separated from each other to take out the claw members 34*j* (the cap portion 34Y). A stand portion 202*a* for forming the hook portion of each of the claw members 34*j* is formed on the outer mold 202. The first hole 34*j*1, which is a mold-processing hole used for mold processing, is arranged near each of the claw members 34*j* of the cap portion 34Y to allow the stand portion 202*a* of the outer mold 202 to come off in order to separate the molds 201 and 202 from each other. More specifically, a standing wall is disposed between the outer circumference of the claw-member forming unit 34*i* and the outer circumference of the cavity B, and the first hole 34*j*1 is arranged on the wall. This first hole 34*j*1 is the first hole 34*j*1 formed on the inner circumferential surface of each of the claw members 34*j* illustrated in FIG. 23. Referring to FIG. 21, the first holes 34*j*1 formed on the inner circumferential surfaces of the claw members 34*j* are formed on an attachment surface 34*v* to which the cap seal 37 is attached. However, to fulfill the function of the cap seal 37 (sealing capability between the container body 33Y and the cap portion 34Y), the configuration is such that most of the area of the cap seal 37 can be disposed on the attachment surface 34*v* except for the positions of the first holes 34*j*1.

Figure 23:
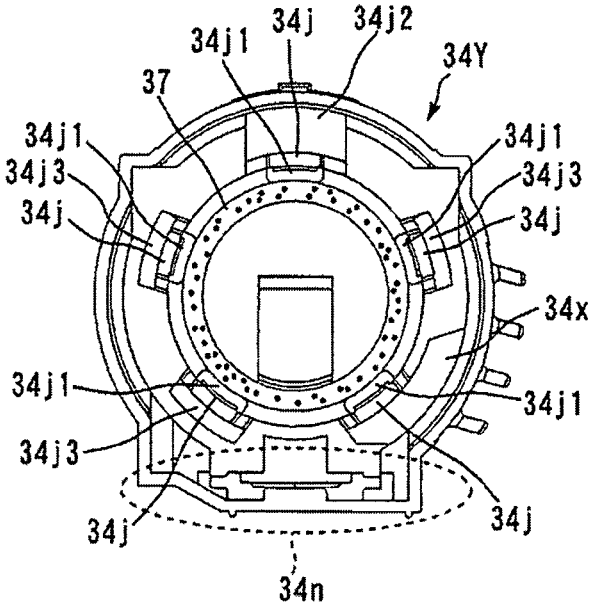
FIG. 23 is a back view of the cap portion viewed from the container body side.

Referring to FIG. 23, the second hole 34*j*3 (mold-processing hole) formed on the outer circumferential surface of each of the claw members 34*j* is used for forming the back face of the claw member 34*j* (face on the side on which the hook portion does not protrude). More specifically, the second holes 34*j*3 are openings formed on a wall surface that stands between the claw-member forming unit 34*i* and the insertion portion 34*z*. Referring to FIG. 23, the notch portion 34*x* functions as the second hole 34*j*3 for the claw member 34*j* formed on the right lower side. Referring to FIG. 23, a concave portion 34*j*2 functions as the second hole 34*j*3 of the claw member 34*j* formed on the uppermost side.

As described above, according to the first embodiment, because the cap portion 34Y is formed by integral molding, dimensional deviation relative to a desired dimension due to variation in bonding or welding accuracy does not occur on the cap portion itself, compared to a cap portion formed by bonding or welding two or more molded components together. Therefore, a gap between the container body 33Y and the cap portion 34Y is less likely to vary. Consequently, it is possible to prevent reduction in the sealing capability of the cap seal 37 between the components 33Y and 34Y and prevent toner scattering that occurs due to positional deviation between the toner outlet W of the cap portion 34Y and the toner supply port 72*w* of the apparatus body 100. Furthermore, because the cap portion 34Y is formed by integral molding, the mechanical strength of the cap portion 34Y itself can become greater and costs for a mold can become lower than the cap portion that is formed by bonding or welding two or more molded components together.

In the first embodiment, the cap portion 34Y is formed by integral molding. However, even when the cap portion is formed by bonding or welding two or more molded components together, if one of the molded components is configured such that at least the claw members 34*j* and the attachment surface 34*v* of the cap seal 37 (i.e., a portion of the cap portion 34Y facing the circumference of the opening of the container body 33Y) are integrated with each other, positional accuracy between the cap seal 37 and the container body 33Y can be increased, and it is possible to prevent toner from leaking from a contact surface between the container body 33Y and the cap seal 37 (prevent reduction in the sealing capability).

Referring to FIGS. 19 to 22, the ring-shaped cap seal 37 as a seal member is attached to an opposing surface of the cap portion 34Y (a surface facing the bottle opening 33*a* formed on the circumference of the opening A of the container body 33Y, i.e., the attachment surface 34*v*). The cap seal 37 is used for sealing the gap between the opposing surfaces of the container body 33Y and the cap portion 34Y at the circumference of the opening A, and is made of elastic material such as polyurethane foam (foamed resin material).

Referring to FIGS. 21 and 22, according to the first embodiment, a recess 34*v*1 is formed on the attachment surface 34*v* of the cap portion 34Y in order to separate the cap seal 37 from the cap portion 34Y. The notch portion 34*x* as an insertion port, into which a bar-shaped jig for separating the cap seal 37 from the cap portion 34Y is inserted, is formed at a position of facing a position of the recess 34*v*1 and on the outer circumferential surface of the cap portion 34Y. A concave portion 34*x*1 used as a pivot point of the jig is formed in a portion of the notch portion 34*x* (insertion port).

With this configuration, even when the toner container 32Y (the cap portion 34Y) is recycled or subjected to maintenance, the cap seal 37 can be easily separated from the cap portion 34Y. More specifically, a bar-shaped jig (for example, a cross-slot screwdriver) is inserted from the notch portion 34*x* (insertion port) and the tip of the jig is inserted into the recess 34*v*1. That is, the tip of the jig is inserted into a part of the lower surface of the cap seal 37 (on the attachment surface side). Then, by engaging the central part of the bar-shaped jig with the concave portion 34*x*1 such that the concave portion 34*x*1 is used as a pivot point, the cap seal 37 is separated from the attachment surface 34*v*.

In the cap seal 37 of the first embodiment, a film member 37*a* is attached to a surface to be attached to the cap portion 34Y. The film member 37*a* is made of material such as polyester film that is harder than the foamed resin material used for forming a main body of the cap seal 37. Therefore, performance of separation operation using the jig can be increased.

The recess 34*v*1 for separating the cap seal 37 is formed at a position that corresponds to the inner circumferential surface side of the cap seal 37 and that is other than a region where the cap seal 37 comes into contact with the container body 33Y. That is, the recess 34*v*1 is formed in a portion outside of the region that actually contributes to the sealing capability in the cap seal 37 and in such a manner that the recess 34*v*1 faces the cap seal 37. Therefore, the cap seal 37 sandwiched between the container body 33Y and the cap portion 34Y is not deformed by the recess 34*v*1, so that it is possible to prevent reduction in the sealing capability between the container body 33Y and the cap portion 34Y.

Figure 20:
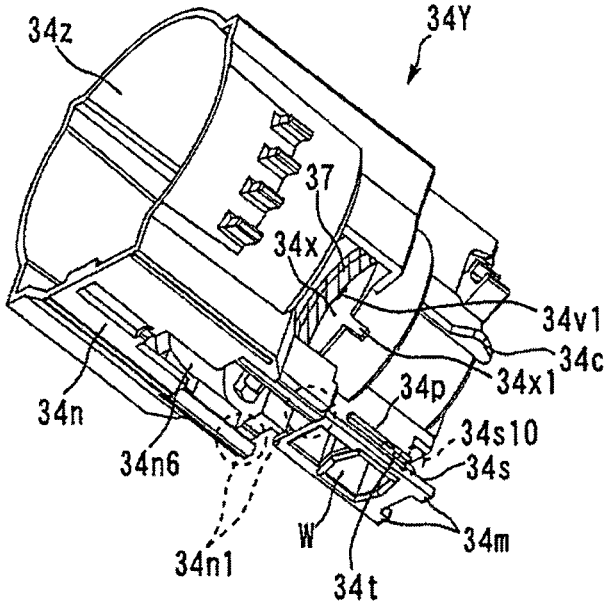
FIG. 20 is another perspective view of the cap portion from which the shutter member is detached.

Referring to FIG. 20, the cap portion 34Y of the first embodiment is configured such that the cap seal 37 (seal member) is disposed on the container body 33Y side (left side in FIG. 14) in the longitudinal direction relative to the pressed portions 34*c* that are disposed on the tip of the cap portion 34Y in the longitudinal direction. In this manner, because the pressed portions 34*c*, which protrude from the outer circumferential surface of the cap portion 34Y and that increase the outer diameter of the cap portion 34, and the cap seal 37, which needs to have a certain attachment area (or the outer diameter of the cap portion 34Y) in accordance with the size of the bottle opening 33*a* (the opening A) of the container body 33Y, are disposed at different positions, it is possible to prevent increase in size (increase in the diameter) of the cap portion 34Y.

More specifically, the cap portion 34Y is formed such that the outer diameter of the tip where the pressed portions 34*c* are formed is made smaller than the outer diameter of the portion where the attachment surface 34*v* for the cap seal 37 is formed. Therefore, the outer diameter of the tip of the cap portion 34Y is not much increased even when the pressed portions 34*c* are formed on the tip. Consequently, it is possible to ensure a relatively large attachment surface for the cap seal 37. That is, it is possible to maintain high sealing capability between the container body 33Y and the cap portion 34Y without increasing the size of the cap portion 34Y, and allow for smooth attachment/detachment operation of the toner container 32Y.

As illustrated in FIGS. 11 and 14, the mount portion 34*k* for mounting the RFID chip 35 is formed on the end face of the cap portion 34Y. The mount portion 34*k* is formed as a wall portion of which circumference protrudes from the end face of the cap portion 34Y. Base portions for fixing four corners of the approximately-rectangular RFID chip 35 are formed at four corners of the rectangular wall portion inside the mount portion 34*k*. By placing the RFID chip 35 on the base portions, an electronic device formed on the back face of the RFID chip 35 (a surface facing a first member 34Y1) does not come into contact with the first member 34Y1. The RFID chip 35 is fixed to the base portions in such a manner that the RFID chip 35 is first placed on the base portions, heat and pressure is applied to a part of the base portions for fusing, and the base portions are cooled to be solidified and joined to the four corners of the RFID chip 35.

As illustrated in FIG. 20, the shutter rails 34*t* (second rail unit) for guiding the shutter member 34*d* to move in the longitudinal direction in order to open and close the toner outlet W is formed on both sides of the bottom portion of the cap portion 34Y. More specifically, the shutter rails 34*t* are formed such that ribbed protrusions, which protrude in a short-edge direction (a direction perpendicular to the longitudinal direction of the toner container 32Y, i.e., the vertical direction on the sheet of FIG. 14) at the edges of the bottom surface where the toner outlet W is formed, are extended in the long-edge direction (a direction parallel to the longitudinal direction of the toner container 32Y). An end portion of each of the protrusions functions as a vertical surface 34*s* described below.

Figure 45:
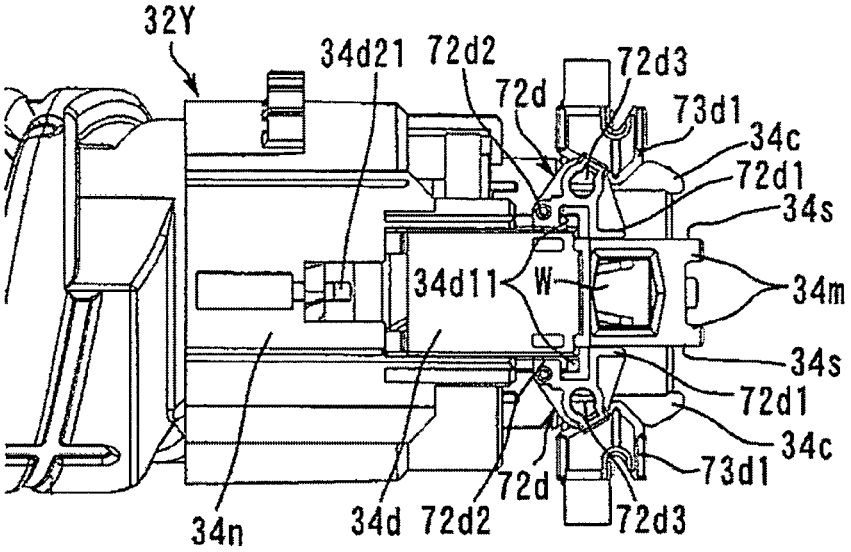
FIG. 45 is a bottom view illustrating a state following the state illustrated in FIG. 44.

The two vertical surfaces 34*s* formed on both side edges of the cap portion 34Y continue from the end of the shutter member 34*d*, which is at a position of closing the toner outlet W in the close direction, to the protruding position in the longitudinal direction (attachment direction) (also see FIG. 45). A locking projection for preventing the shutter member 34*d* from coming off toward the front face side is formed on the upper surface of the end of each of the shutter rails 34*t*. In the first embodiment, portions extending from the locking protrusion toward the container body 33Y side are used as the shutter rails 34*t*. The vertical surfaces 34*s* further extend from the positions of the locking protrusions toward the front face side.

More specifically, two projections 34*m* (horned members) projecting in the longitudinal direction (attachment direction) from the end face of the cap portion 34Y perpendicular to the longitudinal direction are formed on the cap portion 34Y. The two projections 34*m* are disposed so as to sandwich the second hole 34*b* near the bottom edge of the second hole 34*b* in the short-edge direction (the vertical direction on the sheet of FIG. 14). The two vertical surfaces 34*s* include respective vertical surfaces of the side edges of the two projections 34*m*. That is, the vertical surfaces at the outer side edges of the two projections 34*m* are on the same planes as the ribbed vertical surfaces 34*s* on which the shutter rails 34*t* are formed.

The base portion of each of the two projections 34*m* extends to the same height as the rib that forms the second hole 34*b* (the edge of the hole 34*b*), and the base portion forms a part of the rib. The end face, on which the edge of the second hole 34*b* and the base portions of the two projections 34*m* are formed, is on approximately the same plane as the tip end face of the shutter seal 36 (end face on the front face side), which will be described later, when the shutter member 34*d* is closed. In the first embodiment, the horned projections 34*m* being a pair are provided to form the vertical surfaces 34*s*. However, it is possible to connect the tip end faces of the horned projections 34*m* being a pair into one planer projection, and use the both side surfaces of the protrusion as the vertical surfaces 34*s*.

The vertical surfaces 34*s* configured as above are held surfaces held by first holding units 72*d*1 of shutter closing mechanisms 72*d* (shutter holding mechanisms) of the cap holding portion 73 (the toner-container holder 70) (see FIG. 45). That is, the posture of the shutter member 34*d* of the cap portion 34Y set in the cap holding portion 73 is fixed by the shutter closing mechanisms 72*d* that also function as the shutter holding mechanisms.

Because the vertical surfaces 34*s* that functions as the held surfaces are extended in the attachment direction (to the right in FIG. 45), when the toner container 32Y is removed from the toner-container holder 70, a timing at which the shutter closing mechanisms 72*d* (second holding units 72*d*2) release holding of the shutter member 34*d* using the vertical surfaces 34*s* can be delayed relative to a timing at which the shutter closing mechanisms 72*d* completely close the shutter member 34*d*. Therefore, it is possible to prevent the toner container 32Y from being removed from the apparatus body 100 before the shutter member 34*d* completely closes the toner outlet W. In particular, because the tips of the two projections 34*m* in the longitudinal direction (attachment direction) are located so as to protrude relative to the end face of the first hole 34*a* in the longitudinal direction (attachment direction), the shutter closing mechanisms 72*d* (the second holding units 72*d*2) release holding of the shutter, member 34*d* at the end of removal of the cap portion 34Y from the cap holding portion 73. Therefore, it is possible to reliably prevent a closing failure of the shutter member 34*d*.

The configuration and operation of the shutter closing mechanisms 72*d* (the shutter holding mechanisms) will be described in detail below with reference to FIGS. 43 to 45.

Figure 17:
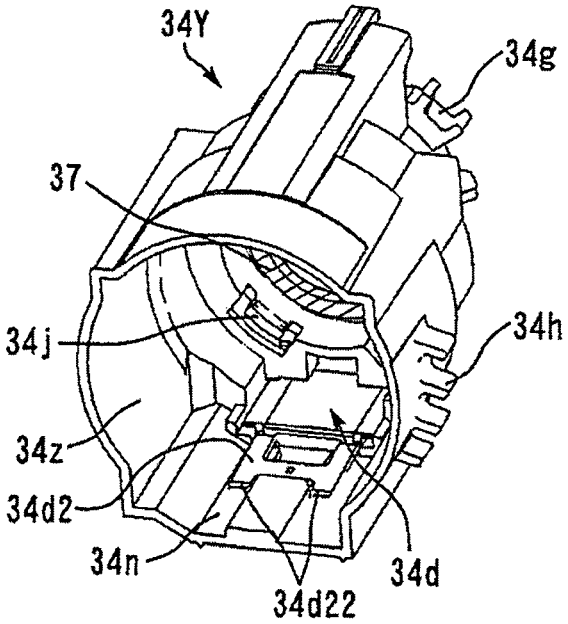
FIG. 17 is a perspective view of the interior of the cap portion in the state illustrated in FIG. 16.

The shutter member 34*d* with the shutter seal 36 attached on a surface facing the toner outlet W is disposed on the bottom portion of the cap portion 34Y configured as above. As illustrated in FIGS. 15 to 17, the shutter member 34*d* opens and closes the toner outlet W in synchronization with the attachment/detachment operation of the toner container 32Y to the toner-container holder 70.

Figure 25:
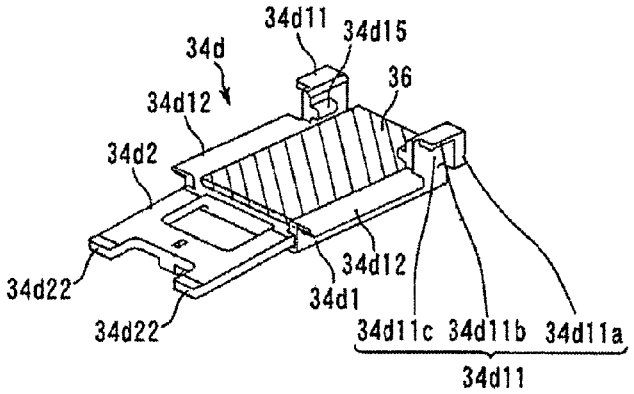
FIG. 25 is a perspective view of the shutter member.
Figure 26:
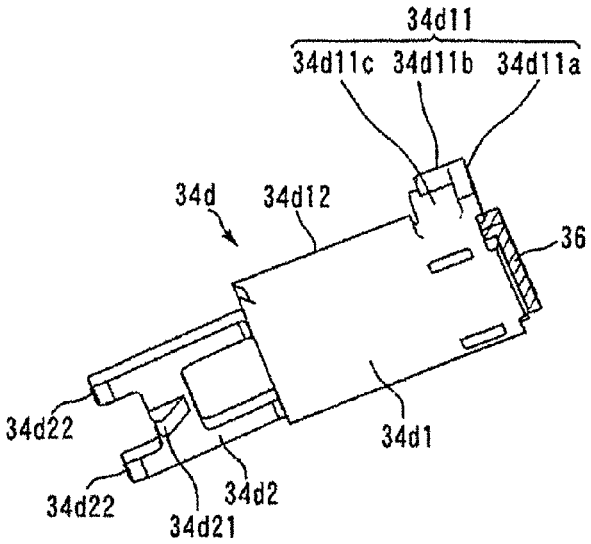
FIG. 26 is another perspective view of the shutter member.

More specifically, referring to FIGS. 25 and 26, the shutter member 34*d* includes a plate-shaped shutter main unit 34*d*1 and the shutter deforming unit 34*d*2. The shutter deforming unit 34*d*2 protrudes from the shutter main unit 34*d*1 to the container body 33Y side (the contained body side in the state where the cap portion 34Y and the container body 33Y are assembled together), is thinner than the shutter main unit 34*d*1, and has elasticity. Shutter sliders 34*d*12 being a pair are formed on both outer sides of the shutter main unit 34*d*1, and shutter-rail engaging portions 34*d*15 being a pair are formed on both inner sides of the shutter main unit 34*d*1. The shutter sliders 34*d*12 are projections that extend on side portions of the shutter main unit 34*d*1 and parallel to the insertion direction of the toner container 32Y. The shutter-rail engaging portions 34*d*15 are projections that project inside the shutter main unit 34*d*1 (on the side opposite to the side where the shutter sliders 34*d*12 protrude) at a predetermined interval with respect to the shutter seal 36.

Each of the shutter sliders 34*d*12 of the shutter main unit 34*d*1 is engaged with corresponding one of the slide grooves 34*n*1 (the first rail unit) of the cap portion 34Y, and each of the shutter rails 34*t* (the second rail unit) of the cap portion 34Y is fitted and sandwiched between corresponding one of the shutter-rail engaging portions 34*d*15 of the shutter main unit 34*d*1 and the shutter seal 36. Accordingly, the shutter member 34*d* moves along the rail units 34*n*1 and 34*t* to allow the shutter main unit 34*d*1 to open and close the toner outlet W.

In the first embodiment, referring to FIG. 20, the longitudinal lengths of the slide grooves 34*n*1 (the first rail unit) formed in the shutter housing unit 34*n* (the lengths in the insertion direction of the toner container 32Y) are shorter than the lengths of the shutter rails 34*t* (the second rail unit) in the longitudinal direction.

The shutter seal 36 as a seal member is attached to the top face of the shutter main unit 34*d*1 (the surface facing the toner outlet W). The shutter seal 36 prevents toner from leaking between the shutter main unit 34*d*1 and the toner outlet W while the toner outlet W is being closed by the shutter main unit 34*d*1 (the shutter member 34*d*). The shutter seal 36 is made of foamed resin material or the like.

As illustrated in FIGS. 25 and 26, the shutter seal 36 of the first embodiment is disposed so as to protrude in the longitudinal direction (attachment direction) from one end of the shutter member 34*d* in the close direction. The tip of the shutter seal 36 (protruding portion) comes into contact with a wall formed on the circumference of the toner supply port 72*w* (see FIG. 29) when the cap portion 34Y is attached to the cap holding portion 73, and functions as a seal member to prevent toner in the toner container 32Y from leaking to the periphery of the toner supply port 72*w*.

Referring to FIGS. 25 and 26, the shutter deforming unit 34*d*2 of the shutter member 34*d* is integrally formed on the shutter main unit 34*d*1 and is elastically deformable in the vertical direction by using the connection position between the shutter deforming unit 34*d*2 and the shutter main unit 34*d*1 as a base point (a portion surrounded by a dashed line in FIGS. 18B and 18C). The shutter deforming unit 34*d*2 is disposed on the container body 33Y side in the longitudinal direction relative to the shutter main unit 34*d*1 (see FIG. 15). Stoppers 34*d*22 and a stopper releasing unit 34*d*21 are formed on the shutter deforming unit 34*d*2. The shutter deforming unit 34*d*2 extends obliquely downward from the shutter main unit 34*d*1 (to the lower side in FIG. 14).

The stoppers 34*d*22 of the shutter deforming unit 34*d*2 are walls formed on the endmost portions (tips of the shutter deforming unit 34*d*2 on the opposite side of the shutter main unit 34*d*1) in the open direction of the shutter deforming unit 34*d*2 (the left side in FIGS. 18A to 18C). The stoppers 34*d*22 come into contact with contact portions 34*n*5 formed on the shutter housing unit 34*n* of the cap portion 34Y, thereby regulating the movement of the shutter member 34*d* in a direction in which the toner outlet W that has been closed is opened. That is, the stoppers 34*d*22 of the shutter member 34*d* are in contact with the contact portions 34*n*5 while the toner container 32Y remains alone (when the toner container 32Y is not set in the apparatus body 100), so that the shutter member 34*d* does not move by itself in the open direction to open the toner outlet W.

The stopper releasing unit 34*d*21 (stopper releasing projection) of the shutter deforming unit 34*d*2 protrudes downward in the vertical direction. The stopper releasing unit 34*d*21 displaces the stoppers 34*d*22 upward along with upward elastic deformation of the shutter deforming unit 34*d*2 upon reception of an external force from the lower side, thereby releasing the state of contact between the stoppers 34*d*22 and the contact portions 34*n*5. The stopper releasing unit 34*d*21 is formed between the stoppers 34*d*22 and the connection position (connection position between the shutter main unit 34*d*1 and the shutter deforming unit 34*d*2), and is a cone-shaped projection with slopes on the both sides in the longitudinal direction. The stopper releasing unit 34*d*21 comes into contact with a stopper-release biasing portion 72*b* (see FIG. 29), which is formed on the bottle holding portion 72, in synchronization with the attachment operation of the toner container 32Y to the toner-container holder 70, and is pushed upward by the stopper-release biasing portion 72*b*

(receives an external force from the lower side). Accordingly, the shutter deforming unit 34*d*2 is elastically deformed upward and the stoppers 34*d*22 are displaced upward. Thus, the contact state between the stoppers 34*d*22 and the contact portions 34*n*5 is released, so that the shutter member 34*d* can move in the open direction.

In the first embodiment, the shutter deforming unit 34*d*2 is inclined downward as described above, so that when the shutter deforming unit 34*d*2 is pushed upward and elastically deformed by the stopper-release biasing portion 72*b*, the inclination is cancelled out and the shutter deforming unit 34*d*2 becomes linear with respect to the shutter main unit 34*d*1. Therefore, the amount of warpage of the shutter deforming unit 34*d*2 in the upward direction with respect to the shutter main unit 34*d*1 in the shutter housing unit 34*n* can be reduced (or the amount of warpage becomes zero). Therefore, it is possible to prevent the shutter deforming unit 34*d*2 housed in the shutter housing unit 34*n* from coming into contact with the container body 33Y, so that the space in the shutter housing unit 34*n* can be efficiently used.

Referring to FIGS. 18A to 18C, the operation of the shutter member 34*d* in synchronization with the attachment operation of the toner container 32Y to the toner-container holder 70 will be described in detail below. The positions of the shutter member 34*d* in FIGS. 18A to 18C correspond to the positions of the shutter member 34*d* in FIGS. 15 and 16.

As illustrated in FIG. 18A, when the attachment operation of the toner container 32Y to the toner-container holder 70 (movement to the right in FIG. 18) is started but the stopper releasing unit 34*d*21 of the shutter member 34*d* does not reach the position of the stopper-release biasing portion 72*b* formed on the bottle holding portion 72 (see FIG. 29), the stoppers 34*d*22 of the shutter member 34*d* are in contact with the contact portions 34*n*5 and the movement of the shutter member 34*d* in the open direction is regulated.

As illustrated in FIG. 18B, when the attachment operation of the toner container 32Y proceeds, the stopper releasing unit 34*d*21 is pushed upward by the stopper-release biasing portion 72*b*, and the shutter deforming unit 34*d*2 is elastically deformed by using the connection position (a portion surrounded by a dashed line) as a base point. Accordingly, the contact state between the stoppers 34*d*22 and the contact portions 34*n*5 is released and the shutter member 34*d* is allowed to relatively move in the open direction.

Thereafter, the shutter member 34*d* comes into contact with the wall formed on the circumference of the toner supply port 72*w* of the cap holding portion 73 (see FIG. 29), so that the movement of the shutter member 34*d* in the toner-container holder 70 (the cap holding portion 73) is regulated (the shutter member 34*d* does not absolutely move in the longitudinal direction). However, the toner container 32Y is allowed to move in the attachment direction, so that the shutter member 34*d* relatively moves in the open direction. That is, as illustrated in FIG. 18C, the shutter member 34*d* relatively moves to the container body 33Y side and the shutter deforming unit 34*d*2 is housed in the shutter housing unit 34*n* (housing unit). Thus, the toner outlet W is completely opened by the movement of the shutter member 34*d* in the open direction. At this time, the stopper releasing unit 34*d*21 of the shutter member 34*d* is stored in a notch portion 34*n*6 of the shutter housing unit 34*n* (also see FIG. 17).

As described above, the toner container 32Y of the first embodiment includes the shutter deforming unit 34*d*2 that is elastically deformed by using the connection position of the shutter main unit 34*d*1 as a base point, and also includes, on the shutter deforming unit 34*d*2, the stoppers 34*d*22 for regulating the movement of the shutter member 34*d* in the open direction and the stopper releasing unit 34*d*21 for releasing the regulation. Therefore, the shutter member 34*d* does not open the toner outlet W by itself while the toner container 32Y remains alone, but opens the toner outlet W in synchronization with the attachment operation only when the toner container 32Y is set in the apparatus body 100.

The shutter-rail engaging portions 34*d*15 of the shutter main unit 34*d*1 (see FIG. 25) also function as second stoppers that come into contact with a second contact portion 34*s*10 formed on the cap portion 34Y (see FIG. 20) and regulate movement of the shutter member 34 in a close direction (the opposite direction of the direction in which the stoppers 34*d*22 perform regulation). That is, when the shutter member 34*d* transits from the state in which the toner outlet W is closed (the state illustrated in FIG. 15) from the state in which the toner outlet W is opened (the state illustrated in FIGS. 16 and 17), the shutter-rail engaging portions 34*d*15 (the second stopper) of the shutter member 34*d* come into contact with the second contact portion 34*s*10 on the front side in the close direction, and the stoppers 34*d*22 of the shutter member 34*d* come into contact with the contact portions 34*n*5 on the rear side in the close direction. Accordingly, the position of the shutter member 34*d* in the close state is fixed.

Referring to FIG. 20, ribs 34*p* having vertical surfaces on the same virtual planes as the vertical surfaces 34*s* of the shutter rails 34*t* (or vertical surfaces parallel to the virtual plane) are extended on the upper sides of the shutter rails 34*t* in the longitudinal direction while groove portions are interposed between the ribs and the shutter rails. The ribs 34*p* prevent the first holding units 72*d*1 from entering the groove portions on the upper sides of the shutter rails 34*t* when the first holding units 72*d*1 of the shutter closing mechanisms 72*d* (shutter holding mechanisms) illustrated in FIGS. 43 to 45 hold the vertical surfaces 34*s* of the shutter rails 34*t*. That is, a distance between the rib 34*p* and the shutter rail 34*t* (a distance of the groove portion) is set to be shorter than the heights of the first holding units 72*d*1 (the lengths in a direction normal to the sheet of FIG. 43).

The ribs 34*p* can fulfill their functions as long as they laterally protrude (in a vertical direction on the sheet of FIG. 14) and extend in the longitudinal direction (the horizontal direction in FIG. 14). Therefore, the ribs 34*p* need not always have the vertical surfaces described above.

Referring to FIGS. 25 and 26, held portions 34*d*11 being a pair are formed on the tips of both edges of the shutter main unit 34*d*1 of the shutter member 34*d* in the attachment direction. As illustrated in FIGS. 43 to 45, the held portions 34*d*11 are held by the second holding units 72*d*2 of the shutter closing mechanisms 72*d* (shutter holding mechanisms) at the time of the open/close operation of the shutter member 34*d*. Each of the held portions 34*d*11 is formed of an engaging wall 34*d*11*a* that stands on the tip of the shutter main unit 34*d*1 in the attachment direction, a suppression wall 34*d*11*b* extending on the upper side of the held portion 34*d*11 and parallel to the attachment direction, and a side wall 34*d*11*c* (which also functions as a side wall of the shutter main unit 34*d*1).

The held portions 34*d*11 of the shutter member 34*d* are held by the second holding units 72*d*2 of the shutter closing mechanisms 72*d* (shutter holding mechanisms) and the vertical surfaces 34*s* of the cap portion 34Y are held by the first holding units 72*d*1 of the shutter closing mechanisms 72*d* (shutter holding mechanisms) at the time of the open/close operation of the shutter member 34*d*, so that the postures of the shutter member 34*d* and the cap portion 34Y in the cap holding portion 73 at the time of the open/close operation of the shutter member 34*d* are fixed. At this time, the second holding units 72*d*2 of the shutter closing mechanisms 72*d*

(shutter holding mechanisms) hold the side walls 34*d*11*c* of the held portions 34*d*11 (the shutter main unit 34*d*1), and the suppression walls 34*d*11*b* function to suppress vertical movement of the held portions 34*d*11 relative to the second holding units 72*d*2. The engaging walls 34*d*11*a* of the held portions 34*d*11 are engaged with the second holding units 72*d*2, which will be described later.

Referring to FIG. 15, the toner container 32Y of the first embodiment is configured such that the stopper releasing unit 34*d*21 of the shutter member 34*d* is disposed on the container body 33Y side (left side in FIG. 14) relative to the incompatibly-shaped portions 34*g* of the cap portion 34Y in the longitudinal direction. That is, the stopper releasing unit 34*d*21 is formed on the left side in FIG. 14 relative to the position where the incompatibly-shaped portions 34*g* are formed.

With this configuration, when the attachment operation of the toner container 32Y is performed as illustrated in FIG. 4, and if the toner container for a different color is attached, the incompatibly-shaped portions 34*g* formed on the tip of the cap portion 34Y come into contact with but are not engaged with the engagement portions 73*c* of the cap holding portion 73 before any other portions. Therefore, it is possible to reliably prevent the shutter member 34*d*, which is covering the toner outlet W of the cap portion 34Y, from starting the opening operation (operation of releasing the stoppers 34*d*22 by the stopper releasing unit 34*d*21), and prevent toner of a different color from being erroneously supplied to the image forming apparatus body 100 from the toner outlet W.

In particular, as illustrated in FIG. 4, because the image forming apparatus body 100 of the first embodiment is configured such that the toner container 32Y is placed on the toner-container holder 70 from the upper side and slid in the horizontal direction (longitudinal direction) to complete the attachment operation, it is necessary to determine the incompatibility of the toner container at the position of the cap holding portion 73 in the toner-container holder 70. Therefore, the above configuration in which the incompatibly-shaped portions 34*g* are arranged on the tip of the cap portion 34Y is useful.

As described above, the toner container 32Y of the first embodiment includes the slide grooves 34*n*1 (first rail unit) and the shutter rails 34*t* (second rail unit) as the rail units for guiding the shutter main unit 34*d*1 of the shutter member 34*d* to open and close the toner outlet W.

Referring to FIG. 20, the slide grooves 34*n*1 (first rail unit) are extended in the longitudinal direction to support the shutter deforming unit 34*d*2 side of the shutter main unit 34*d*1 (the left side in FIG. 14). On the other hand, the shutter rails 34*t* (second rail unit) extend in the longitudinal direction to support a side of the shutter main unit 34*d*1 (the right side in FIG. 14) opposite to the shutter deforming unit 34*d*2 side. That is, the both sides of the shutter main unit 34*d*1 in the longitudinal direction are supported by the slide grooves 34*n*1 (first rail unit) and the shutter rails 34*t* (second rail unit).

Referring to FIG. 20, the lengths of the slide grooves 34*n*1 (first rail unit) in the longitudinal direction (the lengths in the insertion direction of the toner container 32Y) of the shutter housing unit 34*n* are made shorter than the lengths of the shutter rails 34*t* (second rail unit) in the longitudinal direction. The slide grooves 34*n*1 are also made shorter than the shutter sliders 34*d*12 of the shutter member 34*d*.

More specifically, referring to FIG. 20, the shutter rails 34*t* (the groove portions sandwiched between the vertical surfaces 34*s* and the ribs 34*p*) are formed such that the lengths in the longitudinal direction are relatively long, ranging from about 15 mm to 20 mm. On the other hand, referring to FIGS. 19 and 20, the slide grooves 34*n*1 (the groove portions surrounded by the upper wall, the side walls, and the lower wall, and surrounded by a dashed line in the figure) are formed such that the lengths in the longitudinal direction are relatively short, ranging from about 1 mm to 2 mm. The ends of the slide grooves 34*n*1 are on the same plane as the other wall surfaces inside the cap portion 34Y. That is, the lengths of the slide grooves 34*n*1 in the longitudinal direction are the same as the thickness of the cap portion 34Y.

In other words, the cap portion 34Y of the first embodiment is configured such that a distance between a portion supported by the slide grooves 34*n*1 and a portion supported by the shutter rails 34*t* in the shutter main unit 34*d*1 is gradually shortened as the operation of opening the toner outlet W by the shutter member 34*d* proceeds. That is, a distance (a distance in the longitudinal direction) between the position of the slide grooves 34*n*1 illustrated in FIG. 20 (the position where the slide grooves 34*n*1 and the shutter sliders 34*d*12 come into contact with each other) and a position where the shutter rails 34*t* and the shutter sliders 34*d*12 come into contact with each other is gradually shortened as the opening operation of the shutter member 34*d* proceeds.

Therefore, when the shutter member 34*d* completely opens the toner outlet W (the state illustrated in FIGS. 16 and 17, in which the shutter deforming unit 34*d*2 is housed in the shutter housing unit 34*n*), the shutter main unit 34*d*1 is supported with a short span between the slide grooves 34*n*1 and the shutter rails 34*t*. Therefore, compared to the shutter main unit 34*d*1 supported with a long span (the state illustrated in FIG. 15), the shutter main unit 34*d*1 easily moves in the vertical direction, so that the degree of elastic deformation of the shutter deforming unit 34*d*2 (which is elastically deformed by the contact with the shutter housing unit 34*n*) connected to the end of the shutter main unit 34*d*1 (the end on the container body 33Y side) is reduced. When continuously observed along with the opening operation of the shutter member 34*d*, the amount of the elastic deformation of the shutter deforming unit 34*d*2 becomes maximum when the stopper releasing unit 34*d*21 releases the stoppers 34*d*22 (when the stopper-release biasing portion 72*b* of the apparatus body 100 pushes the stopper releasing unit 34*d*21 upward), and thereafter, the amount of the elastic deformation gradually decreases along with decrease in the span with which the shutter main unit 34*d*1 is supported by the slide grooves 34*n*1 and the shutter rails 34*t*.

With this configuration, even when the shutter member 34*d* keeps the toner outlet W open for a long time (the state illustrated in FIGS. 16 and 17, in which the shutter deforming unit 34*d*2 is housed in the shutter housing unit 34*n*), it is possible to prevent plastic deformation of the shutter member 34*d*, similarly to when the shutter member 34*d* keeps the toner outlet W closed (the state illustrated in FIG. 15). Therefore, even after the shutter member 34*d* has performed the open/close operation, it is possible to prevent toner from leaking from the circumference of the shutter member 34*d*. In addition, because the amount of the elastic deformation of the shutter deforming unit 34*d*2 gradually decreases as the opening operation of the shutter member 34*d* proceeds, the attachment operation of the toner container 32Y (the opening operation of the shutter member 34*d*) can be smoothly performed.

The configuration described above may be modified such that when the shutter member 34*d* completely opens the toner outlet W (the states illustrated in FIGS. 16 and 17), the portions of the shutter main unit 34*d*1 supported by the shutter rails 34*t* (second rail unit) are separated from the shutter rails 34*t* and the shutter main unit 34*d*1 is supported only by the slide grooves 34*n*1 (first rail unit). In this case, because the shutter main unit 34*d*1 is supported only by the slide grooves 34*n*1 while the shutter member 34*d* keeps the toner outlet W completely open, the amount of move of the shutter main unit 34*d*1 can be further increased and the amount of the elastic deformation of the shutter deforming unit 34*d*2 can be further reduced. As a result, it is possible to further ensure the effects described above.

In the first embodiment, referring to FIG. 15, the notch portion 34*n*6, which is a hole for reducing a contact force between the stopper releasing unit 34*d*21 and the shutter housing unit 34*n*, is formed at a position on the shutter housing unit 34*n* (housing unit) and through which the stopper releasing unit 34*d*21 of the shutter deforming unit 34*d*2 passes along with the opening operation of the shutter member 34*d*. Because the notch portion 34*n*6 (hole) is arranged on the shutter housing unit 34*n*, the stopper releasing unit 34*d*21 does not come into contact with (is not pushed by) the upper surface of the shutter housing unit 34*n* when the shutter deforming unit 34*d*2 is housed in the shutter housing unit 34*n* along with the opening operation of the shutter member 34*d*. Therefore, the elastic deformation of the shutter deforming unit 34*d*2 that occurs along with the operation of the shutter member 34*d* can be reduced.

In the first embodiment, the notch portion 34*n*6 (hole) is formed to reduce the contact force between the stopper releasing unit 34*d*21 and the shutter housing unit 34*n*. However, it is possible to arrange a groove in the same area as described above, instead of the notch portion 34*n*6 (hole).

In the first embodiment, the notch portion 34*n*6 (hole) is formed at a position (area) through which the stopper releasing unit 34*d*21 of the shutter deforming unit 34*d*2 passes along with the opening operation of the shutter member 34*d*. However, it is possible to form a hole or a groove at a position where the stopper releasing unit 34*d*21 stops at the end of the opening operation of the shutter member 34*d*. In this case, it is possible to reduce the elastic deformation of the shutter deforming unit 34*d*2 while the shutter deforming unit 34*d*2 is housed in the shutter housing unit 34*n* (in the state illustrated in FIGS. 16 and 17).

The shutter housing unit 34*n* (housing unit) of the first embodiment is used for smoothly performing the open/close operation of the shutter member 34*d*. That is, because the shutter housing unit 34*n* is arranged on the cap portion 34Y, even while the shutter member 34*d* keeps the toner outlet W open, the shutter member 34*d* remains integrated with the cap portion 34Y without protruding downward from the cap portion 34Y in the same manner as when the shutter member 34*d* keeps the toner outlet W closed. Therefore, the open/close operation of the shutter member 34*d* can be smoothly performed.

As illustrated in FIG. 23, the cap portion 34Y of the first embodiment is configured such that, when viewed in the cross-section perpendicular to the longitudinal direction, one of the five claw members 34*j*, which are arranged in parallel in the circumferential direction and which rotatably hold the container body 33Y, is disposed on an upper portion opposite to the shutter housing unit 34*n* in the cap portion 34Y, and any of the claw members 34*j* is not disposed at the position of the shutter housing unit 34*n*. As described above, because the shutter housing unit 34*n* is a portion for housing the shutter deforming unit 34*d*2, a gap with the container body 33Y remains large and it is difficult to form the claw members 34*j* on the shutter housing unit 34*n* because of the structure. Therefore, a force for holding the container body 33Y (regulating force) is reduced at the bottom portion of the cap portion 34Y (portion where the shutter housing unit 34*n* is arranged) because of the structure. However, according to the first embodiment, because one claw member 34*j* is disposed on the upper portion opposite to the shutter housing unit 34*n*, even when the regulating force of the cap portion 34Y is small on the lower side of the container body 33Y and the container body 33Y is likely to incline in the vertical direction, the claw member 34*j* arranged on the upper portion opposite to the shutter housing unit 34*n* can hold the container body 33Y so that the inclination can be cancelled out. Therefore, the cap portion 34Y can hold the container body 33Y with good balance in the circumferential direction.

In addition, referring to FIG. 14, the cap portion 34Y of the first embodiment includes a protrusion H that is arranged near the shutter housing unit 34*n* for reducing the gap with the container body 33Y.

With this configuration, even when the regulating force of the cap portion 34Y is small on the lower side of the container body 33Y and the container body 33Y is likely to incline in the vertical direction as described above, the inclination is regulated by the contact between the protrusion H of the cap portion 34Y and the container body 33Y. Therefore, the cap portion 34Y can hold the container body 33Y with good balance in the circumferential direction.

Referring to FIGS. 16 and 45, the toner outlet W of the cap portion 34Y, which is opened and closed by the shutter member 34*d* configured as above, has a hexagonal shape when viewed from the lower side in the vertical direction.

More specifically, an edge portion 34*r* protruding downward is formed on the circumference of the toner outlet W of the cap portion 34Y. The edge portion 34*r* has tips 34*r*1 on the both sides in the longitudinal direction (the horizontal direction in FIG. 45). Each of the tips 34*r*1 has a pointed shape that is pointed in a longitudinal direction so as to be separated from the center of the toner outlet W. More specifically, when viewed from the lower side in the vertical direction, the edge portion 34*r* is a hexagonal edge portion having parallel portions 34*r*2 that are opposed to each other along the longitudinal direction, and the two vertex portions 34*r*1 that are positioned on the tips opposing to each other in the longitudinal direction. The toner outlet W has a hexagonal shape that follows the hexagonal shape of the edge portion 34*r*.

In this manner, the tips 34*r*1, which are formed on the edge portion 34*r* on the circumference of the toner outlet W in the longitudinal direction (the direction in which the shutter member 34*d* is opened and closed), have pointed shapes, so that when the shutter member 34*d* is closed, the shutter seal 36 attached to the shutter member 34*d* first comes into slide contact with the edge portion 34*r* at the pointed-shaped tip 34*r*1 with a small area, and thereafter, the area of the slide contact gradually increases. Therefore, the shutter seal 36 is less likely to be peeled off or damaged due to the contact with the edge portion 34*r*. When the shutter member 34*d* is opened, the area of the slide contact gradually decreases, so that the damage on the shutter seal 36 due to the contact with the edge portion 34*r* is reduced.

Figure 46:
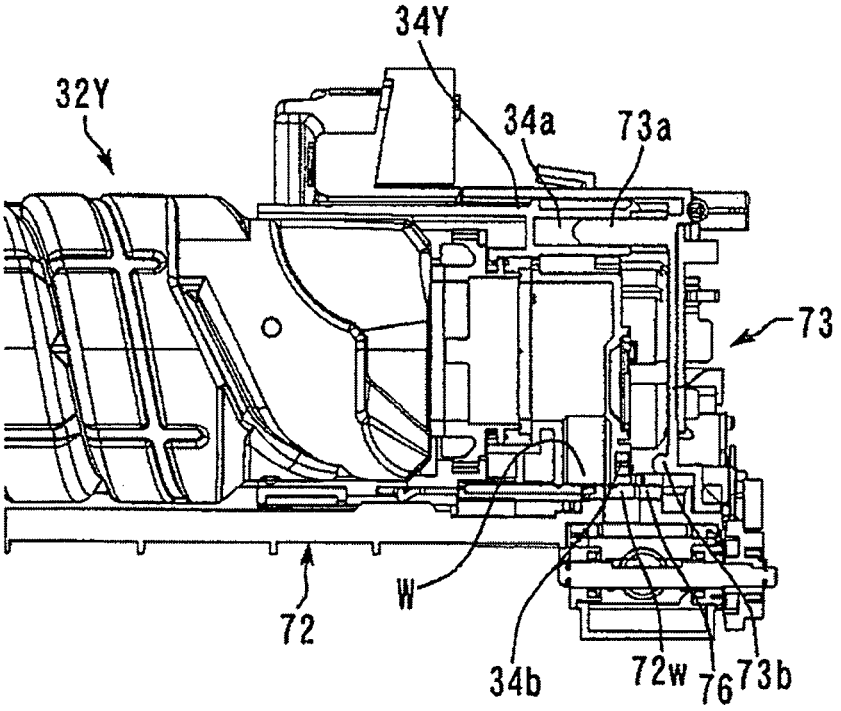
FIG. 46 is a cross-sectional side view of how the cap portion of the toner container is attached to the cap holding portion of the toner-container holder.

Referring to FIG. 46, a seal member 76 made of foamed resin material is attached to the circumference of the toner supply port 72*w* of the cap holding portion 73, so that it is possible to prevent toner from scattering from the toner supply port 72*w* communicating with the toner outlet W of the toner container 32Y. Even when the edge portion 34*r* of the cap portion 34Y comes into slide contact with the seal member 76 arranged on the circumference of the toner supply port 72*w* along with the attachment operation of the toner container 32Y in the longitudinal direction, the edge portion 34*r* and the seal member 76 come into slide contact with each other first at the edge portion 34*r* with a small area, and thereafter, the area of the slide contact gradually increases.

Therefore, the seal member 76 of the toner supply port 72*w* is less likely to be peeled off or damaged due to the contact with the edge portion 34*r*. In addition, when the detachment operation of the toner container 32Y in the longitudinal direction is performed, the area of the slide contact between the seal member 76 of the toner supply port 72*w* and the edge portion 34*r* gradually decreases, so that damage on the seal member 76 of the toner supply port 72*w* due to the contact with the edge portion 34*r* can be reduced.

Therefore, it is possible to reliably prevent toner (or remaining toner) housed in the toner container 32Y from scattering to the outside along with the attachment/detachment operation of the toner container 32Y to the apparatus body 100.

Referring to FIG. 16, in the first embodiment, the edge portion 34*r* of the cap portion 34Y is configured such that planes (planes in contact with the tips 34*r*1) normal to the longitudinal direction (the horizontal direction illustrated in FIG. 45) have tapered shapes so that the amount of downward protrusion gradually decreases from the center of the toner outlet W.

With this configuration, even when the shutter seal 36 attached to the shutter member 34*d* is rubbed by the edge portion 34*r* along with the attachment/detachment operation of the toner container 32Y in the longitudinal direction, the shutter seal 36 is less likely to be damaged. Similarly, even when the seal member 76 (see FIG. 46) arranged on the circumference of the toner supply port 72*w* of the cap holding portion 73 is rubbed by the edge portion 34*r* along with the attachment/detachment operation of the toner container 32Y in the longitudinal direction, the seal member 76 is less likely to be damaged.

In the first embodiment, assuming that the volume-average particle size of toner contained in the toner containers 32Y, 32M, 32C, and 32K is Dv (μm) and the number-average particle size is Dn (μm), following relationships are satisfied.

$$3 \leq Dv \leq 8 \quad (1)$$

$$1.00 \leq Dv/Dn \leq 1.40 \quad (2)$$

Therefore, toner particles corresponding to an image pattern are selected at the time of a developing process, so that good image quality can be maintained, and, even when the toner is stirred in the developing device for a long time, good developing capability can be maintained. In addition, toner can be efficiently and reliably conveyed without blocking the toner supply path such as a tube 71.

The volume-average particle size and the number-average particle size of toner are measured by using, for example, Coulter-counter particle size distribution measurement device such as "COULTER COUNTER TA-2" (Beckman Coulter, Inc) or "COULTER MULTISIZER 2" (Beckman Coulter, Inc).

In the first embodiment, as the toner contained in the toner containers 32Y, 32M, 32C, and 32K, approximately spherical toner with a shape factor SF-1 in a range from 100 to 180 and with a shape factor SF-2 in a range from 100 to 180 is used. Therefore, it is possible to maintain high transfer efficiency and prevent reduction in cleaning performance. In addition, toner can be efficiently and reliably conveyed without blocking the toner supply path such as the tube 71.

The shape factor SF-1 represents the degree of sphericity of a toner particle, and is obtained by the following Equation.

$$SF\text{-}1=(M^2/S)\times(100\pi/4)$$

In the above Equation, M is the maximum particle size in a projection plane of the toner particle (the largest particle size among various particle sizes), and S is an area of the projection plane of the toner particle. Therefore, a toner particle with the shape factor SF-1 of 100 is perfectly spherical, and the sphericity decreases as the shape factor becomes greater than 100.

The shape factor SF-2 represents the irregularity of a toner particle, and is determined by the following Equation.

$$SF\text{-}2=(N^2/S)\times(100/4\pi)$$

In the Equation, N is the circumferential length in the projection plane of the toner particle, and S is an area of the projection plane of the toner particle. Therefore, a toner particle with the shape factor SF-2 of 100 has no irregularities, and the irregularity increases as the shape factor becomes greater than 100.

The shape factor SF-1 and the shape factor SF-2 are obtained by photographing a toner particle by a scanning electron microscope "S-800" (manufactured by Hitachi, Ltd.) and analyzing the obtained photograph of the toner particle by an image analyzer "LUSEX3" (manufactured by Nireco Corp.).

The toner-container holder 70 (the bottle holding portion 72 and the cap holding portion 73) will be described in detail below with reference to FIGS. 29 to 46.

As described above with reference to FIG. 4, the toner-container holder 70 includes the bottle holding portion 72 and the cap holding portion 73. The toner container 32Y is first placed, by a user, on a bottle holding face 72*a* of the bottle holding portion 72 from the upper side while the toner container 32Y is oriented so that the longitudinal direction is parallel to the horizontal direction, and thereafter, the toner container 32Y is pushed into the cap holding portion 73 while sliding on the bottle holding face 72*a* in the longitudinal direction, which is the attachment direction, with the cap portion 34Y positioned at the leading end of the container body 33Y.

Figure 29:
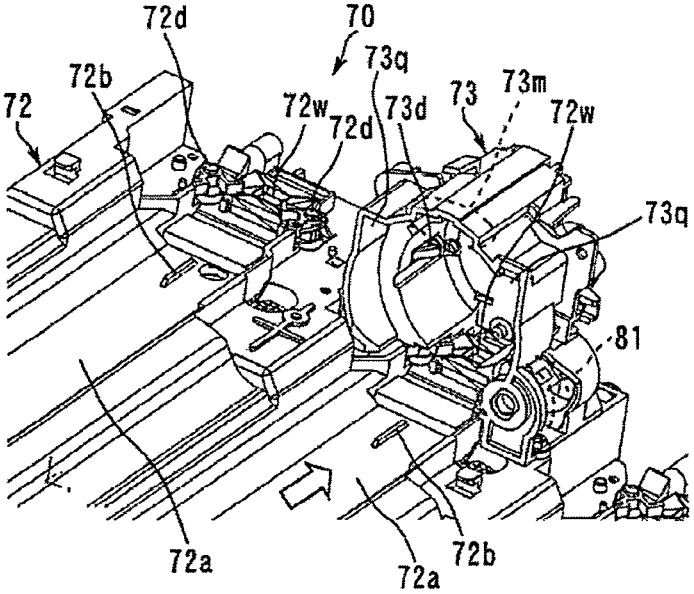
FIG. 29 is a perspective view of the vicinity of a bottle holding portion in the toner-container holder.

Referring to FIGS. 29 and 30, the bottle holding face 72*a* is formed on the bottle holding portion 72 for each color, and the cap holding portion 73 is formed on the bottle holding portion 73 for each color. The toner containers 32Y, 32M, 32C, and 32K are inserted into the respective bottle holding faces 72*a* and the respective cap holding portions 73 (in a direction of a white arrow), so that each cap portion is non-rotatably held by each of the bottle holding portions 72.

In FIGS. 29, 30, 34 to 36, and 40 to 42, some of the four cap holding portions 73 are not illustrated for the sake of clarification of the configuration of the bottle holding portion 72.

Referring to FIGS. 29 to 31, the bottle holding portion 72 of the toner-container holder 70 includes the bottle holding face 72*a*, the stopper-release biasing portion 72*b*, the shutter closing mechanisms 72*d* as the shutter holding mechanisms, the toner supply port 72*w*, and the seal member 76.

The bottle holding face 72*a* functions as a sliding face of the toner container 32Y at the time of the attachment/detachment operation of the toner container 32Y, and functions as a holding unit of the rotatable container body 33Y after setting of the toner container 32Y is complete.

The stopper-release biasing portion 72*b* is a trapezoidal rib formed on the cap holding portion 73 side (downstream side in the attachment direction of the toner container 32Y) on the bottle holding face 72*a*. As described above with reference to FIG. 18, the stopper-release biasing portion 72*b* pushes the stopper releasing unit 34*d*21 of the cap portion 34Y upward to release the contact state between the stoppers 34*d*22 and the contact portions 34*n*5 in synchronization with the attachment operation of the toner container 32Y (in order to allow the opening operation of the shutter member 34*d*).

Referring to FIGS. 29 to 31 and 43 to 45, the shutter closing mechanisms 72*d* (shutter holding mechanisms) are disposed at positions on the bottle holding portion 72 that is covered by the cap holding portion 73, and on the upstream side of the toner supply port 72*w* in the attachment direction of the toner container 32Y. The shutter closing mechanisms 72*d* being a pair are approximately horseshoe-shaped members that are arranged so as to face each other in the vertical direction in FIG. 43, and are rotatable about support shafts 72*d*3 at which torsion coil springs are arranged. The first holding units 72*d*1 are formed on one end of the respective shutter closing mechanisms 72*d* (shutter holding mechanisms), and the second holding units 72*d*2 are formed on the other ends of the shutter closing mechanisms 72*d*. As described above, the held portions 34*d*11 of the shutter member 34*d* are held by the second holding units 72*d*2 and the vertical surfaces 34*s* of the cap portion 34Y are held by the first holding units 72*d*1 at the time of the open/close operation of the shutter member 34*d* in the toner container 32Y, so that the postures of the shutter member 34*d* and the cap portion 34Y in the cap holding portion 73 at the time of the open/close operation of the shutter member 34*d* are fixed. Consequently, it is possible to smoothly perform the open/close operation.

The operation of the shutter closing mechanisms 72*d* (shutter holding mechanisms) along with the open/close operation of the shutter member 34*d* will be described later with reference to FIGS. 43 to 45.

Referring to FIGS. 29 to 33, the cap holding portion 73 of the toner-container holder 70 includes the main guide pin 73*a*, the sub guide pin 73*b*, the engagement portions 73*c*, the pressing portions 73*d*, the engaged portion 73*m*, the antenna 73*e* (RFID antenna), the drive gear 81, and a bearing 73*k*.

As described above with reference to FIG. 11, the main guide pin 73*a* and the sub guide pin 73*b* are engaged with the first hole 34*a* and the second hole 34*b* of the cap portion 34Y, respectively. Accordingly, the position of the cap portion 34Y in the cap holding portion 73 is fixed.

Figure 32:
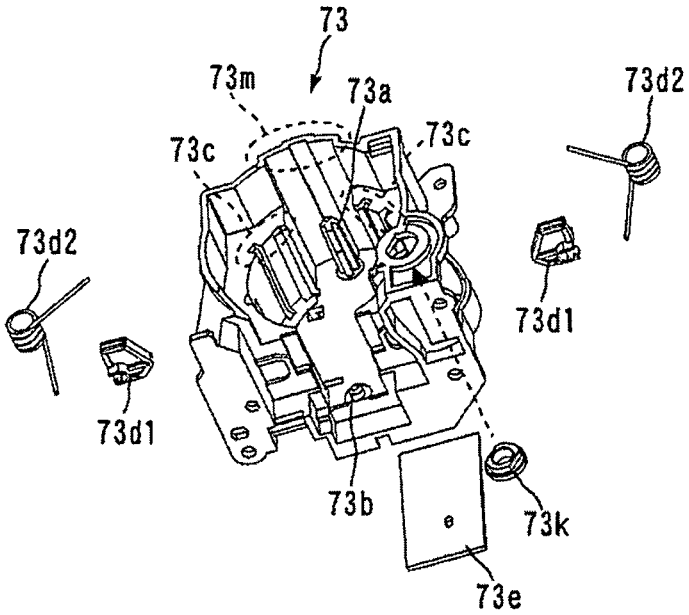
FIG. 32 is an exploded perspective view of a cap holding portion of the toner-container holder.

Referring to FIGS. 32 and 46, the main guide pin 73*a* is longer than the sub guide pin 73*b* in the longitudinal direction (positions of the guide surfaces that function as the base portions are formed on the same plane). Both of the main guide pin 73*a* and the sub guide pin 73*b* extend in the longitudinal direction (attachment/detachment direction of the toner container 32Y). The main guide pin 73*a* is formed such that the tip is gradually tapered. Therefore, it is possible to smoothly attach the toner container 32Y to the cap holding portion 73 in the attachment operation of the toner container 32Y to the cap holding portion 73 in the longitudinal direction.

The engaged portion 73*m* is engaged with the first engaging portion 34*e* and the second engaging portions 34*f* (regulating portions) formed on the cap portion 34Y of the toner container 32Y. Therefore, the cap portion 34Y is attached to and detached from the cap holding portion 73 while the posture of the cap portion 34Y is regulated. Furthermore, the posture of the cap portion 34Y while the cap portion 34Y is being attached to the cap holding portion 73 is regulated.

The engagement portions 73*c* are engaged with the incompatibly-shaped portions 34*g* formed on the tip of the cap portion 34Y of the toner container 32Y. Because the engagement portions 73*c* corresponding to the incompatibly-shaped portions 34*g* of the toner container 32Y are arranged on the cap holding portion 73, it is possible to prevent a toner container for a certain color (for example, toner container for yellow) from being erroneously set in a toner-container holder for a different color (for example, a toner-container holder for cyan).

Referring to FIG. 32, the engagement portions 73*c* are arranged on the side near the bottle holding portion 72 in the longitudinal direction on the cap holding portion 73. Therefore, because the incompatibly-shaped portions 34*g* arranged on the tip of the cap portion 34Y are not engaged with but interfere with the engagement portions 73*c* of the cap holding portion 73 before any other portions, it is possible to reliably prevent the shutter member 34*d*, which is covering the toner outlet W of the cap portion 34Y, from being opened, and prevent toner of a different color from being erroneously supplied from the toner outlet W toward the image forming apparatus body 100.

In particular, as illustrated in FIG. 4, because the image forming apparatus body 100 of the first embodiment is configured such that the toner container 32Y is placed on the toner container holder 70 from the upper side and slid in the horizontal direction (longitudinal direction) to complete the attachment operation, it is necessary to determine the incompatibility of the toner container at the position close to the bottle holding portion 72 in the cap holding portion 73. Therefore, the above configuration in which the engagement portions 73*c* are arranged on the side near the bottle holding portion 72 is useful.

The toner-container holder 70 of the first embodiment is configured such that the positional relationship between the stopper-release biasing portion 72*b* and the engagement portions 73*c* is set so that the incompatibly-shaped portions 34*g* of the cap portion 34Y are first engaged with the engagement portions 73*c*, and thereafter, the stopper-release biasing portion 72*b* is engaged with the stopper releasing unit 34*d*21 of the cap portion 34Y during the attachment operation of the toner container 32Y.

Therefore, because the opening operation of the shutter member 34*d* is performed after the incompatibility is determined, it is possible to more reliably prevent the toner container from being erroneously set and toner of a different color from being supplied.

Referring to FIGS. 31 to 33 and 40, the bearing 73*k* rotatably supports, on the cap holding portion 73, a drive shaft of the drive gear 81 of the driving unit 91.

The antenna 73*e* is mounted on the rear end face of the cap holding portion 73. The antenna 73*e* is used for performing non-contact radio communication with the RFID chip 35 (see FIGS. 5 and 9) mounted on the end face of the cap portion 34Y of the toner container 32Y.

Figure 33:
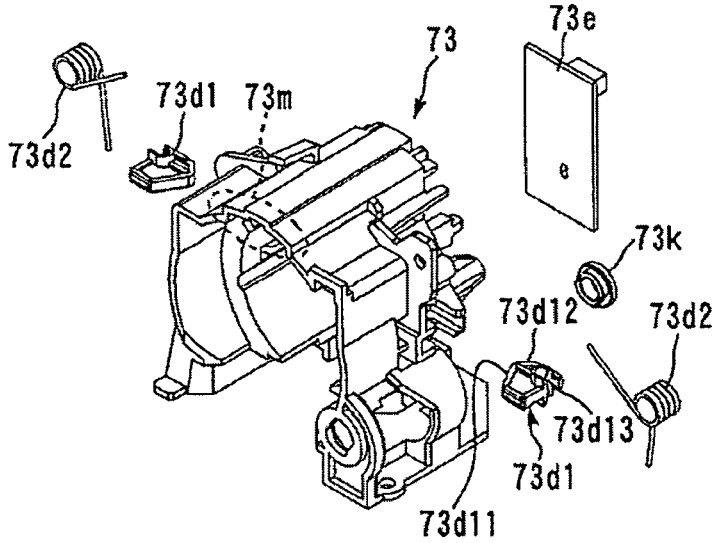
FIG. 33 is another exploded perspective view of the cap holding portion of the toner-container holder.

Referring to FIGS. 31 to 33, the pressing portions 73*d* of the cap holding portion 73 are arranged on both side walls of the cap holding portion 73 and on the downstream side in the attachment direction of the toner container 32Y.

Referring to FIGS. 31 to 33, each of the pressing portions 73*d* includes a slider 73*d*1 and a torsion spring 73*d*2. The tip of the slider 73*d*1 has a cone shape. More specifically, referring to FIG. 33, the slider 73*d*1 has a cone shape in which a slope 73*d*11 on the bottle holding portion 72 side is more gentle than a slope 73*d*12 on the rear side (the rear side in the attachment direction). Therefore, a user can smoothly perform the attachment/detachment operation with a good click feeling during the attachment/detachment operation of the toner container 32Y to the cap holding portion 73.

An end of the torsion spring 73*d*2 is held by a concave portion (recess) 73*d*13 of the slider 73*d*1. The slider 73*d*1 is inserted into a slide insertion port 73*d*6 of the cap holding portion 73, and a coil portion of the torsion spring 73*d*2 is inserted into a bearing 73*d*5 of the cap holding portion 73. The other end of the torsion spring 73*d*2 is held by a projection 73*d*7 of the cap holding portion 73. With this configuration, the sliders 73*d*1 being a pair are biased in the arrow directions in FIG. 37 (directions toward the toner container 32Y) by a spring force of the torsion springs 73*d*2.

The pair of the pressing portions 73*d* (the sliders 73*d*1) configured as above push the pressed portions 34*c* of the cap portion 34Y in a direction of reaction to a force in the attachment direction (or the detachment direction) when the toner container 32Y (the cap portion 34Y) is attached to (or detached from) the toner-container holder 70 (the cap holding portion 73). Therefore, during the attachment operation (or the detachment operation) of the toner container 32Y to the cap holding portion 73, a user feels a reaction force to an operating force in the attachment direction (or the detachment direction) at the position where the pressed portions 34*c* and the pressing portions 73*d* are engaged with each other, and accordingly, the user increases the operating force in the attachment direction (or the detachment direction) to complete the attachment operation (or the detachment operation) at one stroke. Thus, the user gains a good click feeling in the attachment operation (or the detachment operation) of the toner container 32Y to the cap holding portion 73.

Figure 34:
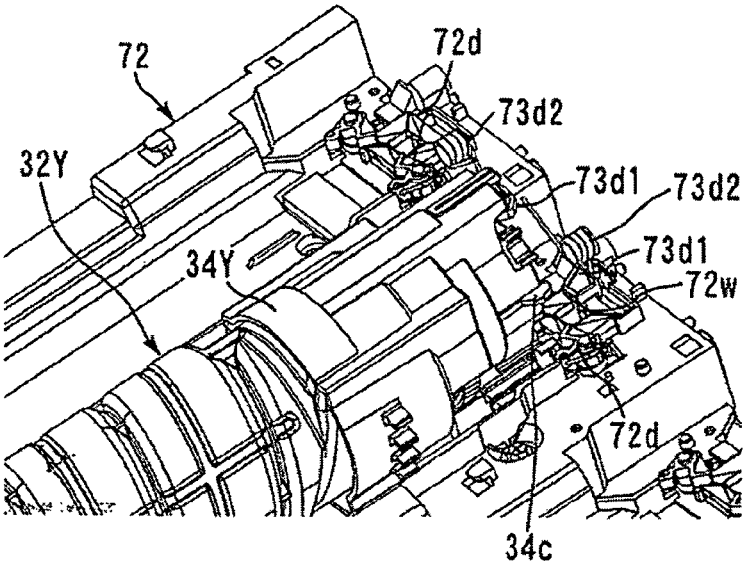
FIG. 34 is a perspective view of how the cap portion of the toner container is attached to the cap holding portion of the toner-container holder.
Figure 35:
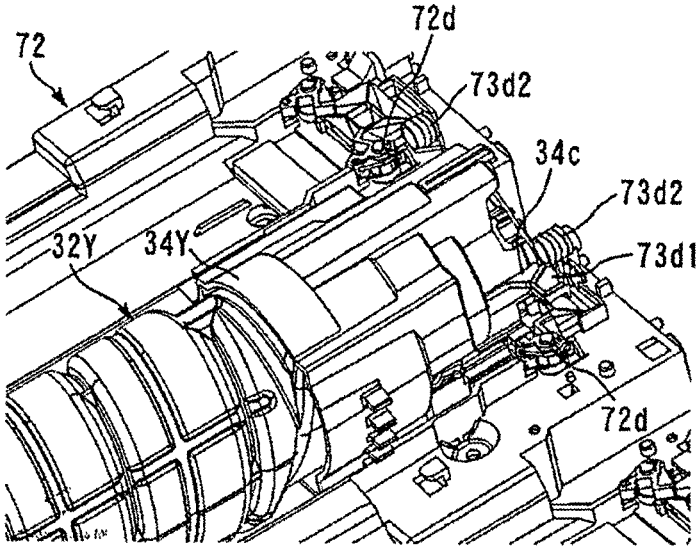
FIG. 35 is a diagram illustrating a state following the state illustrated in FIG. 34.
Figure 37:
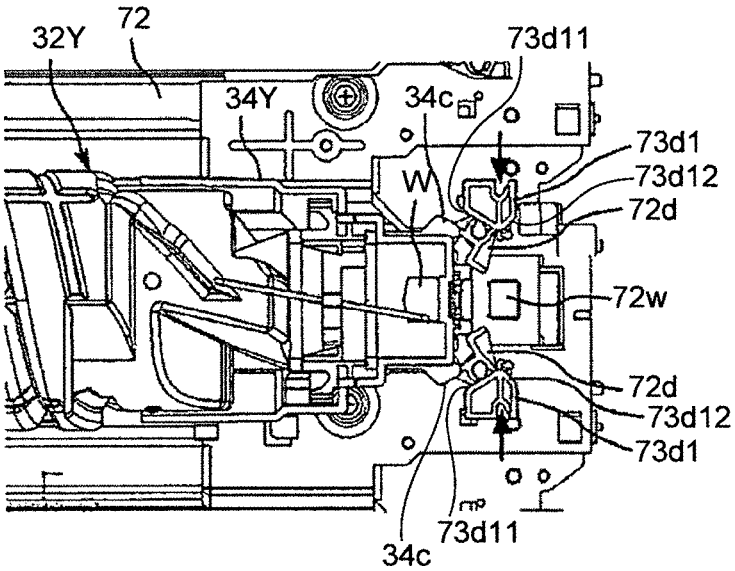
FIG. 37 is a cross-sectional top view of how the cap portion is attached to the cap holding portion while a pressed portion of the toner container is engaged with a pressing portion of the toner-container holder.
Figure 38:
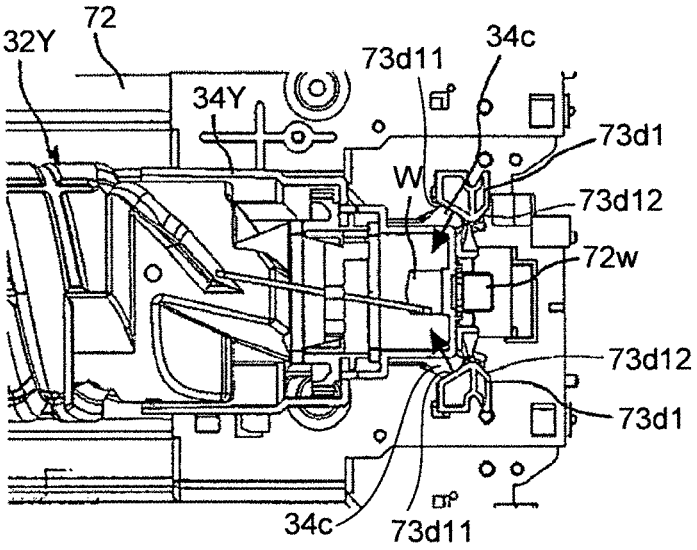
FIG. 38 is a diagram illustrating a state following the state illustrated in FIG. 37.
Figure 39:
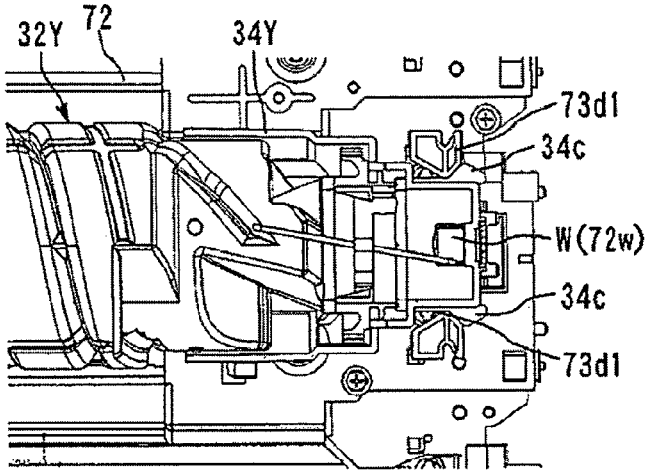
FIG. 39 is a diagram illustrating a state following the state illustrated in FIG. 38.
Figure 40:
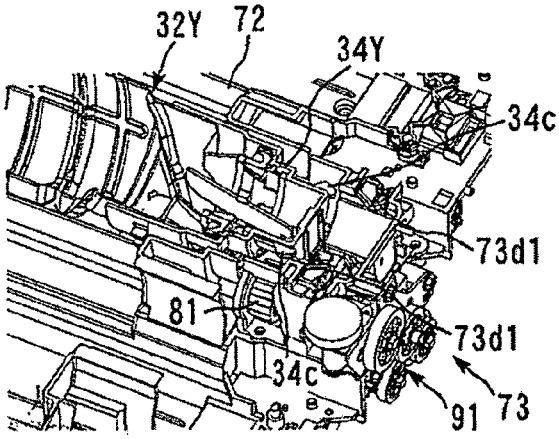
FIG. 40 is a cross-sectional perspective view of how the cap portion of the toner container is attached to the cap holding portion of the toner-container holder.
Figure 41:
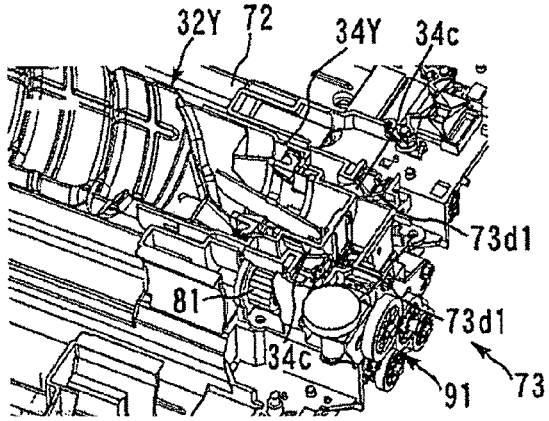
FIG. 41 is a diagram illustrating a state following the state illustrated in FIG. 40.
Figure 42:
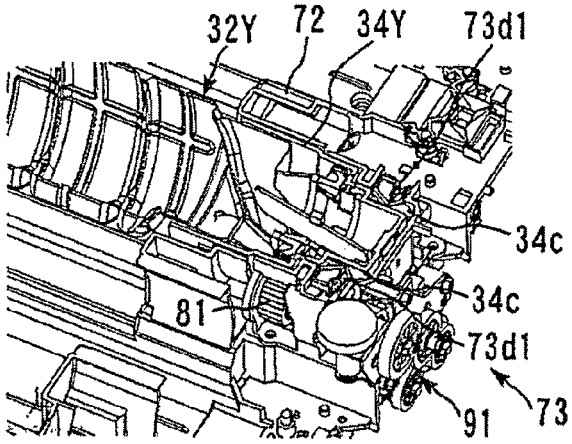
FIG. 42 is a diagram illustrating a state following the state illustrated in FIG. 41.

FIGS. 34 to 36 are perspective views illustrating the sequence of how the cap portion 34Y of the toner container 32Y is attached to the cap holding portion 73 of the toner-container holder 70. FIGS. 37 to 39 are cross-sectional top views illustrating the sequence of how the cap portion 34Y is attached to the cap holding portion 73 while the pressed portions 34*c* of the toner container 32Y are engaged with the pressing portions 73*d* of the cap holding portion 73. FIGS. 40 to 42 are cross-sectional perspective views illustrating the sequence of how the cap portion 34Y of the toner container 32Y is attached to the cap holding portion 73.

As illustrated in FIGS. 34, 37, and 40, the toner container 32Y is placed on the bottle holding portion 72 and then pushed and slid toward the cap holding portion 73.

Thereafter, as illustrated in FIGS. 35, 38, and 41, the pressed portions 34*c* of the toner container 32Y come into contact with the pressing portions 73*d* (the slopes 73*d*11 of the sliders 73*d*1). The toner container 32Y is further pushed, and the pressing portions 73*d* (the sliders 73*d*1) move in directions away from the cap portion 34Y (reverse directions of the arrow directions in FIG. 37) against the spring force of the shutter deforming unit 34*d*2 while coming into slide contact with the slopes of the pressed portions 34*c*.

Thereafter, as illustrated in FIGS. 36, 39, and 42, the sliders 73*d*1 pass over the vertexes of the slopes of the pressed portions 34*c*, and the slopes 73*d*12 on the rear side of the sliders 73*d*1 come into contact with the slopes of the pressed portions 34*c* on the container body 33Y side. At this time, because the sliders 73*d*1 are biased by the shutter deforming unit 34*d*2, the slopes of the pressed portions 34*c* on the container body 33Y side are pushed out by the slopes 73*d*12 of the sliders 73*d*1 on the rear side, so that the cap portion 34Y moves toward the rear side of the cap holding portion 73 at one stroke. As a result, the cap portion 34Y reaches a position where the toner outlet W overlaps the toner supply port 72*w* (correct attachment position).

When the sliders 73*d*1 come into contact with the vertexes of the slopes of the pressed portions 34*c*, the sliders 73*d*1 push the pressed portions 34*c* in a direction perpendicular to the longitudinal direction.

In a series of the attachment operation of the toner container 32Y, a user proceeds with insertion of the toner container 32Y toward the cap holding portion 73 while the user feels a small resistive force at the start of the insertion, the user then feels a relatively large resistive force when the sliders 73*d*1 are pressed to the pressed portions 34*c*, and when the sliders 73*d*1 pass over the pressed portions 34*c*, the user gains a feeling that the toner container 32Y is firmly fitted to the rear side at one stroke. In this manner, the user can surely gain a click feeling during the attachment operation of the toner container 32Y. Therefore, it is possible to prevent a setting failure to attach the cap portion 34Y to the correct attachment position of the cap holding portion 73.

The operation of detaching the toner container 32Y (the cap portion 34Y) from the toner-container holder 70 (the cap holding portion 73) is performed in reverse order of the attachment operation described above.

The slopes of the pressed portions 34*c* of the cap portion 34Y on the container body 33Y side are made steeper (approximately vertical) than the slopes on the tip side. The slants of the slopes 73*d*12 of the sliders 73*d*1 of the cap holding portion 73 are made steep in accordance with the pressed portions 34*c*. Therefore, the toner container 32Y (the cap portion 34Y) that is completely attached to the cap holding portion 73 does not easily come off.

In the first embodiment, referring to FIG. 8, the pressed portions 34*c* formed on both side portions of the cap portion 34Y are arranged on a virtual horizontal plane passing through the center of the tip of the cap portion 34Y (the small-diameter portion on which the pressed portions 34*c* and the incompatibly-shaped portions 34*g* are formed) and on the outer circumferential surface of the small-diameter portion. Similarly, the pressing portions 73*d* of the cap holding portion 73 are arranged at opposing positions on the above-mentioned virtual horizontal plane so as to come into contact with the pressed portions being a pair.

With this configuration, referring to FIG. 38, when the pressing portions 73*d* being a pair come into contact with the pressed portions 34*c* being a pair, vectors of the force that the pressing portions 73*d* being a pair apply to the pressed portions 34*c* (vectors of the force indicated by arrows in FIG. 38), become line symmetric with respect to a rotation axis of the container body 33Y. Therefore, when the pressed portions 34*c* being a pair are pressed by the pressing portions 73*d* being a pair at the time the toner container 32Y is detached, the cap portion 34Y is uniformly pressed in the vertical direction in FIG. 38. Therefore, it is possible to prevent the cap portion 34Y from being non-uniformly pressed and the cap seal 37 disposed between the cap portion 34Y and the container body 33Y from being twisted, thereby preventing reduction in the sealing capability between the container body 33Y and the cap portion 34Y. In addition, it is possible to perform the attachment/detachment operation of the toner container 32Y smoothly and with good balance.

In the first embodiment, referring to FIG. 46 for example, a timing at which the main guide pin 73*a* of the cap holding portion 73 starts to be engaged with the main guide hole 34*a* of the cap portion 34Y in the attachment operation of the toner container 32Y is made earlier than a timing at which the pressing portions 73*d* of the cap holding portion 73 start to be engaged with the pressed portions 34*c* of the cap portion 34Y. More specifically, the opening of the main guide hole 34*a* is formed on the tip side relative to the vertexes of the pressed portions 34*c* in the cap portion 34Y, and the main guide pin 73*a* is extended to the bottle holding portion 72 side relative to the position where the shutter main unit 34*d*1 is arranged in the cap holding portion 73.

With this configuration, the pressing portions 73*d* start to press the pressed portions 34*c* after the position of the cap portion 34Y in the cap holding portion 73 is fixed. Therefore, when the pressing portions 73*d* being a pair press the pressed portions 34*c* being a pair at the time of the attachment/detachment of the toner container 32Y, the cap portion 34Y is uniformly pressed in the vertical direction in FIG. 38.

Figure 43:
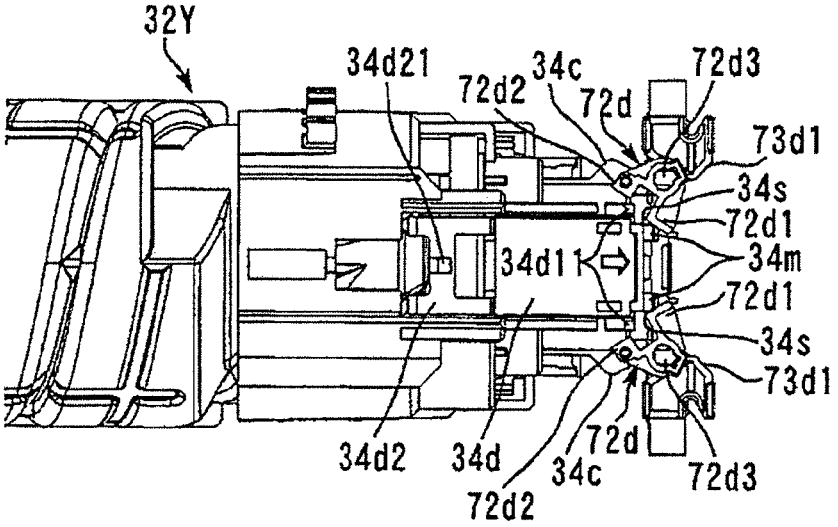
FIG. 43 is a bottom view of how the shutter member of the toner container opens the toner outlet while being engaged with a shutter holding mechanism of the toner-container holder.
Figure 44:
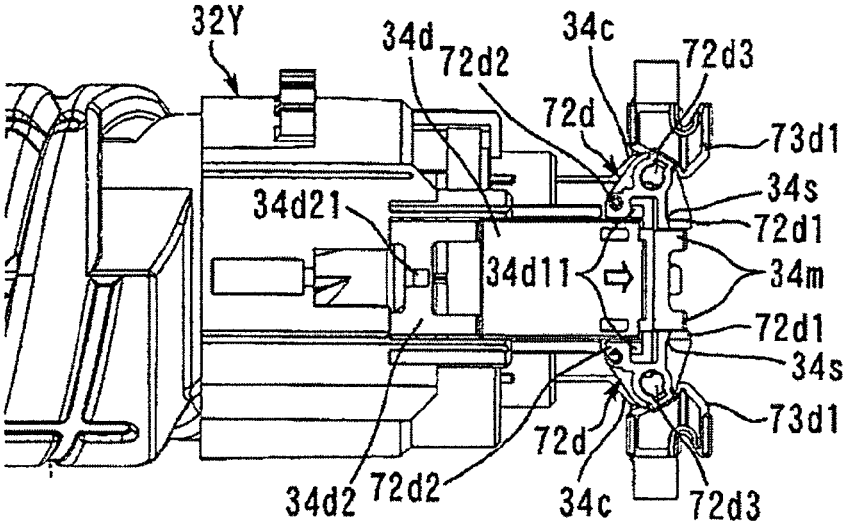
FIG. 44 is a bottom view illustrating a state following the state illustrated in FIG. 43.

FIGS. 43 to 45 are diagrams illustrating the operation of the shutter closing mechanisms 72*d* (shutter holding mechanisms) and the operation of the pressing portions 73*d* along with the open/close operation of the shutter member 34*d*.

As illustrated in FIG. 43, when the opening operation of the shutter member 34*d* is performed, the first holding units 72*d*1 come into contact with the projections 34*m* and the second holding units 72*d*2 come into contact with the held portions 34*d*11 of the shutter member 34*d* along with the attachment operation of the toner container 32Y in the direction of a white arrow.

Thereafter, as illustrated in FIG. 44, when the attachment operation of the toner container 32Y in the direction of the white arrow proceeds, the shutter closing mechanisms 72*d* (shutter holding mechanisms) rotate about the support shafts 72*d*3, so that the first holding units 72*d*1 hold the vertical surfaces 34*s* of the held portions 34*d*11 of the shutter member 34*d* and the second holding units 72*d*2 hold the side walls 34*d*11*c* (the shutter member 34*d*) of the shutter main unit 34*d*1 (the held portions 34*d*11) while the second holding units 72*d*2 are being engaged with the engaging walls 34*d*11*a* of the held portions 34*d*11 of the shutter member 34*d*.

Thereafter, the shutter member 34*d* comes into contact with the wall formed on the circumference of the toner supply port 72*w* of the cap holding portion 73 (see FIG. 29). Accordingly, the movement of the shutter member 34*d* in the cap holding portion 73 is regulated while the shutter member 34*d* is sandwiched between the wall and the second holding units 72*d*2 (the shutter member 34*d* does not absolutely move in the longitudinal direction). However, the toner container 32Y can move in the attachment direction, and the shutter member 34*d* can relatively move in the open direction. That is, as illustrated in FIG. 45, the shutter member 34*d* relatively moves to the container body 33Y side to thereby open the toner outlet W. At this time, as illustrated in FIG. 45, the opening operation of the shutter member 34*d* is performed such that the first holding units 72*d*1 hold the vertical surfaces 34*s* of the cap portion 34Y and the second holding units 72*d*2 hold the shutter member 34*d* while the second holding units 72*d*2 are being engaged with the held portions 34*d*11 of the shutter member 34*d*. Therefore, the postures of the shutter member 34*d* and the cap portion 34Y in the cap holding portion 73 are fixed and the opening operation of the shutter member 34*d* can be smoothly performed.

When the toner container 32Y is removed (detached) from the toner-container holder 70 (the cap holding portion 73), the operation is performed in reverse order of the attachment operation described above. That is, the operation of the shutter closing mechanisms 72*d* (shutter holding mechanisms) along with the closing operation of the shutter member 34*d* is performed in order of FIGS. 45, 44, and 43.

Referring to FIG. 45, in the first embodiment, because the vertical surfaces 34*s* that function as the held surfaces to be held by the first holding units 72*d*1 are extended in the attachment direction (to the right in FIG. 45) (because the projections 34*m* are arranged), when the toner container 32Y is removed from the toner-container holder 70, a timing at which the shutter closing mechanisms 72*d* (the second holding units 72*d*2) release holding of the shutter member 34*d* (the held portions 34*d*11) using the vertical surfaces 34*s* can be delayed relative to a timing at which the shutter closing mechanisms 72*d* completely close the shutter member 34*d*. That is, because the vertical surfaces 34*s* (the projections 34*m*) are extended so as to protrude to the right side in FIG. 44, when the closing operation of the shutter member 34*d* is performed (relative movement from the state illustrated in FIG. 45 to the state illustrated in FIG. 44), rotation of the shutter closing mechanisms 72*d* as illustrated in FIG. 43 is prevented and the closing operation of the shutter member 34*d* can be completed while the first holding units 72*d*1 are holding the vertical surfaces 34*s* of the projections 34*m* and the second holding units 72*d*2 are holding the held portions 34*d*11 of the shutter member 34*d*. In other words, when the vertical surfaces 34*s* are not extended so as to protrude to the right side in FIG. 45, the first holding units 72*d*1 release the holding of the vertical surfaces 34*s* at an earlier timing and the shutter closing mechanisms 72*d* instantly rotate as illustrated in FIG. 43, and accordingly, the second holding units 72*d*2 also release the holding of the held portions 34*d*11 of the shutter member 34*d* Consequently, the shutter member 34*d* cannot completely finish the closing operation.

In this manner, according to the first embodiment, because the projections 34*m* are arranged on the cap portion 34Y, it is possible to prevent the toner container 32Y from being removed from the apparatus body 100 before the shutter member 34*d* completely closes the toner outlet W.

Referring to FIGS. 43 to 45, according to the first embodiment, a timing at which the pressing force of the pressing portions 73*d* for pressing the cap portion 34Y becomes maximum (a timing at which the sliders 73*d*1 reach the vertexes of the pressed portions 34*c*) is made different from a timing at which the stopper-release biasing portion 72*b* is engaged with the stopper releasing unit 34*d*21 (a timing at which the elastic deformation of the shutter deforming unit 34*d*2 is maximized) in the attachment/detachment operation of the toner container 32Y.

Therefore, even without setting a relatively large pressing force to the pressing portions 73*d* for pressing the pressed portions 34*c* by adding a force corresponding to a force that is applied to the cap portion 34Y when the stopper-release biasing portion 72*b* is engaged with the stopper releasing unit 34*d*21, it is possible to gain a click feeling with the pressed portions 34*c* described above during the attachment/detachment operation.

Referring to FIGS. 43 to 45, according to the first embodiment, when the toner container 32Y (the cap portion 34Y) is attached to the toner-container holder 70, the shutter member 34*d* first starts the opening operation along with the operation of the shutter closing mechanisms 72*d* (shutter holding mechanisms) for holding the shutter member 34*d*, and thereafter, the pressing portions 73*d* start the operation of pressing the pressed portions 34*c*. Furthermore, when the toner container 32Y (the cap portion 34Y) is detached from the toner-container holder 70, the pressing portions 73*d* first end the operation of pressing the pressed portions 34*c* to separate the pressing portions 73*d* from the pressed portions 34*c*, and thereafter, the shutter closing mechanisms 72*d* (shutter holding mechanisms) release holding of the shutter member 34*d* with the closing operation of the shutter member 34*d*.

Therefore, when the shutter closing mechanisms 72*d* (shutter holding mechanisms) start holding the shutter member 34*d* at the time the toner container 32Y is attached, the cap portion 34Y does not receive the pressing force from the pressing portions 73*d*. Consequently, the opening operation of the shutter member 34*d* can be smoothly performed along with the holding operation by the shutter closing mechanisms 72*d* (the shutter holding mechanisms) (opening failure of the shutter member 34*d* does not occur). When the shutter closing mechanisms 72*d* (shutter holding mechanisms) stop holding the shutter member 34*d* at the time the toner container 32Y is detached, the cap portion 34Y does not receive the pressing force from the pressing portions 73*d*. Therefore, the closing operation of the shutter member 34*d* can be smoothly performed along with the holding operation of the shutter closing mechanisms 72*d* (the shutter holding mechanisms) (closing failure of the shutter member 34*d* does not occur).

When the attachment operation of the toner container 32Y to the toner-container holder 70 proceeds, each portion in the bottle holding portion 72 and the cap holding portion 73 is engaged with the cap portion 34Y in sequence as described below.

The cap portion 34Y slides on the bottle holding face 72*a* and the incompatibly-shaped portions 34*g* are engaged with the engagement portions 73*c* of the cap holding portion 73. The first engaging portion 34*e* and the shutter member 34*d* of the cap portion 34Y are engaged with the engaged portion 73*m* of the cap holding portion 73, so that the posture of the cap portion 34Y in the cap holding portion 73 is regulated. Subsequently, the first hole 34*a* of the cap portion 34Y is engaged with the main guide pin 73*a* of the cap holding portion 73, so that the position of the main guide is fixed. Thereafter, the second hole 34*b* of the cap portion 34Y is engaged with the sub guide pin 73*b* of the cap holding portion 73, so that the positions of the main and sub guides are fixed. Before the positioning is complete, the shutter member 34*d* starts the opening operation while the postures of the shutter member 34*d* and the cap portion 34Y in the cap holding portion 73 are fixed by the shutter closing mechanisms 72*d* (the shutter holding mechanisms), and thereafter, the pressing portions 73*d* start the operation of pressing the pressed portions 34*c*. The stopper-release biasing portion 72*b* releases the contact state between the stoppers 34*d*22 and the contact portions 34*n*5 of the shutter member 34*d* of the cap portion 34Y at a timing different from a timing at which the pressing portions 73*d* press the pressed portions 34*c*. Accordingly, the toner outlet W that is opened in the cap portion 34Y and the toner supply port 72*w* of the cap holding portion 73 communicate with each other, which is completion of the setting of the cap portion 34Y (the toner container 32Y) in the cap holding portion 73 (the toner-container holder 70). At this time, the gear 33*c* of the container body 33Y engages with the drive gear 81 of the apparatus body 100, and the RFID chip 35 of the cap portion 34Y is located at a position that is optimal to perform radio communication with the antenna 73*e* of the apparatus body 100.

As described above, according to the image forming apparatus of the first embodiment, a user's few actions of placing the toner container 32Y on the bottle holding portion 72 and moving the toner container 32Y in the horizontal direction cause the shutter member 34*d* to perform the open/close operation of the toner outlet W and complete the attachment/detachment operation of the toner container 32Y in synchronization with the user's operation.

The toner container 32Y of the first embodiment is disposed such that the toner outlet W having a relatively large opening area is arranged with face down in the vertical direction. Therefore, toner can efficiently be discharged directly from the toner outlet W by weight of the toner.

Furthermore, the toner container 32Y is set in the apparatus body 100 such that the longitudinal direction of the toner container is parallel to the horizontal direction. Therefore, it is possible to increase the toner capacity of the toner container 32Y and reduce the replacement frequency of the toner container 32Y without influencing the layout of the entire image forming apparatus body 100 in the height direction.

Referring to FIG. 30, the toner-container holder 70 of the first embodiment is configured such that the height positions in the vertical direction are different between the adjacent bottle holding faces 72*a* (the bottle holding portions 72) among the four bottle holding faces 72*a* (the bottle holding portions 72) for different colors. More specifically, the height positions in the vertical direction are lowered in the following order: the bottle holding face 72*a* for yellow, the bottle holding face 72*a* for magenta, the bottle holding face 72*a* for cyan, and the bottle holding face 72*a* for black (the four bottle holding faces 72*a* are arranged in a stepped manner).

With this configuration, it is possible to arrange the four cap holding portions 73 in parallel without interference with the portions protruding in the horizontal direction (mainly, portions where the pressing portions 73*d* are arranged) between the adjacent cap holding portions 73. Therefore, the apparatus body 100 (the toner container holder 70) can be downsized in the horizontal direction perpendicular to the longitudinal direction.

As described above, the toner container 32Y of the first embodiment includes, on the shutter member 34*d*, the shutter deforming unit 34*d*2 that is elastically deformed by using the connection position with the shutter main unit 34*d*1 as a base point, and also includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete. Therefore, the shutter member 34*d* that opens and closes the toner outlet W does not easily move while the toner container 32Y remains alone. Consequently, even while the shutter member 34*d* keeps the toner outlet W open, it is possible to prevent the shutter member 34*d* from protruding from the cap portion 34Y.

More specifically, in the conventional technology, it is necessary to configure the shutter member such that the shutter member does not easily move while closing the toner outlet in order to prevent toner contained in the toner container from leaking to the outside when the toner container is not set in the apparatus body but remains alone. Furthermore, in order to smoothly open/close the shutter member, the shutter member needs to be configured such that it remains integrated with the cap portion without protruding from the cap portion even while the shutter member keeps the toner outlet open, similarly to when the shutter member keeps the toner outlet closed. By contrast, according to the present embodiment, as described above, it is possible to provide a toner container and an image forming apparatus in which the shutter member that opens and closes the toner outlet does not easily move while the toner container remains alone, and the shutter member does not protrude from the cap portion even while the shutter member keeps the toner outlet open.

Furthermore, as described above, the toner container 32Y of the first embodiment has good operability. In addition, because the cap portion 34Y is formed by integral molding, even when the structure of the cap portion 34Y is complicated, the dimensional accuracy and the mechanical strength of the cap portion 34Y can be adequately ensured and costs can be relatively reduced.

Second Embodiment

A second embodiment will be described in detail below with reference to FIGS. 47 to 51.

Figure 47:
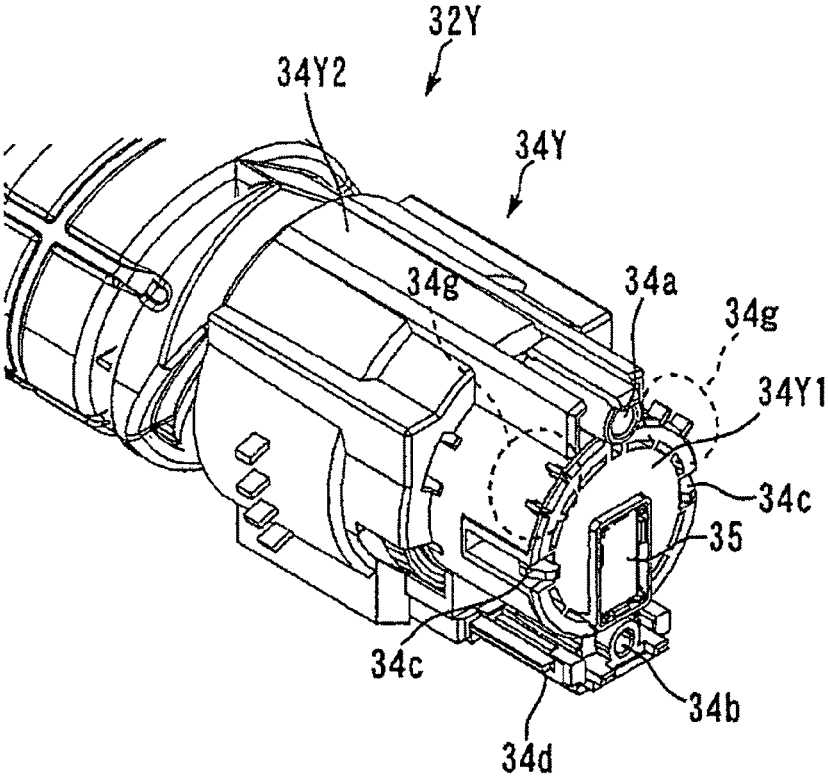
FIG. 47 is a perspective view of a part of a toner container according to a second embodiment.
Figure 48:
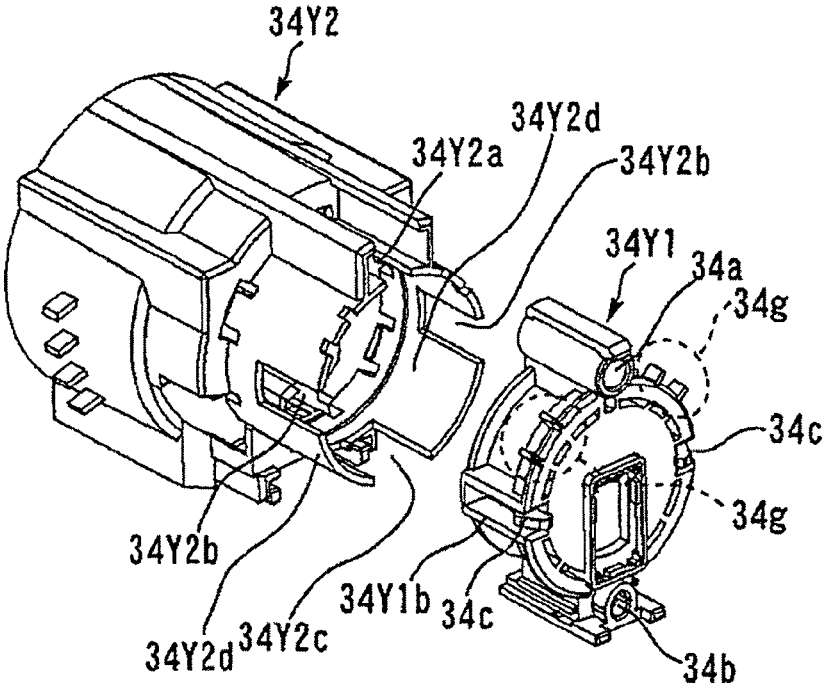
FIG. 48 is an exploded perspective view of a cap portion of the toner container illustrated in FIG. 47.
Figure 49:
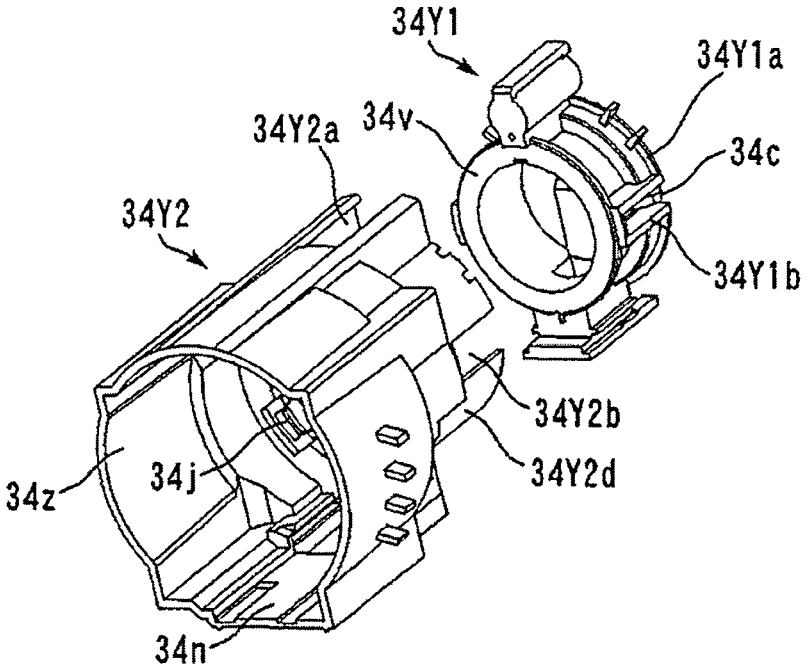
FIG. 49 is another exploded perspective view of the cap portion of the toner container illustrated in FIG. 47.
Figure 50:
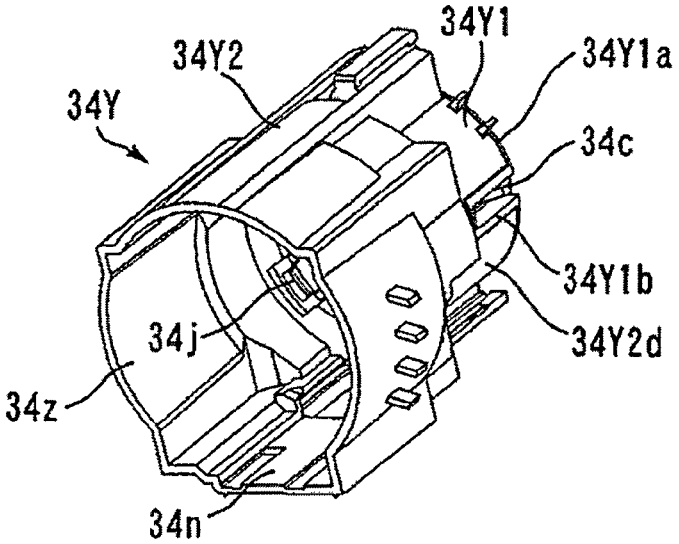
FIG. 50 is a perspective view of the cap portion with a first member and a second member welded together.
Figure 51:
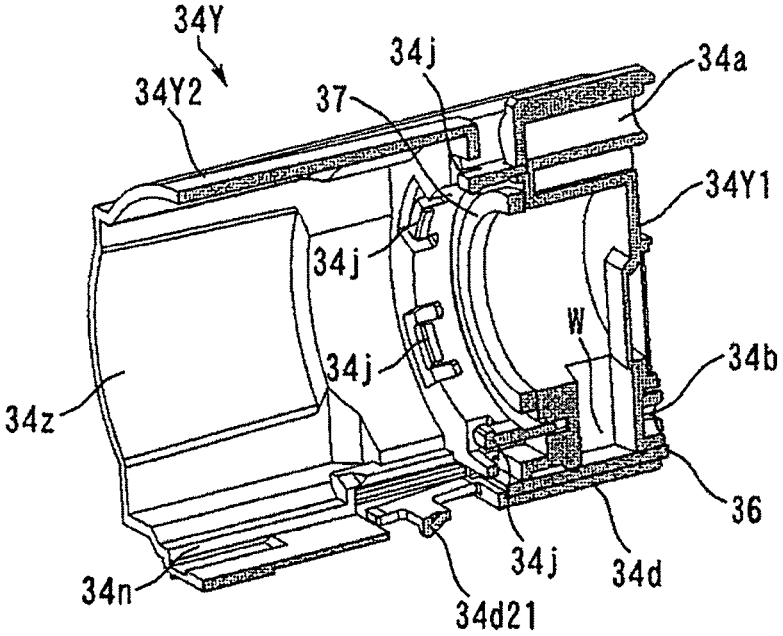
FIG. 51 is a perspective view of the interior of the cap portion of the toner container illustrated in FIG. 47.

FIG. 47 is a perspective view of a part of the toner container 32Y according to the second embodiment. FIGS. 48 and 49 are exploded perspective views of the cap portion 34Y. FIG. 50 is a perspective view of the cap portion 34Y with the first member 34Y1 and a second member 34Y2 welded together. FIG. 51 is a perspective view of the interior of the cap portion 34Y in the toner container 32Y.

The toner container of the second embodiment is different from the first embodiment in that a cap portion of the second embodiment is formed by welding or bonding two molded components, whereas the cap portion of the first embodiment is formed by integral molding.

The toner container 32Y of the second embodiment includes the container body 33Y (bottle body) and the cap portion 34Y arranged on the head of the container body, similarly to the first embodiment. The toner container 32Y further includes the stirring member 33*f*, the cap seal 37, the shutter member 34*d*, the shutter seal 36, and the RFID chip 35, in addition to the container body 33Y and the cap portion 34Y.

Referring to FIGS. 47 to 51, the toner container 32Y of the second embodiment is different from the first embodiment in that the cap portion 34Y (from which the cap seal 37, the shutter member 34*d*, the shutter seal 36, and the RFID chip 35 are removed) is formed by welding (or bonding) the two molded components 34Y1 and 34Y2.

More specifically, the cap portion 34Y includes the first member 34Y1 and the second member 34Y2. The first member 34Y1 includes the toner outlet W, the pressed portions 34*c*, and the attachment surface 34*v* for attaching the cap seal 37. The second member 34Y2 includes a small-diameter portion 34Y2*d* covering a part of the first member 34Y1, and a large diameter portion with a diameter greater than the small-diameter portion 34Y2*d* (the portion where the insertion portion 34*z* is formed). The upper portion (the portion where a main guide hole 34*a* is formed), a side portion 34Y1*b* (the portion where the pressed portions 34*c* are formed), and the bottom portion (the portion where the toner outlet W is formed) of the first member 34Y1 are fitted to notch portions 34Y2*a*, 34Y2*b*, and 34Y2*c* of the second member 34Y2, and the small-diameter portion 34Y2*d* of the second member 34Y2 is fitted to and bonded (welded) to a bonding portion 34Y1*a* of the first member 34Y1.

Referring to FIGS. 47 and 50, the pressed portions 34*c* of the first member 34Y1 are formed within a range of the outer diameter of the small-diameter portion 34Y2*d* of the second member 34Y2. That is, the pressed portions 34*c* of the first member 34Y1 are configured so as not to protrude from the outer circumference of the small-diameter portion 34Y2*d* of the second member 34Y2 when the cap portion 34Y is viewed in a projection plane perpendicular to the longitudinal direction. The attachment surface 34*v* of the first member 34Y1 is formed such that the attachment surface 34*v* just fits to the range of the inner diameter of the small-diameter portion 34Y2*d* of the second member 34Y2.

In this manner, the pressed portions 34*c* that has protruded from the outer circumferential surface of the cap portion 34Y and increased the outer diameter of the cap portion 34Y are formed so as not to protrude from the outer circumference of the small-diameter portion 34Y2*d* of the second member 34Y2. Therefore, it is possible to prevent increase in size (increase in the diameter) of the cap portion 34Y.

Furthermore, because the cap portion 34Y of the second embodiment includes the two molded components 34Y1 and 34Y2, flexibility of arrangement of various portions, such as the claw members 34*j*, the incompatibly-shaped portions 34*g*, the pressed portions 34*c*, the toner outlet W, and the toner fall path C, can be relatively increased compared to the first embodiment in which the cap portion 34Y is formed of one molded component.

As described above, similarly to the first embodiment, the toner container 32Y of the second embodiment includes, on the shutter member 34*d*, the shutter deforming unit 34*d*2 that is elastically deformed by using the connection position with the shutter main unit 34*d*1 as a base point, and also includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete. Therefore, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

Third Embodiment

A third embodiment will be described in detail below with reference to FIG. 52.

Figure 52:
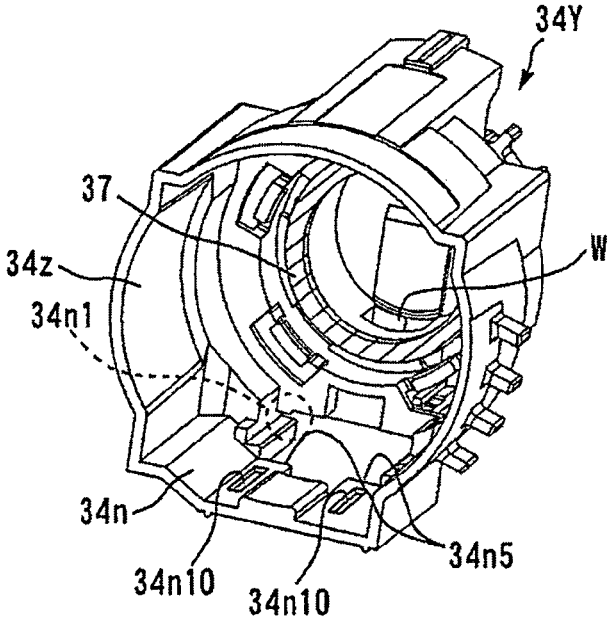
FIG. 52 is a perspective view of a cap portion of a toner container according to a third embodiment, from which a shutter member is detached.

FIG. 52 is a perspective view of the cap portion 34Y of the toner container 32Y according to the third embodiment, from which the shutter member 34*d* is detached. This is comparable to FIG. 19 that illustrates the first embodiment.

The toner container according to the third embodiment is different from the first embodiment in that holes 34*n*10 are arranged for reducing a contact force (pressing force) that is applied by the stoppers 34*d*22 of the shutter member 34*d* to the shutter housing unit 34*n* of the cap portion 34Y.

As illustrated in FIG. 52, the cap portion 34Y of the third embodiment includes, in the shutter housing unit 34*n* (housing unit), the holes 34*n*10 that are formed at positions through which the stoppers 34*d*22 of the shutter deforming unit 34*d*2 pass along with the opening operation of the shutter member 34*d* and which are other than the positions of the contact portions 34*n*5, in order to reduce the contact force (pressing force) that is applied by the stoppers 34*d*22 to the shutter housing unit 34*n* along with the opening operation of the shutter member 34*d*. Because the holes 34*n*10 are arranged in the shutter housing unit 34*n* as described above, when the shutter deforming unit 34*d*2 is housed in the shutter housing unit 34*n* along with the opening operation of the shutter member 34*d*, the stoppers 34*d*22 do not come into contact with the upper surface of the shutter housing unit 34*n* (the stoppers are not pressed against the shutter housing unit). Therefore, it is possible to reduce the elastic deformation of the shutter deforming unit 34*d*2 that occurs along with the opening operation of the shutter member 34*d*.

In the third embodiment, the holes 34*n*10 are formed for reducing the contact force of the stoppers 34*d*22 against the shutter housing unit 34*n*. However, it is possible to arrange grooves in the same area, instead of the holes 34*n*10.

In the third embodiment, the holes 34*n*10 are formed at positions through which the stoppers 34*d*22 of the shutter deforming unit 34*d*2 pass along with the opening operation of the shutter member 34*d* (and in a range excluding the contact portions 34*n*5). However, it is possible to form holes or grooves at positions where the stoppers 34*d*22 stop when the opening operation of the shutter member 34*d* is complete. In this case, it is possible to reduce elastic deformation of the shutter deforming unit 34*d*2 while the shutter deforming unit 34*d*2 is housed in the shutter housing unit 34*n* (the states illustrated in FIGS. 16 and 17).

As described above, similarly to the above embodiments, the toner container 32Y of the third embodiment includes, on the shutter member 34*d*, the shutter deforming unit 34*d*2 that is elastically deformed by using the connection position with the shutter main unit 34*d*1 as a base point, and also includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete. Therefore, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

Fourth Embodiment

A fourth embodiment will be described in detail below with reference to FIG. 53.

Figure 53:
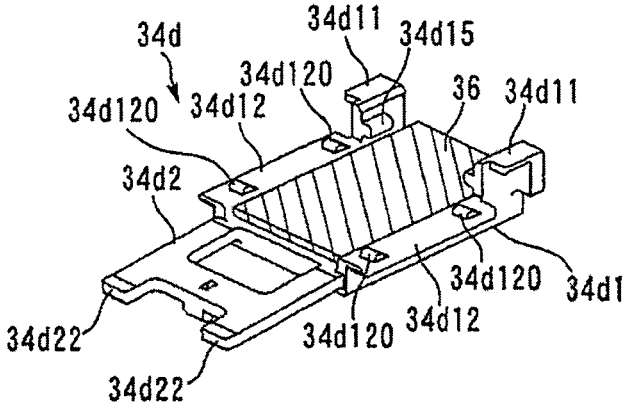
FIG. 53 is a perspective view of a shutter member of a toner container according to a fourth embodiment.

FIG. 53 is a perspective view of the shutter member 34*d* of the toner container 32Y according to the fourth embodiment. This is comparable to FIG. 25 that illustrates the first embodiment.

The toner container 32Y of the fourth embodiment is different from the first embodiment in that a plurality of projections 34*d*120 is formed on the shutter sliders 34*d*12 of the shutter member 34*d*.

As illustrated in FIG. 53, the shutter member 34*d* (the shutter main unit 34*d*1) of the fourth embodiment includes the projections 34*d*120 that come in point contact with rail units (the slide grooves 34*n*1 and the shutter rails 34*t*).

More specifically, two protrusions 34*d*120 being a pair are formed on the shutter sliders 34*d*12 of the shutter main unit 34*d*1 engaged with the slide grooves 34*n*1 (first rail unit) and the shutter rails 34*t* (second rail unit) of the cap portion 34Y.

Therefore, it is possible to reduce a sliding area of the shutter sliders 34*d*12 that are engaged with the slide grooves 34*n*1 (first rail unit) and the shutter rails 34*t* (second rail unit). Consequently, it is possible to reduce load on the shutter member 34*d* at the time of opening and closing, enabling to improve the operability of attaching and detaching the toner container 32Y.

As described above, similarly to the above embodiments, the toner container 32Y of the fourth embodiment includes, on the shutter member 34*d*, the shutter deforming unit 34*d*2 that is elastically deformed by using the connection position with the shutter main unit 34*d*1 as a base point, and also includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete. Therefore, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

Fifth Embodiment

A fifth embodiment will be described in detail below with reference to FIGS. 54A and 54B.

Figure 54A:
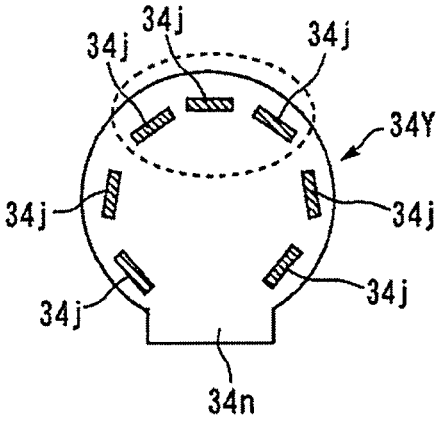
FIGS. 54A and 54B are schematic diagrams illustrating arrangement of claw members of a cap portion of a toner container according to a fifth embodiment.
Figure 54B:
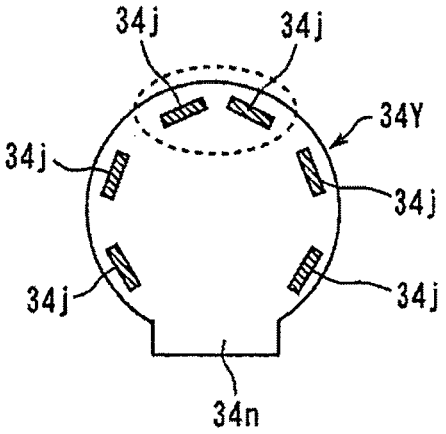

FIGS. 54A and 54B are schematic diagrams illustrating arrangement of the claw members 34*j* of the cap portion 34Y of the toner container 32Y according to the fifth embodiment.

The toner container 32Y of the fifth embodiment is different from the first embodiment in that the claw members 34*j* of the cap portion 34Y are arranged in a different manner.

As illustrated in FIGS. 54A and 54B, similarly to the first embodiment, the cap portion 34Y of the fifth embodiment includes the claw members 34*j*, which are arranged in parallel in the circumferential direction when the cap portion 34Y is viewed in the cross-section perpendicular to the longitudinal direction, in order to rotatably hold the container body 33Y. At least one of the claw members 34*j* is disposed on the upper portion opposite to the shutter housing unit 34*n*, and any of the claw members 34*j* is not disposed at the position of the shutter housing unit 34*n*.

In FIG. 54A, three claw members 34*j* are disposed on the upper portion opposite to the shutter housing unit 34*n*. In FIG. 54B, two claw members 34*j* are disposed on the upper portion opposite to the shutter housing unit 34*n*.

Because the shutter housing unit 34*n* is a portion for housing the shutter deforming unit 34*d*2, a gap with the container body 33Y remains large and it is difficult to form the claw members 34*j* on the shutter housing unit 34*n* because of the structure. Therefore, a force for holding the container body 33Y (regulating force) is reduced at the bottom portion of the cap portion 34Y (portion where the shutter housing unit 34*n* is arranged) because of the structure. However, according to the fifth embodiment, because at least one of the claw members 34*j* is disposed on the upper portion opposite to the shutter housing unit 34*n*, even when the regulating force of the cap portion 34Y is small on the lower side of the container body 33Y and the container body 33Y is likely to incline in the vertical direction, the claw members 34*j* arranged on the upper portion opposite to the shutter housing unit 34*n* can hold the container body 33Y so that the inclination can be cancelled out. Therefore, the cap portion 34Y can hold the container body 33Y with good balance in the circumferential direction.

In the fifth embodiment, when the cap portion 34Y is viewed in the cross-section perpendicular to the longitudinal direction, the claw members 34*j* are disposed such that a pitch between the claw members 34*j* disposed on the upper portion opposite to the shutter housing unit 34*n* (the claw members 34*j* arranged in a region surrounded by a dashed line in the figure) becomes smaller than a pitch between the claw members 34*j* disposed on the side portions (the claw members 34*j* arranged outside of the region surrounded by the dashed line in the figure).

With this configuration, it is possible to reliably hold the container body 33Y by the cap portion 34Y with good balance in the circumferential direction.

As described above, similarly to the above embodiments, the toner container 32Y of the fifth embodiment includes, on the shutter member 34*d*, the shutter deforming unit 34*d*2 that is elastically deformed by using the connection position with the shutter main unit 34*d*1 as a base point, and also includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete. Therefore, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

Sixth Embodiment

A sixth embodiment will be described in detail below with reference to FIGS. 55 to 58B.

A toner container according to the sixth embodiment is different from the first embodiment in that the stirring member 33*f* is configured in a different manner.

The toner container 32Y of the sixth embodiment mainly includes, similarly to the first embodiment, the container body 33Y (bottle body) and the cap portion 34Y (bottle cap) arranged on the head of the container body. The toner container 32Y of the sixth embodiment further includes the stirring member 33*f*, the cap seal 37, the shutter member 34*d*, the shutter seal 36 as a seal member, and the RFID chip 35 as an electronic-information storage member, in addition to the container body 33Y and the cap portion 34Y (see FIG. 9).

In the toner container 32Y of the sixth embodiment, similarly to the first embodiment, the stirring member 33*f* that rotates together with the container body 33Y is fitted to the bottle opening 33*a* (opening A). More specifically, referring to FIGS. 55 to 57, a fitting portion 33*f*2 of the stirring member 33*f* is press fitted to the bottle opening 33*a* (opening A).

Figure 55:
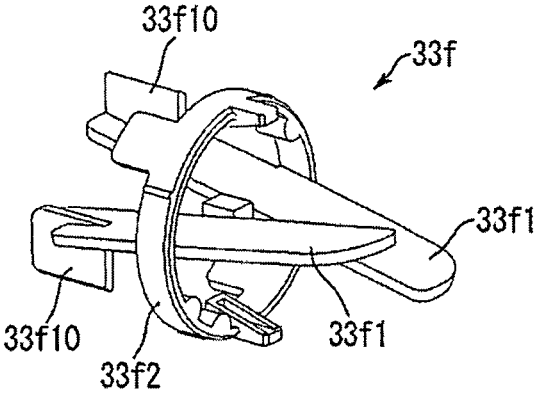
FIG. 55 is a perspective view of a stirring member of a toner container according to a sixth embodiment.
Figure 56:
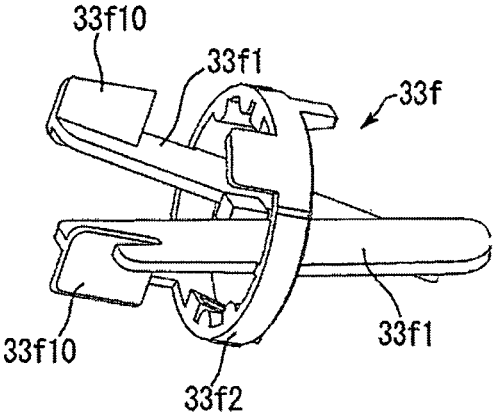
FIG. 56 is another perspective view of the stirring member illustrated in FIG. 55.
Figure 57:
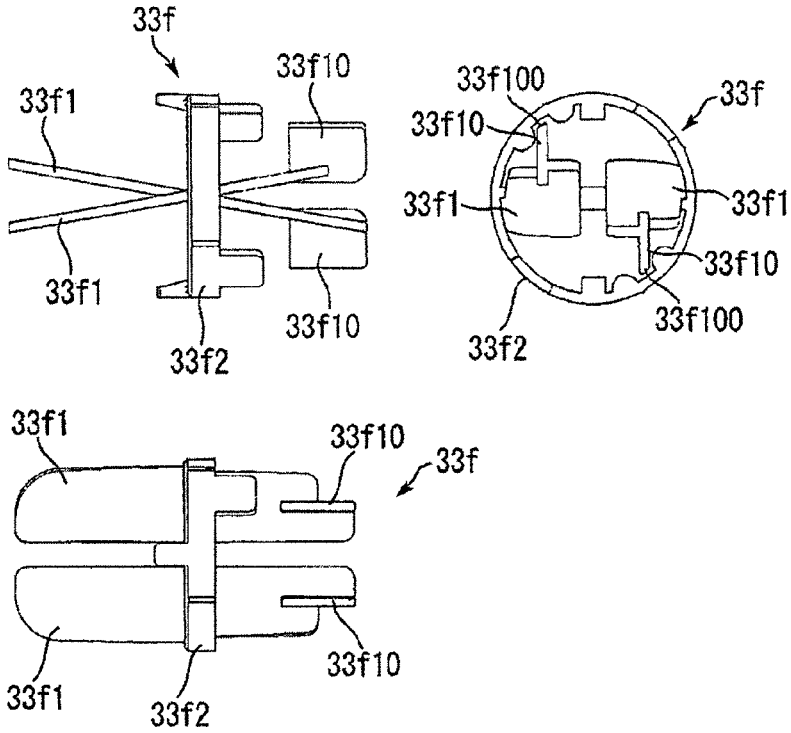
FIG. 57 illustrates three sides of the stirring member illustrated in FIG. 55.

As illustrated in FIGS. 55 to 57, the stirring member 33*f* of the sixth embodiment includes plate members 33*f*1 being a pair, which extend from the cavity B in the cap portion 34Y toward the inside of the container body 33Y. The plate members 33*f*1 of the stirring member 33*f* are alternately inclined, similarly to the first embodiment. The stirring member 33*f* is configured such that the tip thereof (on the side where push plates 33*f*10 are formed) reaches the upper side of the toner outlet W in the cap portion 34Y and the other end thereof (the end on the opposite side) reaches the scooping portion (a portion surrounded by a dashed line in FIGS. 9 and 10) when the cap portion 34Y and the container body 33Y are assembled together. Rotation of the stirring member 33*f* together with the opening A of the container body 33Y increases toner discharging capability of the opening A.

As illustrated in FIGS. 55 to 57, the stirring member 33*f* of the sixth embodiment is different from the first embodiment in that the push plates 33*f*10 are arranged on the tips of the plate members 33*f*1 (on the sides toward the inside of the cap portion 34Y). The push plates 33*f*10 are plate members that stand approximately perpendicular to the main bodies of the plate members 33*f*1. Each of the push plates 33*f*10 includes a tapered portion 33*f*100 on the outer circumference thereof.

As described above, because the push plates 33*f*10 are arranged on the tip of the plate members 33*f*1 of the stirring member 33*f*, the push plates 33*f*10 push toner toward the toner outlet W in the cap portion 34Y along with the rotation of the stirring member 33*f*. Therefore, even when the vicinity of the push plates 33*f*10 (a toner fall path C) is clogged with toner, the toner can be smoothly discharged from the toner outlet W.

Figures 1, 2, 3, 4, 58A:
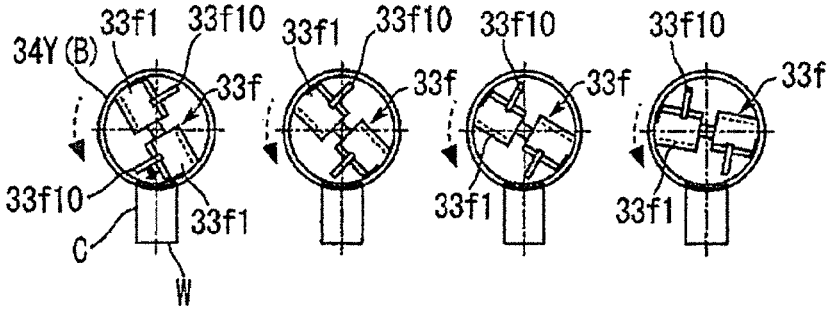
Figures 1, 2, 3, 4, 58B:
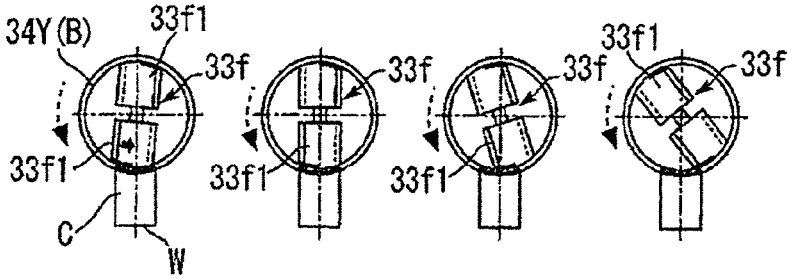

FIGS. 58A-1 to 58A-4 are schematic front views of how the stirring member 33*f* rotates in the toner container 32Y that has the stirring member 33*f* with the push plates 33*f*10 (the stirring member 33*f* of the sixth embodiment). FIGS. 58B-1 to 58B-4 are schematic front views of how the stirring member 33*f* rotates in the toner container 32Y that has the stirring member 33*f* without the push plates 33*f*10 (the stirring member 33*f* of the first embodiment).

In FIGS. 58A-1 and 58B-1, black arrows indicate a toner conveying direction in which the stirring member 33*f* conveys toner toward the toner outlet W (the toner supply port 72*w*).

As illustrated in FIG. 58B-1, when the push plates 33*f*10 are not arranged on the tips of the plate members 33*f*1 of the stirring member 33*f*, toner is conveyed in a circumferential direction along the inner circumference of the cap portion 34Y along with the rotation of the stirring member 33*f*. By contrast, as illustrated in FIG. 58A-1, when the push plates 33*f*10 are arranged on the tips of the plate members 33*f*1 of the stirring member 33*f*, the push plates 33*f*10 convey toner toward the toner outlet W (conveyance in an approximately normal direction with respect to the inner circumference of the cap portion 34Y) along with the rotation of the stirring member 33*f*.

The toner container 32Y of the sixth embodiment includes, similarly to the first embodiment, on the shutter deforming unit 34*d*2, the shutter deforming unit 34*d*2 that is elastically deformed by using the connection position with the shutter main unit 34*d*1 as a base point, and includes, on the shutter deforming unit 34*d*2, the stoppers 34*d*22 for regulating the movement of the shutter deforming unit 34*d*2 in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete.

Therefore, according to the sixth embodiment, similarly to the first embodiment, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

The cap portion 34Y of the toner container 32Y of the sixth embodiment is formed by integral molding, similarly to the first embodiment. Therefore, similarly to the first embodiment, the toner container 32Y of the sixth embodiment has good operability, and even when the structure of the cap portion 34Y is complicated, the dimensional accuracy and the mechanical strength of the cap portion 34Y can be adequately ensured and costs can be relatively reduced.

Seventh Embodiment

A seventh embodiment will be described in detail below with reference to FIGS. 59 to 61.

A toner container according to the seventh embodiment is different from the sixth embodiment in that a flexible member 34*u* is disposed near the toner outlet W of the cap portion 34Y.

The toner container 32Y of the seventh embodiment mainly includes, similarly to the sixth embodiment, the container body 33Y (bottle body) and the cap portion 34Y (bottle cap) arranged on the head of the container body. The toner container 32Y of the seventh embodiment further includes the stirring member 33*f*, the cap seal 37, the shutter member 34*d*, the shutter seal 36 as a seal member, and the RFID chip 35 as an electronic-information storage member, in addition to the container body 33Y and the cap portion 34Y (see FIG. 9).

In the toner container 32Y of the seventh embodiment, similarly to the sixth embodiment, the stirring member 33*f* that rotates together with the container body 33Y is fitted to the bottle opening 33*a* (opening A).

Figure 59:
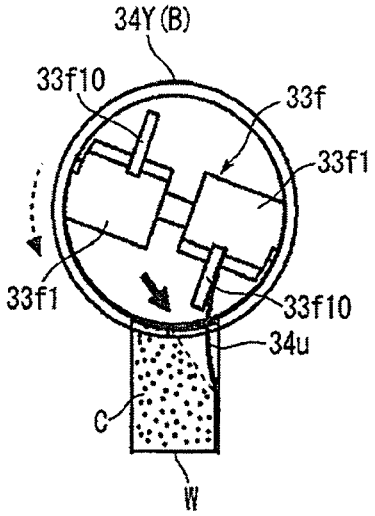
FIG. 59 is a schematic cross-sectional view of a cap portion of a toner container according to a seventh embodiment.
Figure 60:
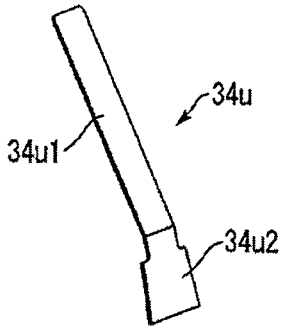
FIG. 60 is a perspective view of a flexible member disposed near a toner outlet of the toner container illustrated in FIG. 59.

As illustrated in FIG. 59, the stirring member 33*f* of the seventh embodiment includes the plate members 33*f*1 being a pair, which extend from the cavity B in the cap portion 34Y toward the inside of the container body 33Y (which are alternately inclined). The stirring member 33*f* of the seventh embodiment further includes the push plates 33*f*10 on the tips of the plate members 33*f*1 (on the side toward the inside of the cap portion 34Y), similarly to the sixth embodiment.

Referring to FIGS. 59 and 61A to 61G, the cap portion 34Y of the seventh embodiment is different from the sixth embodiment in that the cap portion 34Y includes the flexible member

34*u* made of flexible material such as mylar with a thickness of about 0.188 mm to 0.5 mm from the toner fall path C to the cavity B. More specifically, as illustrated in FIG. 60, a part of the flexible member 34*u* is bent, and a fixation portion 34*u*2 (with a width wider than a flexible portion 34*u*1) as an attachment surface is attached (fixed) to the inner wall of the toner fall path C (the inner wall on the side near the toner outlet W and on the downstream side of the stirring member 33*f* in the rotation direction). Specifically, the fixation portion 34*u*2 is attached to the inner wall of the toner fall path C so that the bent portion of the flexible member 34*u* can be located in the toner fall path C. The flexible portion 34*u*1 of the flexible member 34*u* is a free end and extends from the toner fall path C to the inside of the cavity B. The tip of the flexible portion 34*u*1 comes into contact with the push plates 33*f*10 along with the rotation of the stirring member 33*f*, so that even when the vicinity of the toner outlet W (the toner fall path C) is clogged with toner, the toner can be smoothly discharged from the toner outlet W.

Figure 61A:
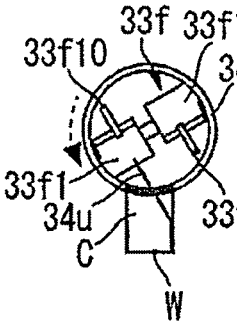
FIGS. 61A to 61G are schematic front views of how a stirring member of the toner container illustrated in FIG. 59 rotates.
Figure 61B:
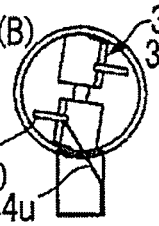
Figure 61C:
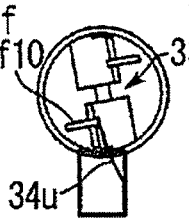
Figure 61D:
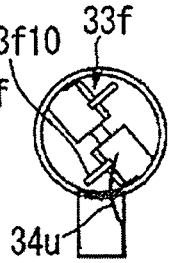

More specifically, as illustrated in FIGS. 61A to 61D, the push plates 33*f*10 push the flexible member 34*u* (the flexible portion 34*u*1) along with the rotation of the stirring member 33*f*, so that the flexible member 34*u* is gradually bent in an arching line. At this time, even when toner is filled between the inner wall of the toner fall path C and the flexible member 34*u* in the state illustrated in FIG. 61A, because the flexible member 34*u* is greatly bent in an arching line and the space between the inner wall of the toner fall path C and the flexible member 34*u* increases as illustrated in FIG. 61D, toner filled in the toner fall path C is loosened.

Figure 61E:
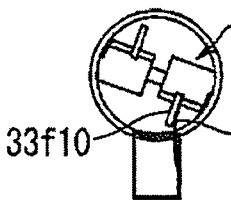
Figure 61F:
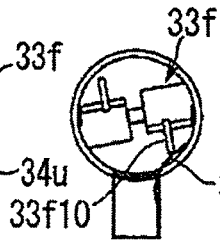
Figure 61G:
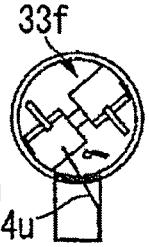

Thereafter, as illustrated in FIG. 61E, a planner portion of the push plate 33*f*10 and a planner portion of the flexible member 34*u* overlap each other, and the flexible member 34*u* is deformed so that the fixation portion 34*u*2 and the flexible portion 34*u*1 become approximately flat with respect to each other. During this, the space between the flexible member 34*u* and the toner is increasingly widened, so that the toner is more and more loosened and supplied to the space by being pushed by the push plate 33*f*10 (the state illustrated in FIG. 59). Accordingly, toner discharging capability and toner loosening performance at the toner outlet W (the toner fall path C) are increased. Thereafter, as illustrated in FIG. 61F, the flexible member 34*u* is completely warped, and the contact with the push plate 33*f*10 is released. Then, as illustrated in FIG. 61G, the flexible member 34*u* is returned to the initial state by the elastic force of the flexible member 34*u*. At this time, the toner receives a return force caused by the elasticity of the flexible member 34*u*, so that the toner loosening and the toner discharging at the toner fall path C are accelerated.

The shape of the flexible member 34*u* is not limited to that described in the seventh embodiment. For example, the flexible member 34*u* may not have a bent portion, or may have the fixation portion 34*u*2 in a different shape.

Similarly to the embodiments described above, the toner container 32Y of the seventh embodiment includes, on the shutter member 34*d*, the shutter deforming unit 34*d*2 that is elastically deformed by using the connection point with the shutter main unit 34*d*1 as a base point, and includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete.

Therefore, according to the seventh embodiment, similarly to the above embodiments, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

The cap portion 34Y of the toner container 32Y of the seventh embodiment is formed by integral molding, similarly to the above embodiments. Therefore, similarly to the above embodiments, the toner container 32Y of the seventh embodiment has good operability, and even when the structure of the cap portion 34Y is complicated, the dimensional accuracy and the mechanical strength of the cap portion 34Y can be adequately ensured and costs can be relatively reduced.

Eighth Embodiment

An eighth embodiment will be described in detail below with reference to FIGS. 62 to 64.

A toner container according to the eighth embodiment is different from the above embodiments in that the container body 33Y of the eighth embodiment is non-rotatably held by the toner-container holder 70 together with the cap portion 34Y, whereas the container body 33Y of the above embodiments is rotatably held by the toner-container holder 70.

Figure 62:
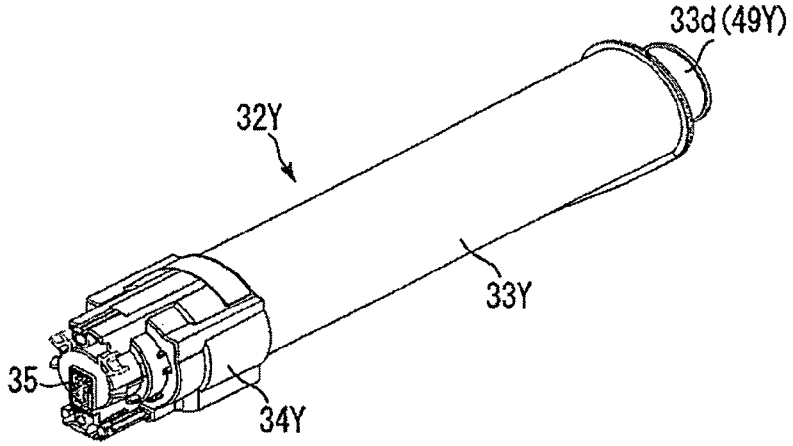
FIG. 62 is a perspective view of a toner container according to an eighth embodiment.

Referring to FIG. 62, similarly to the above embodiments, the toner container 32Y of the eighth embodiment mainly includes the container body 33Y (bottle body) and the cap portion 34Y (bottle cap) arranged on the head of the container body.

The toner container 32Y of the eighth embodiment is different from the above embodiments in that the container body 33Y (bottle body) is fixed to the cap portion 34Y (bottle cap) by any ways of fixing such as bonding, fusion bonding, or engaging. That is, the container body 33Y is not connected to the cap portion 34Y so as to relatively rotate, but is fixed to the cap portion 34Y so as not to relatively rotate.

The container body 33Y of the eighth embodiment is different from the above embodiments in that a spiral-shaped projection is not formed on the circumferential surface thereof. The gear 33*c* is not integrally formed on the container body 33Y, which is different from the above embodiments. A gear member 42Y (see FIG. 64) and the stirring member 33*f* are arranged so as to rotate relative to the container body 33Y and the cap portion 34Y. A conveying member 41Y (see FIG. 63) for conveying toner contained in the container body 33Y toward the opening A is arranged inside the container body 33Y, which is different from the above embodiments.

The cap portion 34Y can be configured similarly to the above embodiments except that the container body 33Y is stuck (fixed) thereto.

The stirring member 33*f* can be configured similarly to the above embodiments except that the stirring member 33*f* is not fixed to the container body 33Y.

Figure 63:
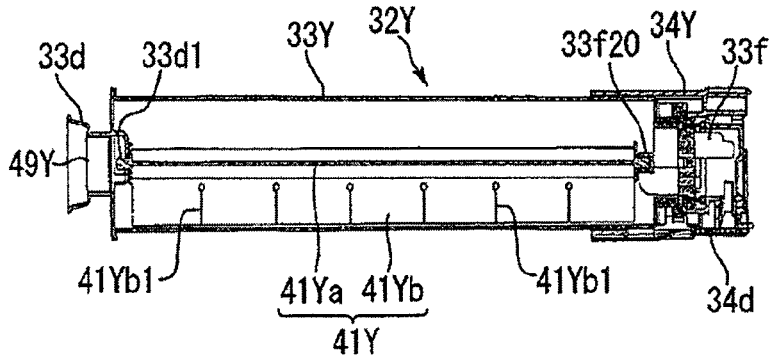
FIG. 63 is a cross-sectional view of the toner container illustrated in FIG. 62.
Figure 64:
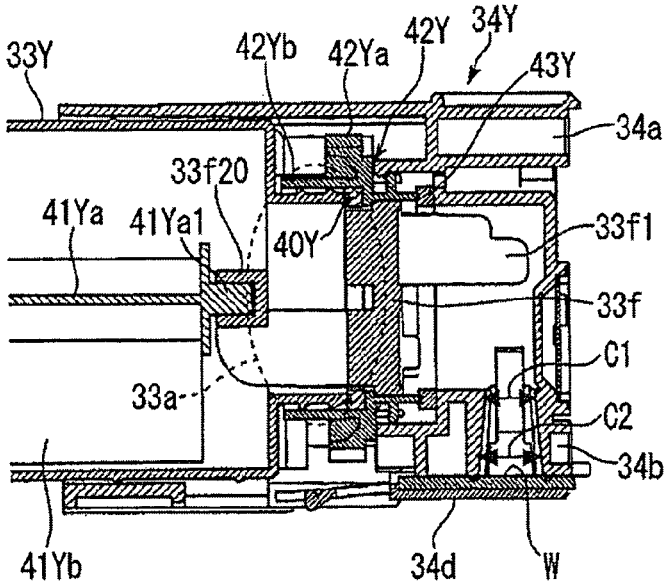
FIG. 64 is a cross-sectional view of the vicinity of a cap portion of the toner container illustrated in FIG. 62.

Referring to FIGS. 63 and 64, detailed explanation will be given below.

Referring to FIG. 63, in the eighth embodiment, the gripper 33*d* is arranged on one end of the container body 33Y in the longitudinal direction (an end opposite to the end on which the cap portion 34Y is arranged in the longitudinal direction and a rear end in the attachment direction for attachment to the apparatus body 100) so that a user can grip it for attaching/detaching the toner container 32Y. A through hole leading from the inside to the outside of the container body 33Y is formed on the gripper 33*d*, and a cap member 49Y is detachably attached to the through hole. The cap member 49Y is used for supplying (or clearing out) toner to the toner container 32Y at the time of manufacturing or recycling. When toner is to be supplied (or cleared out), the cap member 49Y is removed from the container body 33Y. Thereafter, when the supply of toner is completed, the cap member 49Y is attached to the container body 33Y.

Referring to FIG. 63, the conveying member 41Y arranged inside the container body 33Y is formed by attaching a thin flexible stirring member 41Yb, which is made of material such as mylar, to a shaft 41Ya. The shaft 41Ya of the conveying member 41Y is configured such that an end 41Ya1 (see FIG. 64) thereof on one side in the longitudinal direction is engaged with a connecting portion 33*f*20 arranged at the rotation center of the stirring member 33*f*, and an end on the other side in the longitudinal direction is rotatably supported by a bearing 33*d*1 (which is a base portion of the gripper 33*d* and formed on a portion inside the container body 33Y). When the stirring member 33*f* is rotated together with the gear member 42Y by a drive force applied by the driving unit 91 while the container body 33Y and the cap portion 34Y are non-rotatably held by the toner-container holder 70, the conveying member 41Y connected to the stirring member 33*f* at the position of the connecting portion 33*f*20 rotates along with the rotation of the stirring member 33*f*. Therefore, the toner contained in the container body 33Y is convened toward the cap portion 34Y side by the conveying force of the flexible stirring member 41Yb arranged on the conveying member 41Y.

The flexible stirring member 41Yb of the conveying member 41Y includes slits 41Yb1 at a plurality of positions (six positions in the eighth embodiment) in the longitudinal direction. Therefore, the edge of the flexible stirring member 41Yb (a free end side that is not supported by the shaft 41Ya) comes into slide contact with the inner circumferential surface of the container body 33Y along with the rotation of the conveying member 41Y, and the flexible stirring member 41Yb is appropriately twisted and bent during the rotation, so that the toner contained in the container body 33Y is stirred and conveyed to the right side in FIG. 63.

Thus, similarly to the above embodiments, the toner container 32Y of the eighth embodiment can discharge toner from the toner outlet W of the cap portion 34Y.

Referring to FIG. 64, the gear member 42Y is rotatably mounted on the container body 33Y.

More specifically, a gear engaging portion 42Yb formed on the gear member 42Y engages with a projection formed on the outer circumferential surface of the bottle opening 33*a*, so that the gear member 42Y is rotatably held by the container body 33Y. A gear portion 42Ya (spur gear) is formed on the outer circumferential surface of the gear member 42Y. When the toner container 32Y is set in the apparatus body 100, the gear portion 42Ya engages with the drive gear 81 of the apparatus body 100.

A seal member 40Y is disposed between the gear member 42Y and an end face of the bottle opening 33*a* in order to prevent toner from leaking to the outside of the toner container 32Y. The seal member 40Y is made of foamed elastic material such as foamed polyurethane. The seal member 40Y has a ring shape so as to follow the end face of the bottle opening 33*a*, and is attached to the gear member 42Y. When the gear member 42Y is set in the toner container 32Y, the seal member 40Y is pushed against the end face of the bottle opening 33*a*, so that the sealing capability between the container body 33Y and the gear member 42Y can be ensured.

The gear member 42Y is not fixed even to the cap portion 34Y but is rotatably held with respect to the claw members 34*j* of the cap portion 34Y. The way of holding the gear member 42Y by the cap portion 34Y is similar to the way of holding the bottle opening 33*a* of the container body 33Y by the cap portion 34Y as described in the above embodiments. That is, the claw members 34*j* of the cap portion 34Y are engaged with flange-shaped engaging portions arranged on the gear member 42Y so that the gear member 42Y can be rotatably supported by the cap portion 34Y. A cap seal 43Y made of foamed elastic material is attached to a portion of the cap portion 34Y against which the end face of the gear member 42Y (the end face on the side opposite to the container body 33Y) is pushed. Therefore, it is possible to prevent toner from leaking between the gear member 42Y and the cap portion 34Y.

The stirring member 33*f* is attached to an inner diameter portion of the gear member 42Y. The shaft 41Ya (the end 41Ya1 on one end side) of the conveying member 41Y is connected to the connecting portion 33*f*20 of the stirring member 33*f* as described above.

In the eighth embodiment, toner fall paths C1 and C2 formed on the cap portion 34Y are configured such that a flow passage area gradually increases from the upstream side (the lower side of the approximately cylindrical cavity B) to the downstream side (the toner outlet W). That is, as illustrated in FIG. 64, a flow passage area of the toner fall path C2 on the lower side in the vertical direction is made greater than a flow passage area of the toner fall path C1 on the upper side in the vertical direction (C1<C2). Therefore, it is possible to further prevent the toner fall path from being clogged with toner and allow toner to be smoothly discharged from the toner outlet W.

Similarly to the above embodiments, the toner container 32Y of the eighth embodiment includes, on the shutter member 34*d*, the shutter deforming unit 34*d*2 that is elastically deformed by using the connection position with the shutter main unit 34*d*1 as a base point, and includes, on the shutter deforming unit 34*d*2, the stoppers 34*d*22 for regulating the movement of the shutter member 34*d* in the open direction and the stopper releasing unit 34*d*21 for releasing the regulation. The cap portion 34Y includes the shutter housing unit 34*n* (housing unit) for holding and housing the shutter deforming unit 34*d*2 after the opening operation of the shutter member 34*d* is complete.

Therefore, according to the eighth embodiment, similarly to the above embodiments, the shutter member 34*d* that opens and closes the toner outlet W does not easily move while the toner container 32Y remains alone, and it is possible to prevent the shutter member 34*d* from protruding from the cap portion 34Y even while the shutter member 34*d* keeps the toner outlet W open.

The cap portion 34Y of the toner container 32Y of the eighth embodiment is formed by integral molding, similarly to the above embodiments. Therefore, similarly to the above embodiments, the toner container 32Y of the eighth embodiment has good operability, and even when the structure of the cap portion 34Y is complicated, the dimensional accuracy and the mechanical strength of the cap portion 34Y can be adequately ensured and costs can be relatively reduced.

In the above embodiments, only toner is contained in the toner containers 32Y, 32M, 32C, and 32K. However, it is possible to contain two-component developer in the toner containers 32Y, 32M, 32C, and 32K for an image forming apparatus that appropriately supplies two-component developer formed of toner and carrier to a developing device. Even in this case, the same advantages as described above can be achieved.

In the above embodiments, a part or all of the image forming units 6Y, 6M, 6C, and 6K may be configured as a process cartridge. Even in this case, the same advantages as described above can be achieved.

In the first to seventh embodiments, the container body 33Y is made rotatable so that toner contained in the container body 33Y can be conveyed toward the opening A. However, the container body 33Y may be configured such that the container body 33Y is non-rotatably held by the toner-container holder 70 together with the cap portion 34Y, and the container body 33Y includes, inside thereof, a conveying member (for example, a conveying member that has a conveying coil or a plurality of conveying wings on a shaft portion and that rotates in a predetermined direction by a gear separated from the container body) for conveying toner toward the opening A so that toner contained in the container body 33Y can be conveyed toward the opening A (see FIG. 65).

Figure 65:
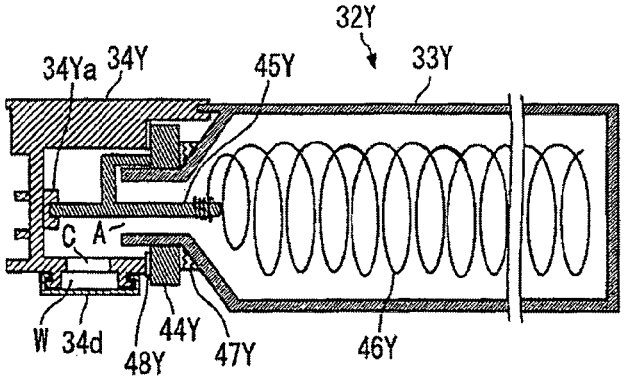
FIG. 65 is a configuration diagram of a toner container according to another embodiment.

More specifically, as illustrated in FIG. 65, the toner container 32Y mainly includes the container body 33Y, a gear 44Y, and the cap portion 34Y (bottle cap). The opening A is arranged on the head of the container body 33Y, and the gear 44Y is rotatably arranged on the outer circumference of the opening A. The gear 44Y engages with the drive gear of the apparatus body 100 to rotate a coil 46Y about a rotation axis. The opening A is used for discharging toner contained in the container body 33Y to the space inside the cap portion 34Y. A rotary shaft 45Y is integrally arranged on the gear 44Y, and the spiral-shaped coil 46Y (conveying coil) is connected to the rotary shaft 45Y. One end of the rotary shaft 45Y is supported by a bearing 34Ya of the cap portion 34Y. The coil 46Y is extended from the opening A to the bottom portion inside the container body 33Y. The gear 44Y rotates around the container body 33Y to thereby rotate the rotary shaft 45Y and the coil 46Y. Therefore, toner contained in the container body 33Y is conveyed to the opening A side by a toner conveying force of the coil 46Y. The gear 44Y is inserted into the outer circumference of the opening A so as to be sandwiched by the container body 33Y and the cap portion 34Y. A rubber member 47Y is disposed between the gear 44Y and the container body 33Y on one end face side of the gear 44Y. A seal member 48Y is disposed between the gear 44Y and the cap portion 34Y on the other end face side of the gear 44Y. With this configuration, the sealing capability of the toner container 32Y as a whole can be ensured. That is, it is possible to prevent toner from leaking between the gear 44Y and the container body 33Y and between the gear 44Y and the cap portion 34Y.

The present invention can also be applied to the above toner container 32Y similarly to the above embodiments. Accordingly, it is possible to achieve the same advantages of the above embodiments.

In the first to seventh embodiments, the toner fall path C in the cap portion 34Y has a uniform flow passage area from the upstream side (the lower side of the approximately cylindrical cavity B) to the downstream side (the toner outlet W). However, it is possible to modify the toner fall path C of the first to seventh embodiment into the toner fall paths C1 and C2 of the eighth embodiment (see FIG. 64) such that the flow passage area gradually increases from the upstream side (the lower side of the approximately cylindrical cavity B) to the downstream side (the toner outlet W). In this case, it is possible to further prevent the toner fall path C from being clogged with toner and allow toner to be more smoothly discharged from the toner outlet W.

According to an embodiment, a toner container that is detachably attached to a main body of an image forming apparatus such that a longitudinal direction of the toner container is parallel to a horizontal direction includes: a cylindrical container body that has an opening on one end thereof in the longitudinal direction, and is configured to convey toner contained therein toward the opening; a cap portion into which the opening of the container body is inserted, and which includes a toner outlet at a bottom portion thereof for discharging toner, which has been discharged from the opening of the container body, to the outside of the toner container in a vertically downward direction; and a shutter member that is held on the bottom portion of the cap portion, and moves along an outer periphery of the cap portion to thereby open and close the toner outlet. In the toner container, the shutter member includes: a shutter main unit that engages with a rail unit arranged on the cap portion, and moves along the rail unit to thereby open and close the toner outlet; and a shutter deforming unit that is integrally formed on the shutter main unit, and is elastically deformable in a vertical direction by using a connection position between the shutter deforming unit and the shutter main unit as a base point. Furthermore, in the toner container, the shutter deforming unit includes: a stopper that comes into contact with a contact portion formed on the cap portion to thereby regulate movement of the shutter member in a direction in which the toner outlet that has been closed is opened; and a stopper releasing unit that protrudes downward in the vertical direction, and displaces the stopper upward along with upward elastic deformation of the shutter deforming unit upon reception of an external force from the lower side to thereby release a state of contact between the stopper and the contact portion. Moreover, in the toner container, the cap portion further includes: a housing unit that is arranged on the container body side in the longitudinal direction relative to the shutter main unit for holding and housing the shutter deforming unit after the shutter member opens the toner outlet.

According to another embodiment, in the above-mentioned toner container, the housing unit of the cap portion has a hole or a groove for reducing a contact force between the stopper releasing unit and the housing unit, the hole or the groove being formed at a position through which the stopper releasing unit of the shutter deforming unit passes along with an opening operation of the shutter member.

According to still another embodiment, in the above-mentioned toner container, the housing unit of the cap portion has a hole or a groove for reducing a contact force between the stopper releasing unit and the housing unit, the hole or the groove being formed at a position at which the stopper releasing unit of the shutter deforming unit stops at the end of an opening operation of the shutter member.

According to still another embodiment, in the above-mentioned toner container, the housing unit of the cap portion has a hole or a groove for reducing a contact force between the stopper and the housing unit, the hole or the groove being formed at a position through which the stopper of the shutter deforming unit passes along with an opening operation of the shutter member and which is other than the position of the contact portion.

According to still another embodiment, in the above-mentioned toner container, the housing unit of the cap portion has a hole or a groove for reducing a contact force between the stopper and the housing unit, the hole or the groove being formed at a position at which the stopper of the shutter deforming unit stops at the end of an opening operation of the shutter member.

According to still another embodiment, in the above-mentioned toner container, the shutter main unit of the shutter member includes a plurality of projections that comes in point contact with the rail unit.

According to still another embodiment, in the above-mentioned toner container, the rail unit of the cap portion includes a first rail unit that extends in the longitudinal direction to support the shutter deforming unit side of the shutter main unit, and a second rail unit that extends in the longitudinal direction to support a side of the shutter main unit opposite to the shutter deforming unit side, wherein the length of the first rail unit in the longitudinal direction is made shorter than the length of the second rail unit in the longitudinal direction.

According to still another embodiment, in the above-mentioned toner container, when the shutter member completely opens the toner outlet, a portion of the shutter main unit supported by the second rail unit is separated from the second rail unit and the shutter main unit is supported only by the first rail unit.

According to still another embodiment, in the above-mentioned toner container, the cap portion includes a plurality of claw members that engages with the container body to rotatably hold the container body, the claw members being arranged in parallel in a circumferential direction of the cap portion such that, when the cap portion is viewed in a cross-section perpendicular to the longitudinal direction, any of the claw members is not disposed at a position of the housing unit and at least one of the claw members is disposed on an upper portion opposite to the housing unit.

According to still another embodiment, in the above-mentioned toner container, when the cap portion is viewed in a cross-section perpendicular to the longitudinal direction, a pitch between the claw members disposed on the upper portion opposite to the housing unit is made smaller than a pitch between the claw members disposed on a side portion of the cap portion.

According to still another embodiment, in the above-mentioned toner container, the cap portion includes a protrusion that is arranged near the housing unit for reducing a gap between the cap portion and the container body.

According to still another embodiment, in the above-mentioned toner container, the stopper is formed on a tip of the shutter deforming unit, the tip being on a side opposite to the shutter main unit, and the stopper releasing unit is formed between the stopper and the connection position.

According to still another embodiment, in the above-mentioned toner container, the container body includes a spiral-shaped projection on an inner circumferential surface thereof, and is held so as to rotate relative to the cap portion.

According to still another embodiment, in the above-mentioned toner container, the cap portion includes a cylindrical cavity that is formed inside of the cap portion and extends in the longitudinal direction, and a toner fall path that has a columnar shape with a constant flow passage area from a lower circumferential surface of the cavity to the toner outlet.

According to still another embodiment, an image forming apparatus includes the above-mentioned toner container that is set in a main body of the image forming apparatus.

Ninth Embodiment

Figure 66:
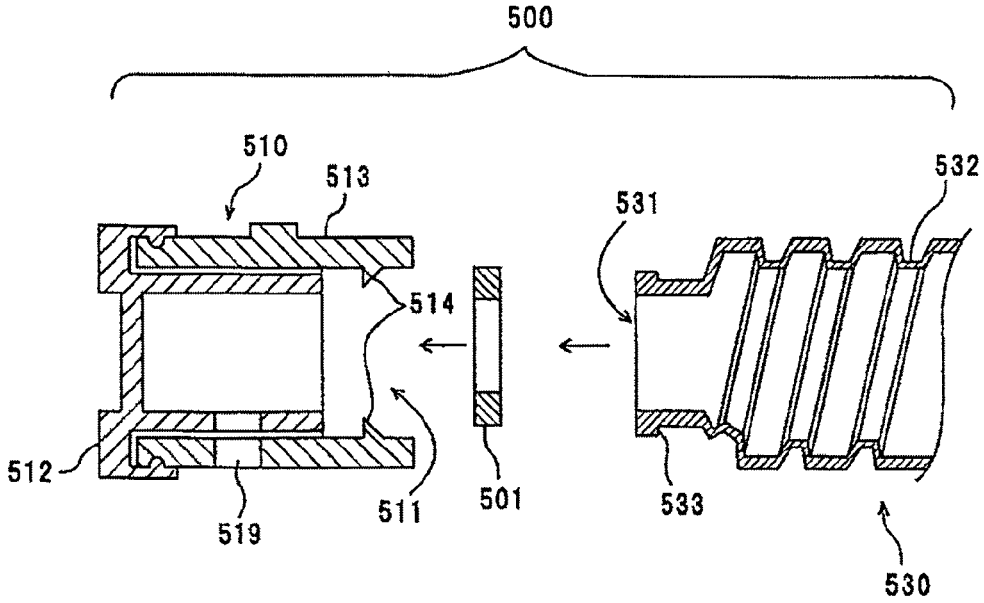
FIG. 66 is an exploded cross-sectional view of a tip portion of a conventional cylindrical rotary toner container.
Figure 67:
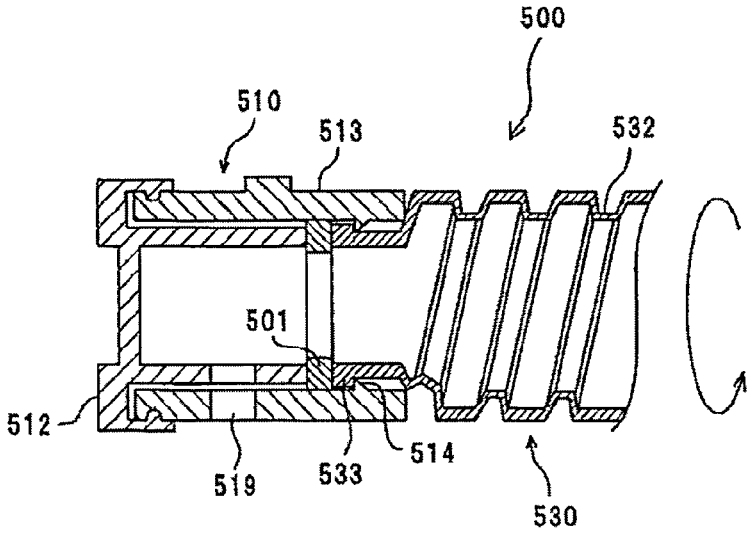
FIG. 67 is a cross-sectional view of the tip portion when the cylindrical container is attached to a cap portion.

As one of toner containers such as toner cartridges that are detachably attached to image forming apparatus bodies, a cylindrical rotary toner container is known that includes a container body (cylindrical container) and a cap portion that rotatably holds a tip portion of the container body (see, for example, Japanese Patent No. 3628539). FIG. 66 is an exploded cross-sectional view of a tip portion of a conventional cylindrical rotary toner container. In the figure, a toner container 500 includes a ring-shaped seal member 501, a cap portion 510 having a shape similar to a cap of a tea storage tin, and a cylindrical container 530 in the form of a long cylinder. In the figure, the cap portion 510, the seal member 501, and the cylindrical container 530 are separated for the sake of convenience; however, they are actually assembled in an integrated manner as illustrated in FIG. 67. Furthermore, only a tip portion of the cylindrical container 530 in the axial direction of the cylinder is illustrated for the sake of convenience.

As illustrated in FIG. 66, the cap portion 510 mainly includes a cap 512 and a cylindrical member 513. One end of the cap 512 in the axial direction of the cylinder is opened and the other end of the cap 512 is closed. By contrast, both ends of the cylindrical member 513 in the axial direction of the cylinder are opened. The inner diameter of the cylindrical member 513 is slightly greater than the outer diameter of the cap 512, and the cap 512 is fitted and welded to the inside of the cylindrical member 513. A receiving opening 511 for receiving the cylindrical container 530 is formed on one end of the cap 512 in the axial direction of the cylinder. Through holes penetrating the cylindrical member 513 and the cap 512 in the thickness direction of the cylinder are formed in specific portions of respective circumferential surfaces of the cylindrical member 513 and the cap 512. The cap 512 is inserted into the cylindrical member 513 so that the through hole thereof communicates with the through hole of the cylindrical member 513. Therefore, a toner outlet 519 for discharging toner contained in the cap portion 510 to the outside is formed at the specific portion of the circumferential surface of the cap portion 510.

A hook portion 514 that protrudes toward the inside of the cylinder is formed on the inner circumferential surface of the cylindrical member 513. The hook portion 514 has a tapered shape on the receiving opening 511 side and has a wall shape standing approximately vertically from the circumferential surface thereof on the cap 512 side. The approximately vertically standing surface functions as a hook surface on which an outer circumferential projection 533, which will be described below, is hooked up.

The cylindrical container 530 includes a container opening 531 on the tip thereof. The cylindrical container 530 also includes the outer circumferential projection 533 that extends on the entire circumference of the outer circumferential surface of the tip of the cylindrical container. The cylindrical container 530 has, on the circumferential wall, a spiral-shaped groove 532 (hereinafter, referred to as a "spiral groove 532") that is recessed inward from the exterior of the container in the same manner as an embossed portion. The spiral groove 532 is a spiral-shaped concave portion when viewed from the exterior of the container and is a spiral-shaped convex portion when viewed from the interior of the container.

The ring-shaped seal member 501 and the tip portion of the cylindrical container 530 are inserted into the cap portion 510 in this order as indicated by arrows in the figure. At this time, the ring-shaped seal member 501 firmly adheres to the rear end of the cap 512 inside the cap portion 510. The outer circumferential projection 533 of the cylindrical container 530 passes over the tapered projection of the hook portion 514 of the cylindrical member 513 of the cap portion 510. Accordingly, the tip of the cylindrical container 530 firmly adheres to the seal member 501. In this state, the outer circumferential projection 533 of the cylindrical container 530 is hooked up on the hook surface of the hook portion 514, so that the cylindrical container 530 can be rotatably held by the cap portion 510 without coming off from the cap portion 510 as illustrated in FIG. 67.

When the cylindrical container 530 of the toner container 500 is rotated by a driving unit (not illustrated) in the image forming apparatus body, toner (not illustrated) contained in the cylindrical container 530 moves from right to left in the figure along with the spiral movement of the spiral groove 532. Accordingly, the toner moves to the inside of the cap 512 of the cap portion 510 via the container opening (531 in FIG. 66) of the cylindrical container 530. Thereafter, the toner is discharged to the outside from the toner outlet 519 of the cap portion 510 and supplied to a developing device (not illustrated) that is a part of an image forming unit.

In the toner container 500 having the above configuration, the cap 512 and the cylindrical member 513 of the cap portion 510 are separately formed in order to form the hook surface of the hook portion 514. More specifically, the hook surface of the hook portion 514 needs to be formed as a surface that approximately vertically stands from the inner circumferential surface of the cylindrical member 513 as described above in order to fulfill the function to hook up the outer circumferential projection 533 of the cylindrical container 530 inserted into the cap portion 510. When the cap 512 and the cylindrical member 513 are not separately formed but are formed by integral molding, an inner mold for molding the interior of the cylinder needs to be pulled out from the inside of the cylinder without being hooked up on the hook surface of the hook portion 514 that stands approximately vertically. To this purpose, it is necessary to use low rigidity material such as polyethylene or polypropylene as the material of the cap portion 510 in order to greatly deform the cylindrical member 513 for a moment when the inner mold is pulled out. However, the cap portion 510 made of such low rigidity material may not have necessary mechanical strength. Furthermore, the cap portion 510 may be relatively easily deformed or dimensional accuracy or flatness accuracy may be reduced. Therefore, it becomes difficult to successfully hook up the outer circumferential projection 533 of the cylindrical container 530 on the hook portion 514 or the sealing capability of the seal member 501 may be reduced. On the other hand, when high rigidity material such as ABS (acrylonitrile butadiene styrene) or polystyrene is used, desired mechanical strength, desired dimensional accuracy, and desired flatness accuracy can be obtained. However, if the cap 512 and the cylindrical member 513 are formed by integral molding, it is impossible to pull out the inner mold from the inside of the cylinder. Therefore, conventionally, there has been used a method in which the cap 512 made of high rigidity material and the cylindrical member 513 made of high rigidity material are molded by using different molds, and thereafter, they are fitted and welded together.

However, in this method, a complicated operation is necessary in which the cap 512 and the cylindrical member 513 are fitted to each other so that the respective through holes for the toner outlet can communicate with each other, and thereafter, the cap 512 and the cylindrical member 513 are welded together. This leads to increase in costs. Furthermore, when the amount of weld is unbalanced, the posture of the cylindrical member 513 on the cap 512 may slightly varies, which makes it impossible to insert the cylindrical container 530 into the cap portion 510.

According to the present embodiment, there is provided a toner container that can solve a problem that occurs by molding the main body and the hook portion of the cap portion by using different molds, and that can ensure desired mechanical strength, desired dimensional accuracy, and desired flatness accuracy of the cap portion.

The basic configuration of the image forming apparatus (printer) of the present embodiment is the same as those of the first to sixth embodiments.

The image forming apparatus having the above configuration includes four image forming units (process cartridges) 1Y, 1M, 1C, and 1K, an optical writing unit 20, and the like, which form an image forming means for forming a toner image.

Figure 68:
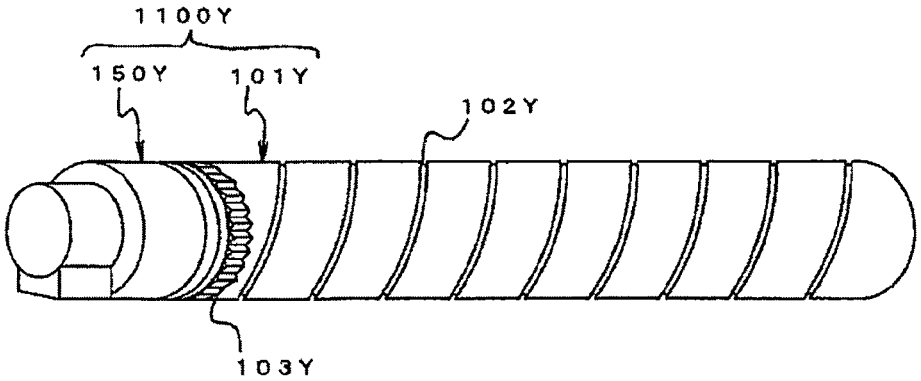
FIG. 68 is a perspective view of a toner container for Y in an image forming apparatus (printer) according to a ninth embodiment.

FIG. 68 is a perspective view of a toner container (toner cartridge) 1100Y for Y (yellow). In the figure, the toner container 1100Y for Y includes a container body (cylindrical container) 101Y for containing Y toner (not illustrated), and a cap portion 150Y. The toner container 1100Y also includes a seal member (not illustrated), which will be described below.

Figure 69:
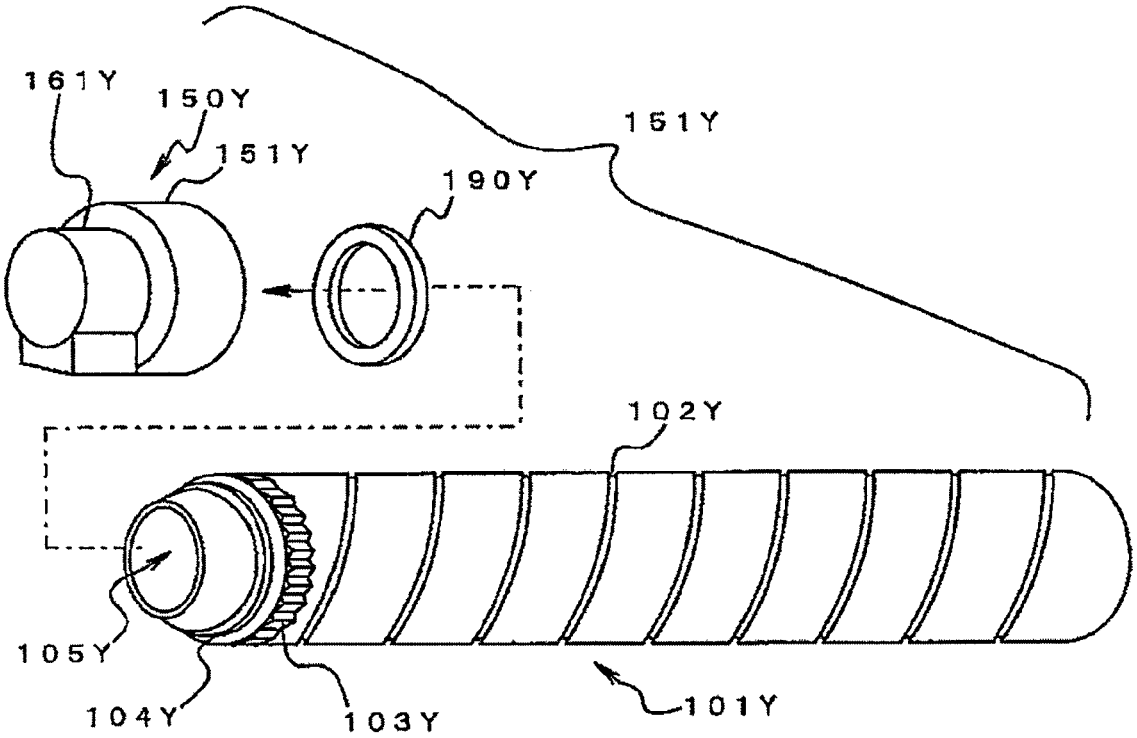
FIG. 69 is an exploded perspective view of the toner container.

As illustrated in FIG. 69, the cap portion 150Y receives a tip portion of the container body 101Y inside thereof so as to cover the tip portion of the container body 101Y in the axial direction of the cylinder. A spiral groove 102Y, which is spirally recessed inward from the exterior of the container, is formed on the circumferential surface of the container body 101Y. A gear portion 103Y, which engages with a drive gear of a toner supply device (not illustrated), and an outer circumferential projection 104Y, which projects on the entire circumference in the circumferential direction, are also formed on the circumferential surface of the container body 101Y. Furthermore, a container opening 105Y having a circular hole shape is formed on the tip of the container body 101Y in the axial direction of the cylinder such that the container opening faces forward in the axial direction of the cylinder.

Figure 70:
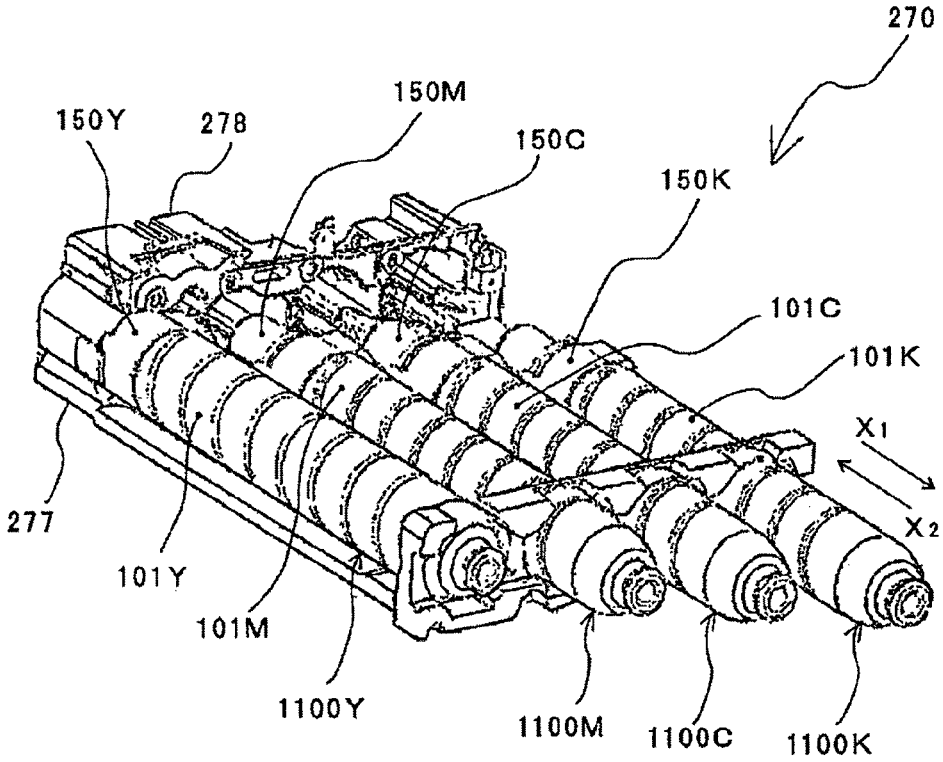
FIG. 70 is a perspective view of a toner-container holder (toner supply device) of the image forming apparatus.

FIG. 70 is a perspective view of the toner supply device of the image forming apparatus. In the figure, a toner supply device 270 as a toner-container holder includes a container placement board (cartridge placement board) 277 for placing the four toner containers 1100Y, 1100M, 1100C, and 1100K, and a cylinder driving unit 278 that separately rotates the container bodies 101Y, 101M, 101C, and 101K of the respective toner containers. The cap portions 150Y, 150M, 150C, and 150K of the toner containers 1100Y, 1100M, 1100C, and 1100K set on the container placement board 277 are engaged with the cylinder driving unit 278 of the toner-container holder (toner supply device) 270. As indicated by an arrow X1 in the figure, when the toner container 1100K being engaged with the cylinder driving unit 278 is slid on the container placement board 277 in a direction away from the cylinder driving unit 278, the cap portion of the toner container 1100K is detached from the cylinder driving unit 278. In this manner, the toner container 1100K can be detached from the toner-container holder 270.

In the toner-container holder 270 to which the toner container 1100K is not attached, when the toner container 1100K is slid on the container placement board 277 in a direction toward the cylinder driving unit 278 as indicated by an arrow X2 in the figure, the cap portion of the toner container 1100K is engaged with the cylinder driving unit 278. In this manner, the toner container 1100K can be attached to the toner-container holder 270. The toner containers 1100Y, 1100M, and 1100C for the other colors can also be attached to and detached from the toner-container holder 270 by the same operation.

The gear portion (not illustrated) as described above is formed on the outer circumferential surface of the tip portion of each of the container bodies 101Y, 101M, 101C, and 101K of the toner containers 1100Y, 1100M, 1100C, and 1100K. When the cap portions 150Y, 150M, 150C, and 150K of the toner containers 1100Y, 1100M, 1100C, and 1100K are engaged with the cylinder driving unit 278, drive gears for Y, M, C, and K (not illustrated), which are arranged on the cylinder driving unit 278, engage with the respective gear portions of the container bodies 101Y, 101M, 101C, and 101K. When the drive gears for Y, M, C, and K (not illustrated) on the cylinder driving unit 278 are rotated by a driving system (not illustrated), the container bodies 101Y, 101M, 101C, and 101K rotate on the cap portions 150Y, 150M, 150C, and 150K along with the rotation of the drive gears.

In FIG. 68 described above, when the container body 101Y rotates on the cap portion 150Y as above, Y toner (yellow toner) in the container body 101Y moves from the rear end side to the front end side in the rotation axis direction along the screw-shaped spiral groove 102Y. The Y toner flows into the cap portion 150Y via the container opening (105Y in FIG. 69) arranged on the tip of the container body 101Y.

The characteristic configuration of the image forming apparatus according to the embodiment will be described below. In FIG. 69 described above, the cap portion 150Y has a two-stage cylindrical structure in which a large-diameter cylindrical portion 151Y, which is a structural body in the form of a cylinder with a relatively large diameter, and a small-diameter cylindrical portion 161Y, which is a structural body in the form of a cylinder with a relatively small diameter, are concentrically stacked in the axial direction.

Figure 71:
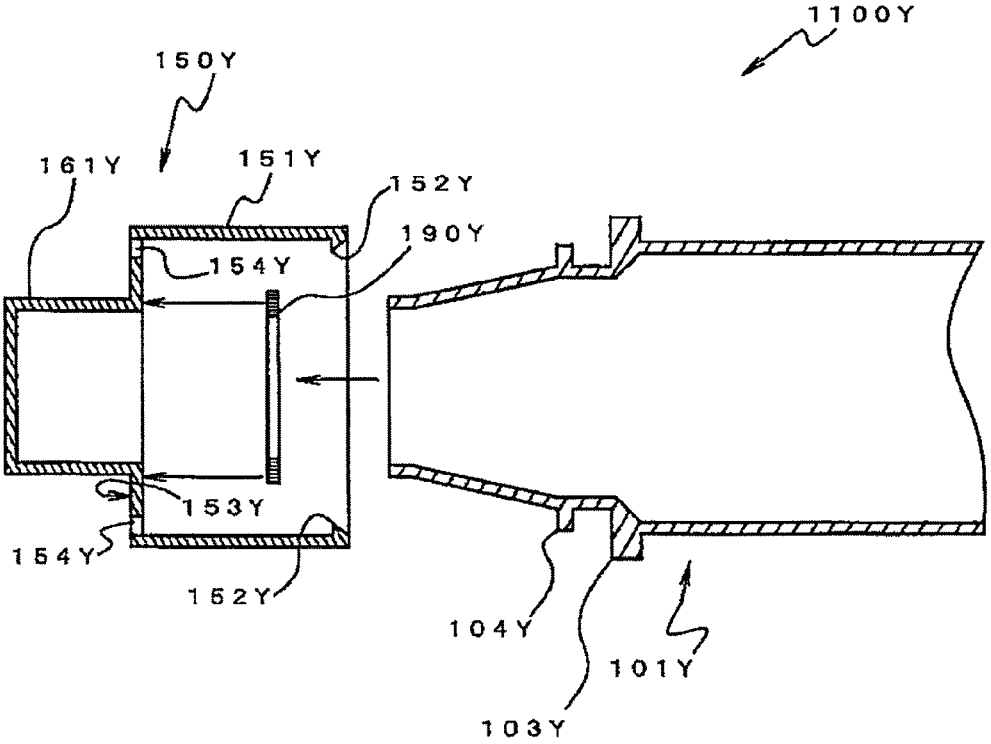
FIG. 71 is an enlarged longitudinal sectional view of a tip portion of the toner container before assembly.

FIG. 71 is an enlarged longitudinal sectional view of the tip portion of the toner container 1100Y before assembly. In the large-diameter cylindrical portion 151Y of the cap portion 150Y illustrated in the figure, a side wall is not formed on one end side in the axial direction of the cylinder (on the right side in the figure), and this end is opened in a circular shape. The opening is the receiving opening for receiving the tip portion of the container body 101Y. On the other hand, the small-diameter cylindrical portion 161Y is connected to the other end of the large-diameter cylindrical portion 151Y in the axial direction of the cylinder. At the connection position (stacked position), the large-diameter cylindrical portion 151Y protrudes from the small-diameter cylindrical portion 161Y in a normal direction and in a ring shape. The ring-shaped protruding portion functions as a ring-shaped top wall 153Y of the large-diameter cylindrical portion 151Y. The inner surface of the ring-shaped top wall 153Y is an attachment surface to which a ring-shaped sealing member 190Y made of elastic material is attached. The sealing member 190Y is attached to the inner surface of the ring-shaped top wall 153Y by adhesive agent.

The tip portion of the container body 101Y is tapered. The outer circumferential projection 104Y, which protrudes from the entire circumference of the outer circumferential surface of the cylinder, is formed at a position slightly behind the position where the tip portion starts to be tapered. The gear portion 103Y protrudes at a position behind the outer circumferential projection 104Y on the outer circumferential surface.

Hook portions 152Y are arranged on, the inner circumferential surface of the large-diameter cylindrical portion 151Y of the cap portion 150Y so as to protrude toward the inside of the cylinder. A rear end side of each of the hook portions 152Y in the axial direction of the cylinder has a tapered shape that obliquely stands toward the front end side, and the front end side of each of the hook portions 152Y stands approximately vertically from the inner circumferential surface of the large-diameter cylindrical portion 151Y. The surface that stands approximately vertically functions as a hook surface for hooking up the outer circumferential projection 104Y.

Figure 72:
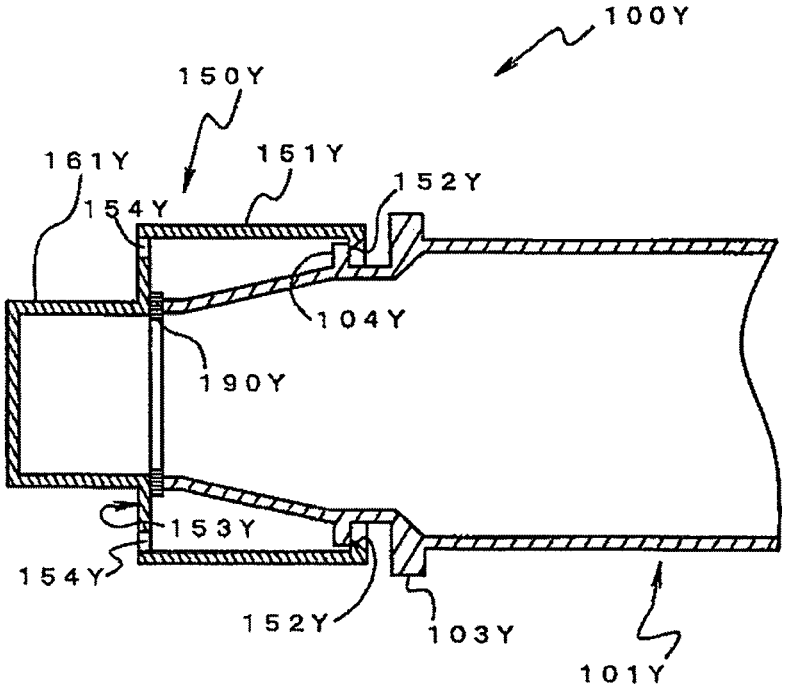
FIG. 72 is an enlarged longitudinal sectional view of the tip portion after assembly.

When the tip portion of the container body 101Y is inserted into the cap portion 150Y, the outer circumferential projection 104Y of the container body 101Y passes over the hook portions 152Y of the large-diameter cylindrical portion 151Y of the cap portion 150Y. Accordingly, the tip of the container body 101Y firmly adheres to the sealing member 190Y made of foamed polyurethane as illustrated in FIG. 72. In this state, the outer circumferential projection 104Y of the container body 101Y is hooked up on the hook surfaces of the hook portions 152Y. Therefore, the container body 101Y can be rotatably held by the cap portion 150Y without coming off from the cap portion 150Y.

Figure 73:
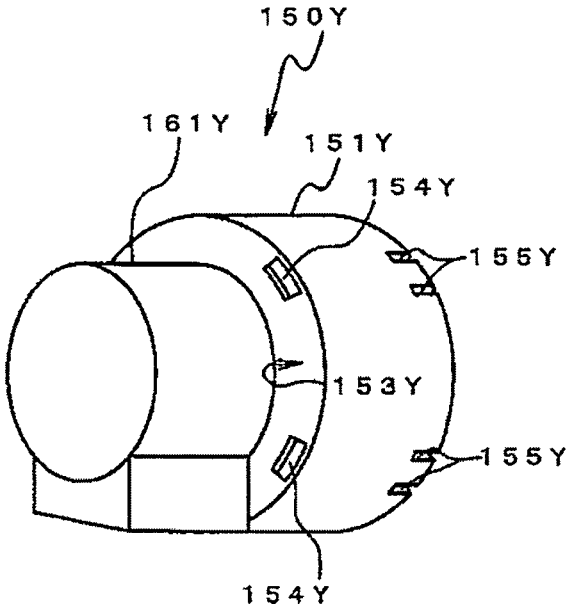
FIG. 73 is an enlarged perspective view of a cap portion of the toner container viewed from a front end side.
Figure 74:
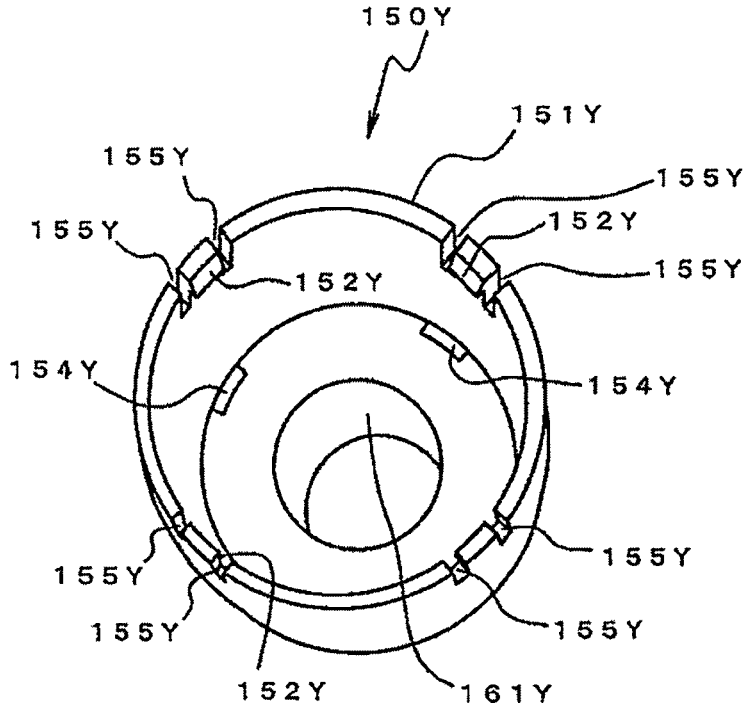
FIG. 74 is an enlarged perspective view of the cap portion viewed from a receiving opening side.
Figure 75:
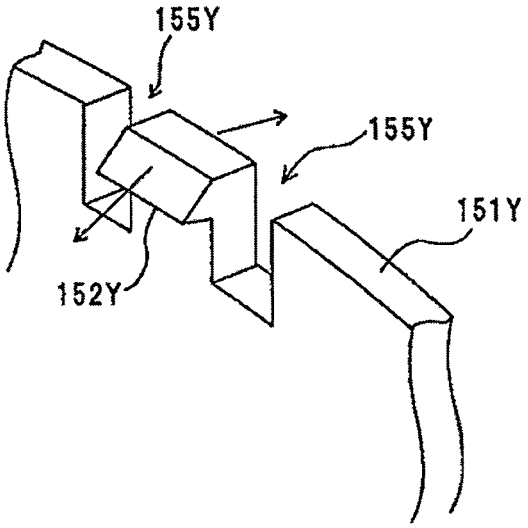
FIG. 75 is an enlarged perspective view of the vicinity of a hook portion of the cap portion.

FIG. 73 is an enlarged perspective view of the cap portion 150Y viewed from the front end side. FIG. 74 is an enlarged perspective view of the cap portion 150Y viewed from the receiving opening side. As illustrated in FIG. 74, the hook portions 152Y are extended in a few centimeters (cm) in the circumferential direction rather than being extended on the entire circumference of the inner circumferential surface of the large-diameter cylindrical portion 151Y of the cap portion 150Y. Four hook portions 152Y are disposed on a concentric circle, the center of which is on the axis line of the cylinder, so as to have a phase angle of 90°. Cuts 155Y are arranged on both sides of each of the hook portions 152Y in the circumferential direction. The portions where the hook portions are formed are separated from other portions by the cuts 155Y on the both sides of the hook portions on the circumferential wall of the large-diameter cylindrical portion 151Y, so that the portions where the hook portions are formed on the circumferential wall can easily be bent in the normal direction as illustrated in FIG. 75.

The amount of protrusion of each of the hook portions 152Y from the inner circumferential surface of the cylinder is about 1 millimeter (mm). The length of each of the hook portions 152Y in the circumferential direction is about 9 mm.

As illustrated in FIGS. 73 and 74, die-cut holes 154Y are formed on the large-diameter cylindrical portion 151Y. The die-cut holes 154Y are formed in regions that face the respective hook surfaces of the four hook portions 152Y protruding from the inner circumferential surface of the large-diameter cylindrical portion 151Y within the entire region of the ring-shaped top wall 153Y of the large-diameter cylindrical portion 151Y. The length of each of the die-cut holes 154Y in the circumferential direction is the same as the length of each of the hook portions 152Y in the circumferential direction, i.e., 9 mm. The length of each of the die-cut holes 154Y in the short-edge direction is 2 mm.

Figure 76:
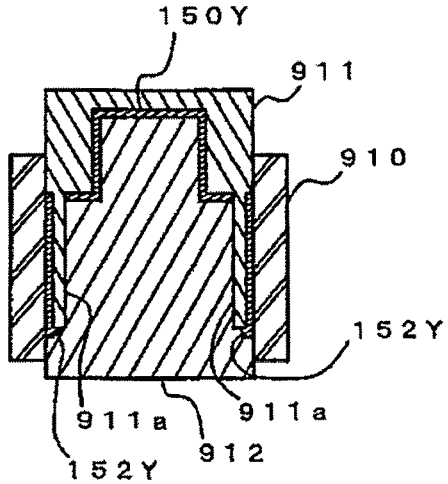
FIG. 76 is a cross-sectional view of the cap portion being molded in molds for molding.
Figure 77:
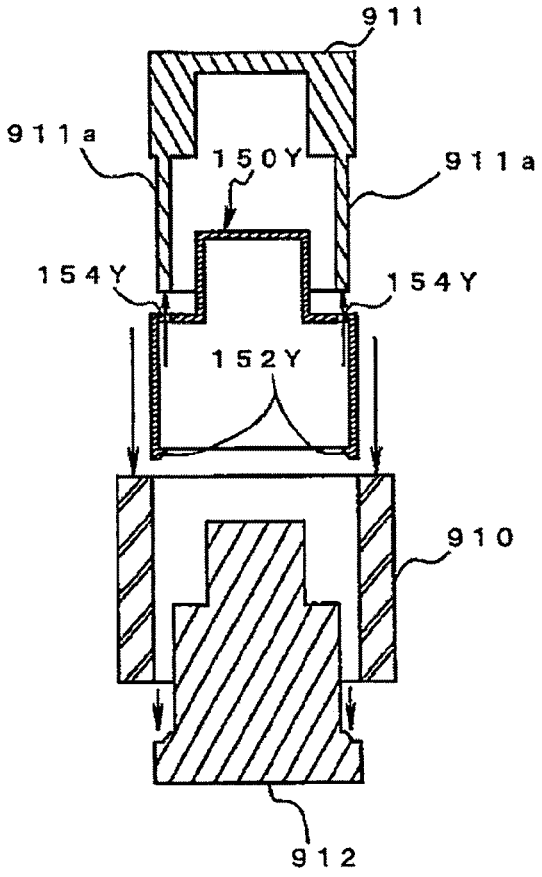
FIG. 77 is a cross-sectional view of the various molds and the cap portion from which the molds are removed.

FIG. 76 is a cross-sectional view of the cap portion 150Y being molded in molds for molding. The cap portion 150Y is molded by using a first outer mold 910 for molding the outer circumferential surface of the large-diameter cylindrical portion, an inner mold 912 for molding the inner circumferential surfaces of the large-diameter cylindrical portion and the small-diameter cylindrical portion, and a second outer mold 911 for molding the outer circumference of the small-diameter cylindrical portion and the ring-shaped top wall of the large-diameter cylindrical portion. The first outer mold 910 has a pipe-shaped structure with an inner circumferential surface for molding the outer circumferential surface of the large-diameter cylindrical portion of the cap portion 150Y. The inner mold 912 has a two-stage cylindrical structure for molding the inner surfaces of the small-diameter cylindrical portion and the large-diameter cylindrical portion of the cap portion 150Y. The most of the second outer mold 911 is used for molding the outer surface of the small-diameter cylindrical portion and the outer surface of the ring-shaped top wall of the large-diameter cylindrical portion of the cap portion 150Y, and parts of the second outer mold 911 serve as hook mold members 911*a* for molding the hook surfaces of the hook portions (152Y in FIG. 71). The hook mold members 911*a* extend from the bottom face of the main body of the second outer mold 911 and enters the inside of the large-diameter cylindrical portion while penetrating through the ring-shaped top wall of the large-diameter cylindrical portion of the cap portion 150Y. As illustrated in FIG. 77, when the second outer mold 911 is pulled out from the cap portion 150Y in the axial direction of the cylinder after the molding, the hook mold members 911*a* that have entered the inside of the large-diameter cylindrical portion are pulled out together from the large-diameter cylindrical portion. The portions through which the hook mold members 911*a* have penetrated within the entire region of the large-diameter cylindrical portion are left as the die-cut holes 154Y. In FIG. 77, only two hook mold members 911*a* are illustrated for the sake of convenience; however, there are actually four hook mold members 911*a* extending from the bottom face of the main body of the second outer mold 911.

As described above, according to the image forming apparatus of the embodiment, four die-cut holes 154Y, through which the hook mold members 911*a* that are used for separately molding the hook surfaces of the four hook portions 152Y can be separately pulled out from the inside to the outside of the molded cap portion 150Y, are molded on the ring-shaped top wall 153Y by the hook mold members themselves in a process of molding the cap portion 150Y. With this configuration, the four hook mold members 911*a*, which are used for separately molding the hook surfaces of the four hook portions 152Y of the cap portion 150Y, mold the hook surfaces of the hook portions 152Y inside the large-diameter cylindrical portion of the cap portion 150Y, and also mold, on the ring-shaped top wall 153Y, the die-cut holes 154Y that are used for pulling out the hook mold members from the inside to the outside of the large-diameter cylindrical portion after the molding. Therefore, even when the cap (in the embodiment, corresponding to the small-diameter cylindrical portion) and the hook portions 152Y are formed by integral molding, it is possible to easily pull out the hook mold members 911*a* located inside the cap portion 150Y to the outside through the die-cut holes 154Y without forcibly deforming the cap portion 150Y. Consequently, it is possible to ensure desired mechanical strength, desired dimensional accuracy, and desired flatness accuracy by using high rigidity material such as ABS or polystyrene as the material of the cap portion 150Y, and also solve a problem with separate molding by integrally molding the cap and the hook portions 152Y of the cap portion 150Y.

The number of the hook portions 152Y is not limited to four. While the toner container 1100Y for Y is explained in detail above, the toner containers 1100M, 1100C, and 1100K for the other colors have the same configurations.

Figure 78:
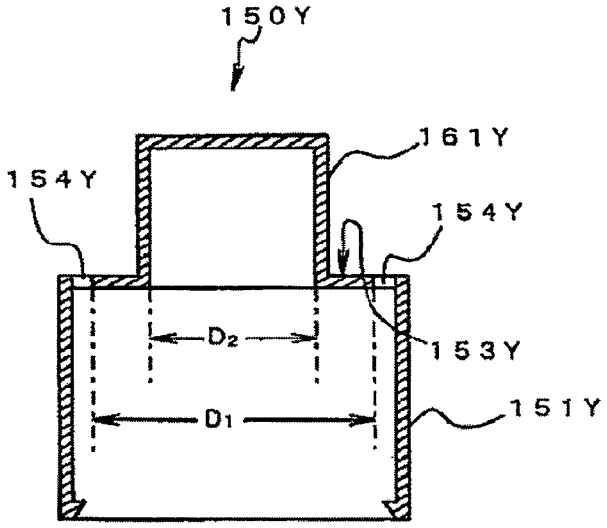
FIG. 78 is a cross-sectional view of the cap portion for explaining various diameters.

As illustrated in FIG. 78, in the cap portion 150Y, an inner diameter D1 of a circular orbit, in which the four die-cut holes 154Y (two of them are illustrated in the figure) formed on the concentric circular area of the ring-shaped top wall 153Y of the large-diameter cylindrical portion 151Y are arranged, is made greater than an inner diameter D2 of the small-diameter cylindrical portion 161Y. The inner diameter D2 of the small-diameter cylindrical portion 161Y is the inner diameter of a ring of the ring-shaped top wall 153Y of the large-diameter cylindrical portion 151Y. That is, in the image forming apparatus, the inner diameter D1 of the circular orbit in which the die-cut holes 154Y are arranged is greater than the inner diameter (D2) of the ring of the ring-shaped top wall 153Y. Therefore, in the ring-shaped top wall 153Y, a ring-shaped flat region is formed between the inner diameter D1 and the inner diameter D2, so that an area for attaching the ring-shaped sealing member 190Y can be ensured on the flat region.

According to the embodiment, the inner diameter D1 of the circular orbit in which the die-cut holes 154Y are arranged is 35 mm. The inner diameter D2 of the small-diameter cylindrical portion 161Y is 30 mm. The width of the ring-shaped top wall 153Y of the large-diameter cylindrical portion 151Y in the normal direction is 2.5 mm.

Examples with added characteristic configurations of the image forming apparatus according to the embodiment will be described below.

First Example

Figure 79:
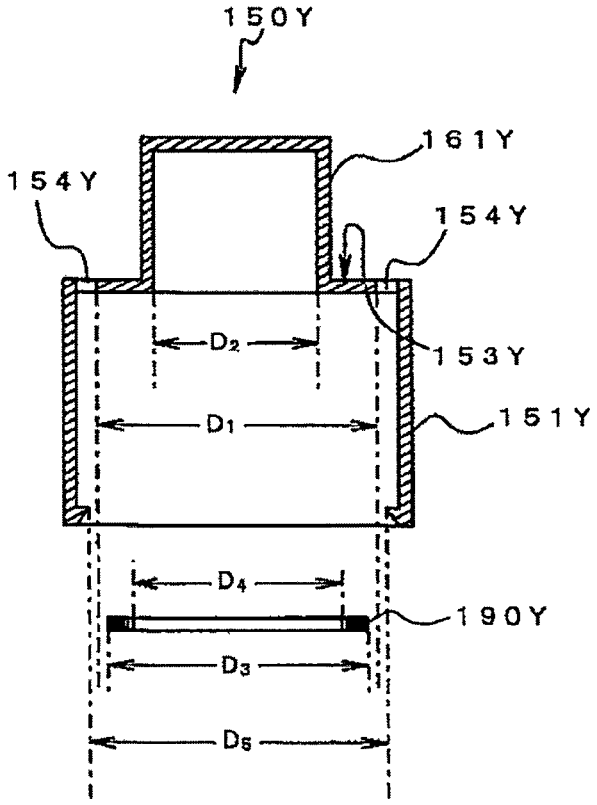
FIG. 79 is a cross-sectional view of a cap portion of an image forming apparatus according to a first example of the ninth embodiment for explaining various diameters.

FIG. 79 is a cross-sectional view of the cap portion 150Y for Y and the sealing member 190Y in an image forming apparatus according to a first example. As the sealing member 190Y, a seal member is used that has an outer diameter D3 greater than the inner diameter D2 of the small-diameter cylindrical portion 161Y and smaller than an inner diameter D5 of a circular orbit in which the four hook portions 152Y are arranged. With this configuration, because the outer diameter D3 of the sealing member 190Y is made greater than the inner diameter D2 of the small-diameter cylindrical portion 161Y, the sealing member 190Y can be firmly attached to the entire circumference of the ring-shaped top wall 153Y. Furthermore, because the inner diameter D5 of the circular orbit in which the four hook portions 152Y are arranged is greater than the outer diameter D3 of the ring-shaped sealing member 190Y, it is possible to insert the sealing member 190Y into the large-diameter cylindrical portion 151Y of the cap portion 150Y while maintaining the shape of the sealing member 190Y without deformation. In the first example, the inner diameter D5 of the circular orbit in which the four hook portions 152Y are arranged is 39.4 mm, and the outer diameter D3 of the sealing member 190Y is 37 mm.

Furthermore, as the sealing member 190Y, a seal member is used that has the outer diameter D3 smaller than the inner diameter D1 of the circular orbit, in which the four die-cut holes 154Y arrayed in parallel on a virtual circle with the same diameter as the ring-shaped top wall 153Y are arranged, and that has an inner diameter D4 greater than the inner diameter D2 of the small-diameter cylindrical portion 161Y. The reason for this is as follows. That is, burrs protruding from the inner surface of the ring-shaped top wall 153Y are inevitably generated on the circumferences of the die-cut holes 154Y or inner portions of the ring of the ring-shaped top wall 153Y. At the spots of the burrs, the adhesiveness of the sealing member 190Y to the inner surface of the top wall is reduced due to the protruding burrs. Therefore, the outer diameter D3 of the sealing member 190Y is made smaller than the inner diameter D1 of the circular orbit in which the die-cut holes 154Y are arranged, and the inner diameter D4 is made greater than the inner diameter D2 of the small-diameter cylindrical portion 161Y. With this configuration, the sealing member 190Y can be firmly attached to the portion between the inner diameter D1 and the inner diameter D2 on the ring-shaped top wall 153Y. Therefore, it is possible to prevent adhesion between the burrs and the sealing member 190Y.

Figure 80:
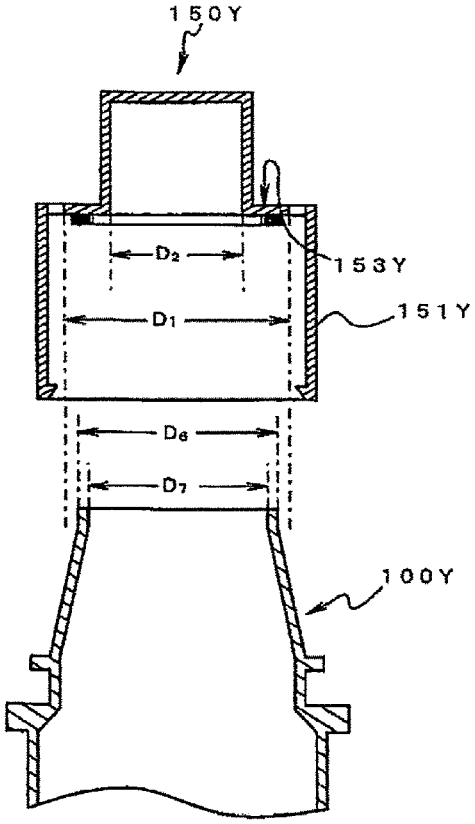
FIG. 80 is a cross-sectional view of the cap portion and a container body (cylindrical container) of the image forming apparatus for explaining various diameters.

As illustrated in FIG. 80, the container body 101Y is formed such that an outer diameter D6 of the tip is smaller than the inner diameter D1 of the circular orbit in which the die-cut holes 154Y are arranged and an inner diameter D7 is greater than the inner diameter D2 of the small-diameter cylindrical portion 161Y. With this configuration, the entire region of the ring-shaped tip end face of the container body 101Y can be reliably pushed against the inner surface of the ring-shaped top wall 153Y of the large-diameter cylindrical portion 151Y. In the embodiment, the outer diameter D6 of the tip of the container body 101Y is 34 mm, and the inner diameter D5 of the circular orbit in which the four hook portions 152Y are arranged is 35 mm.

Figure 81:
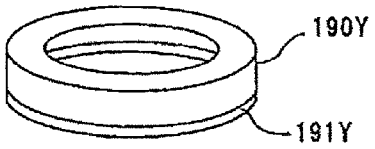
FIG. 81 is an enlarged perspective view of a seal member and a reinforcing member of the image forming apparatus.
Figure 82:
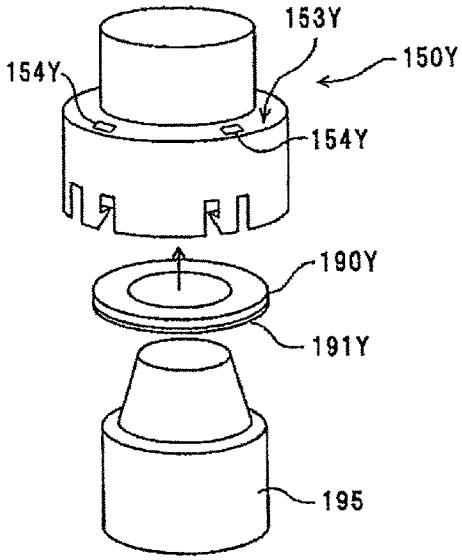
FIG. 82 is a perspective view of how the seal member is attached.

As illustrated in FIG. 81, a ring-shaped reinforcing member 191Y is fixed to the sealing member 190Y. The reinforcing member 191Y has the same size as the sealing member 190Y. The thickness of the reinforcing member 191Y is equal to or greater than 0.05 mm. Because the reinforcing member 191Y is fixed to the sealing member 190Y, it is possible to prevent the sealing member 190Y made of foamed polyurethane from being bent, enabling to reliably and firmly attach the sealing member 190Y to a limited attachment area of the ring-shaped top wall 153Y and prevent the sealing member 190Y from being torn or broken. In the present embodiment, a member with a thickness of 0.05 mm and made of polyester film is used as the reinforcing member 191Y. A double-sided adhesive tape No. 530R manufactured by Nitto Denko Corporation is used as a double-sided adhesive tape (not illustrated) for attaching the sealing member 190Y to the ring-shaped top wall 153Y. PORON LE-20LF (with the thickness of 3 mm) manufactured by INOAC Corporation is used as the material made up of foamed polyurethane for forming the sealing member 190Y. As illustrated in FIG. 82, the sealing member 190Y and the reinforcing member 191Y are attached to a special jig 195 when inserted into the cap portion 150Y so that the sealing member 190Y and the reinforcing member 191Y can be attached to the ring-shaped top wall 153Y of the cap portion 150Y while maintaining correct postures.

In the first example, the sealing member 190Y is squashed by 0.5 mm to 1.5 mm by being pushed by the tip of the container body 101Y.

Second Example

Figure 83:
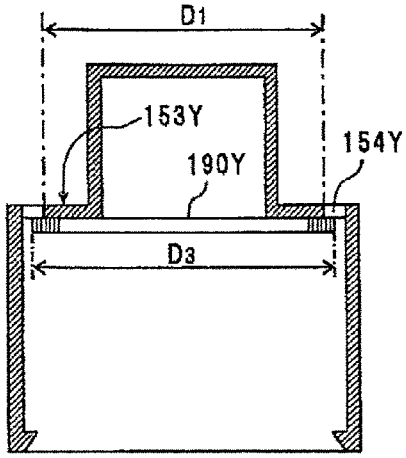
FIG. 83 is a cross-sectional view of a cap portion of an image forming apparatus according to a second example of the ninth embodiment for explaining various diameters.

As illustrated in FIG. 83, in an image forming apparatus according to a second example, the outer diameter D3 of the sealing member 190Y is made greater than the inner diameter D1 of the circular orbit, in which the four die-cut holes 154Y arrayed in parallel in the circular direction on the ring-shaped top wall 153Y are arranged. More specifically, the outer diameter D3 is 37 mm, and the inner diameter D1 is 35 mm.

Figure 84:
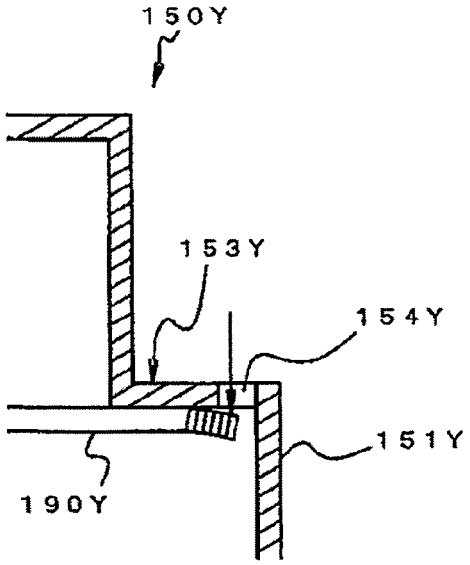
FIG. 84 is a cross-sectional view of how the seal member is removed inside the cap portion.

With this configuration, as illustrated in FIG. 84, the outer edge portion of the sealing member 190Y being attached to the inner surface of the large-diameter cylindrical portion 151Y is exposed to the outside via the die-cut holes 154Y. Therefore, as illustrated in the figure, it is possible to easily detach the sealing member 190Y by a thin jig inserted into the die-cut holes 154Y from the outside of the large-diameter cylindrical portion 151Y. Consequently, it is possible to easily replace the sealing member 190Y when the cap portion 150Y is recycled.

Figure 85:
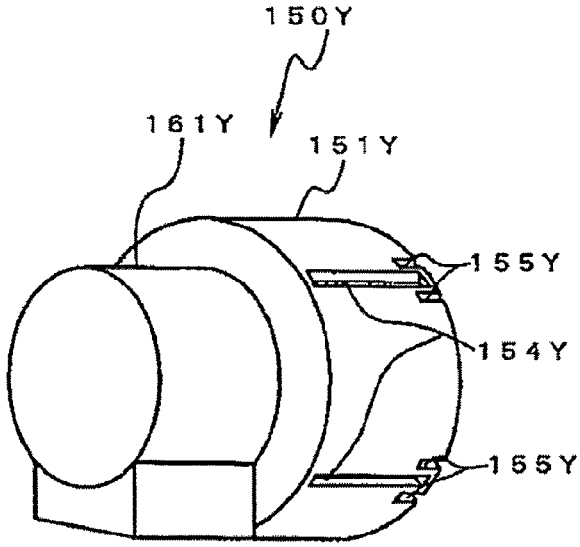
FIG. 85 is an enlarged perspective view of a cap portion for a copier according to a modification.

FIG. 85 is an enlarged perspective view of the cap portion 150Y for Y in an image forming apparatus according to a modification. In the image forming apparatus of the modification, the four die-cut holes 154Y are arranged not on the ring-shaped top wall of the large-diameter cylindrical portion 151Y but on the circumferential wall of the large-diameter cylindrical portion 151Y in parallel in the circumferential direction.

Figure 86:
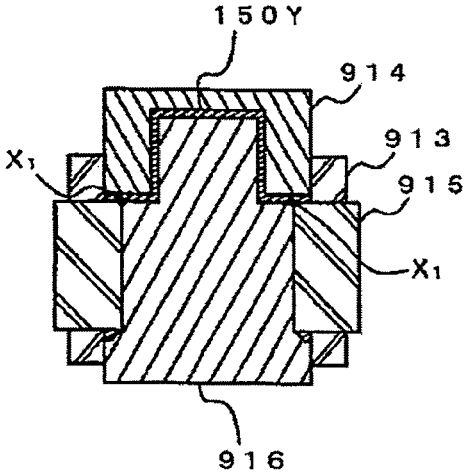
FIG. 86 is a cross-sectional view of the cap portion being molded in molds for molding.
Figure 87:
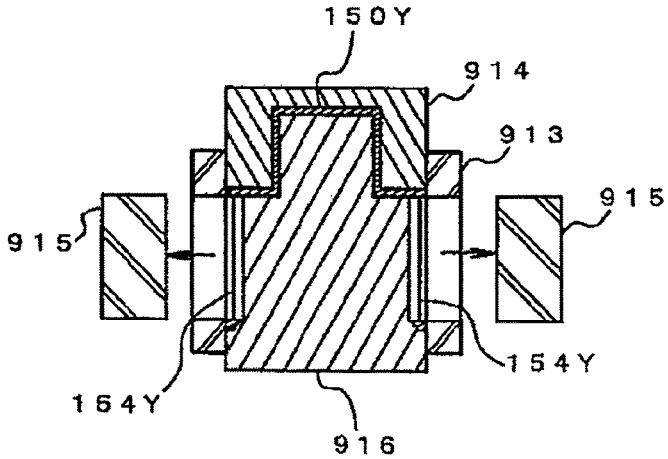
FIG. 87 is a cross-sectional view of the cap portion for explaining how hook mold members are pulled out.

FIG. 86 is a cross-sectional view of the cap portion 150Y being molded in molds for molding. The cap portion 150Y is molded by using a first outer mold 913 for molding the outer circumferential surface of the large-diameter cylindrical portion, an inner mold 916 for molding the inner circumferential surfaces of the large-diameter cylindrical portion and the small-diameter cylindrical portion, a second outer mold 914 for molding the outer circumference of the small-diameter cylindrical portion and the ring-shaped top wall of the large-diameter cylindrical portion, and hook mold members 915 for molding the hook surfaces of the hook portions (152Y). The first outer mold 913 is a mold that basically has a cylindrical structure with the inner circumferential surface having the same diameter as the outer circumferential surface of the large-diameter cylindrical portion of the cap portion 150Y, and has rectangular openings at positions corresponding to the respective four hook portions of the cap portion 150Y. Four hook mold members 915 are provided, and they are inserted into respective four rectangular openings formed on the first outer mold 913. The tip portions of the hook mold members 915 enter the inside of the large-diameter cylindrical portion by penetrating through the circumferential wall of the large-diameter cylindrical portion of the cap portion 150Y, so that the hook surfaces of the hook portions are formed by the tip portions. As illustrated in FIG. 87, when the hook mold members 915 is pulled out from the first outer mold 913 after the hook surfaces of the hook portions are molded, the portions through which the hook mold members 915 have penetrated are left as the die-cut holes 154Y within the entire region of the circumferential wall of the large-diameter cylindrical portion.

As described above, according to the image forming apparatus of the modification, the four die-cut holes 154Y, through which the hook mold members 915 that are used for separately molding the hook surfaces of the four hook portions (152Y) can be separately pulled out from the inside to the outside of the molded cap portion 150Y, are molded on the circumferential wall of the large-diameter cylindrical portion by the hook mold members themselves in a process of molding the cap portion 150Y. With this configuration, the four hook mold members 915, which are used for separately molding the hook surfaces of the four hook portions (152Y) of the cap portion 150Y, mold the hook surfaces of the hook portions 152Y inside the large-diameter cylindrical portion of the cap portion 150Y, and also mold, on the circumferential wall, the die-cut holes 154Y that are used for pulling out the hook mold members 915 from the circumferential wall of the large-diameter cylindrical portion after the molding. Therefore, even when the cap (in the example, corresponding to the small-diameter cylindrical portion) and the hook portions (152Y) of the cap portion 150Y are formed by integral molding, it is possible to easily pull out the hook mold members 915 located inside the cap portion 150Y to the outside through the die-cut holes 154Y without forcibly deforming the cap portion 150Y. Consequently, it is possible to ensure desired mechanical strength, desired dimensional accuracy, and desired flatness accuracy by using high rigidity material such as ABS or polystyrene as the material of the cap portion 150Y, and also solve a problem with separate molding by integrally molding the cap and the hook portions (152Y) of the cap portion 150Y.

Figure 88:
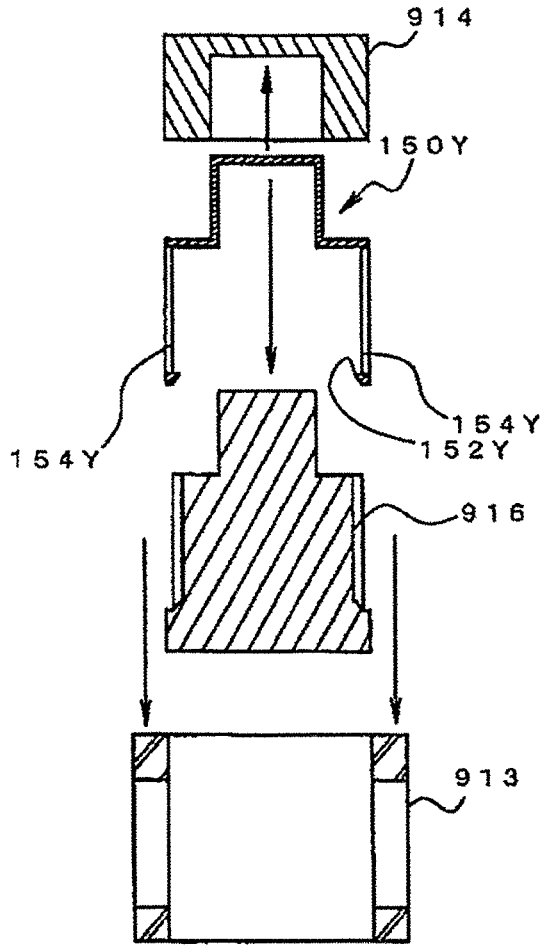
FIG. 88 is a cross-sectional view of the cap portion for explaining how various molds are removed.

As illustrated in FIG. 88, after the four hook mold members 915 are pulled out from the first outer mold 913, the first outer mold 913, the second outer mold 914, and the inner mold 916 are removed from the cap portion 150Y.

Figure 89:
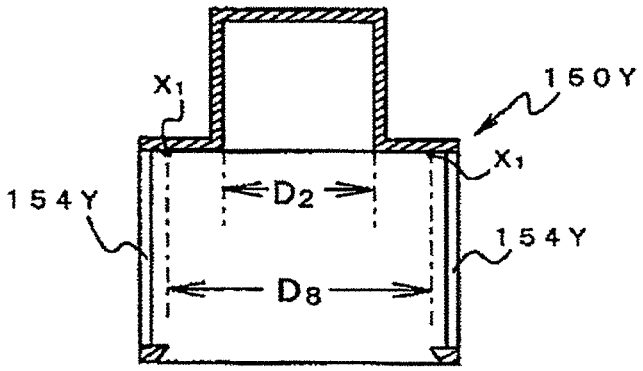
FIG. 89 is a cross-sectional view of the cap portion for explaining various diameters.

In FIG. 86 described above, burrs, which are so-called parting lines, are generated at a mold boundary portion X1 at the boundary between the hook mold members 915 and the inner mold 916 within the entire inner surface of the ring-shaped top wall of the cap portion 150Y. In the image forming apparatus of the modification, as illustrated in FIG. 89, an inner diameter D8 of a circular orbit (X1), in which four parting lines are arranged that are generated on the inner surface of the ring-shaped top wall because of the boundary between the hook mold members (915 in FIG. 86) for molding hooks and the inner mold (916 in FIG. 86), is made greater than the inner diameter D2 of the small-diameter cylindrical portion. The inner diameter D2 of the small-diameter cylindrical portion is the inner diameter of the ring of the ring-shaped top wall of the large-diameter cylindrical portion 151Y. That is, in the image forming apparatus, the inner diameter D8 of the circular orbit of the parting lines is greater than the inner diameter (D2) of the ring of the ring-shaped top wall. Therefore, in the ring-shaped top wall, a ring-shaped flat region is formed between the inner diameter D8 and the inner diameter D2, so that an area for attaching the ring-shaped sealing member 190Y can be ensured on the flat region.

As described above, according to the image forming apparatus of the embodiment, there is provided the cap portion 150Y that has the two-stage cylindrical structure, in which the large-diameter cylindrical portion 151Y and the small-diameter cylindrical portion 161Y are concentrically stacked in the axial direction, and that has the receiving opening for receiving the tip portion of the container body 101Y from the large-diameter cylindrical portion 151Y side. Furthermore, the four hook portions 152Y are arranged in parallel in the circumferential direction on the circumferential surface of the large-diameter cylindrical portion 151Y, and the four die-cut holes 154Y, which correspond to the hook portions 152Y, respectively, are arranged in parallel on the virtual circle with the same diameter as the ring-shaped top wall 153Y, which protrudes in a normal direction and in a ring shape from the small-diameter cylindrical portion 161Y at the position where the large-diameter cylindrical portion 151Y and the small-diameter cylindrical portion 161Y overlap each other in the axial direction. Moreover, the circular opening is formed as the opening of the container body 101Y. Furthermore, the ring-shaped sealing member 190Y is attached to the inner surface of the ring-shaped top wall 153Y. With this configuration, the hook mold members 911*a* that have been located inside the cap portion 150Y during molding can be pulled out from the cap portion 150Y through the die-cut holes 154Y formed on the ring-shaped top wall 153Y of the cap portion 150Y after the molding. Furthermore, because the sealing member 190Y is attached to the ring-shaped top wall 153Y, it is possible to prevent the sealing member 190Y from being twisted due to a slide contact with the container body 101Y.

Furthermore, according to the image forming apparatus of the modification, there is provided the cap portion 150Y that has the two-stage cylindrical structure, in which the large-diameter cylindrical portion 151Y and the small-diameter cylindrical portion 161Y are concentrically stacked in the axial direction, and that has the receiving opening for receiving the tip portion of the container body 101Y from the large-diameter cylindrical portion 151Y side. Furthermore, the four hook portions 152Y are arranged in parallel in the circumferential direction on the circumferential surface of the large-diameter cylindrical portion 151Y, and the four die-cut holes 154Y, which correspond to the hook portions 152Y, respectively, are arranged in parallel in the circumferential direction on the circumferential wall of the large-diameter cylindrical portion 151Y. Moreover, the circular opening is provided as the opening of the container body 101Y. Furthermore, the ring-shaped sealing member 190Y is attached to the inner surface of the ring-shaped top wall 153Y, which protrudes in a normal direction and in a ring shape from the small-diameter cylindrical portion 161Y at the position where the large-diameter cylindrical portion 151Y and the small-diameter cylindrical portion 161Y overlap each other in the axial direction. With this configuration, the hook mold members 915 that have been located inside the cap portion 150Y during molding can be pulled out from the cap portion 150Y through the die-cut holes 154Y formed on the circumferential wall of the large-diameter cylindrical portion 151Y of the cap portion 150Y after the molding. Furthermore, because the sealing member 190Y is attached to the ring-shaped top wall 153Y, it is possible to prevent the sealing member 190Y from being twisted due to a slide contact with the container body 101Y.

Moreover, according to the image forming apparatus of the embodiment, the inner diameter D1 of the circular orbit, in which the four die-cut holes 154Y arrayed in parallel on the virtual circle with the same diameter as the ring-shaped top wall 153Y are arranged, is made greater than the inner diameter D2 of the small-diameter cylindrical portion 161Y. With this configuration, it is possible to form a ring-shaped flat region between the inner diameter D1 and the inner diameter D2, and ensure an area for attaching the ring-shaped sealing member 190Y on the flat region.

Furthermore, according to the image forming apparatus of the modification, the inner diameter D8 of the circular orbit X, in which a plurality of parting lines, which is generated on the inner surface of the ring-shaped top wall (153Y) because of the boundary between the four hook mold members 915 and the inner mold 916 for molding the interior of the cap portion 150Y in a process of molding the cap portion 150Y, are located, is made greater than the inner diameter D2 of the small-diameter cylindrical portion (161Y). With this configuration, in the ring-shaped top wall, it is possible to form a ring-shaped flat region between the inner diameter D8 and the inner diameter D2, and ensure an area for attaching the ring-shaped sealing member 190Y on the flat region.

Moreover, according to the image forming apparatus of the first example, the reinforcing member 191Y is fixed to the sealing member 190Y. With this configuration, it is possible to prevent the sealing member 190Y from being bent, enabling to reliably attach the sealing member 190Y to a limited attachment area of the ring-shaped top wall 153Y and to prevent the sealing member 190Y from being torn or broken.

Furthermore, according to the image forming apparatus of the first example, the outer diameter D3 of the ring-shaped sealing member 190Y is made greater than the inner diameter D2 of the small-diameter cylindrical portion 161Y, and the inner diameter D5 of the circular orbit in which the four hook portions 152Y are arranged is made greater than the outer diameter D3 of the ring-shaped sealing member 190Y. With this configuration, because the outer diameter D3 of the sealing member 190Y is greater than the inner diameter D2 of the small-diameter cylindrical portion 161Y, it is possible to firmly attach the sealing member 190Y to the entire circumference of the ring-shaped top wall 153Y. Furthermore, because the inner diameter D5 of the circular orbit in which the four hook portions 152Y are arranged is greater than the outer diameter D3 of the ring-shaped sealing member 190Y, it is possible to insert the sealing member 190Y into the large-diameter cylindrical portion 151Y of the cap portion 150Y while maintaining the shape of the sealing member 190Y without deformation.

Moreover, according to the image forming apparatus of the first example, the outer diameter D6 of the tip of the container body 101Y is made smaller than the inner diameter D1 of the circular orbit, in which the four die-cut holes 154Y arrayed in parallel on the virtual circle with the same diameter as the ring-shaped top wall 153Y are arranged, and the inner diameter D7 of the tip of the container body 101Y is made greater than the inner diameter D2 of the small-diameter cylindrical portion 161Y. With this configuration, it is possible to reliably push the entire region of the ring-shaped tip end surface of the container body 101Y against the inner surface of the ring-shaped top wall 153Y of the large-diameter cylindrical portion 151Y.

Furthermore, according to the copier of the second example, the outer diameter D3 of the ring-shaped sealing member 190Y is made greater than the inner diameter D1 of the circular orbit, in which the four die-cut holes 154Y arrayed in parallel on the virtual circle with the same diameter as the ring-shaped top wall 153Y are arranged. with this configuration, it is possible to easily detach the sealing member 190Y by a thin jig inserted into the die-cut holes 154Y from the outside of the large-diameter cylindrical portion 151Y. Therefore, it is possible to easily replace the sealing member 190Y when the cap portion 150Y is recycled.

It is obvious that the present invention is not limited by the embodiments and the embodiments may be appropriately changed in various forms other than those suggested in the embodiments within the scope of the technical idea of the present invention. Furthermore, the numbers, positions, and shapes of the components are not limited by the embodiments, and may be changed to those which are appropriate for embodying the present invention According to an embodiment of the present invention, a toner container that is detachably attached to a main body of an image forming apparatus includes: a cylindrical container that has a cylindrical main body for containing toner, and has an outer circumferential projection arranged on an outer circumferential surface of the main body in a circumferential direction; a cap portion that has a plurality of hook portions arranged in parallel on an inner circumferential surface thereof such that the hook portions are engaged with the outer circumferential projection to hold the cylindrical container so that the cylindrical container can rotate in a circular direction while the cap portion houses a tip portion of the cylindrical container; and a sealing member disposed between a tip portion of the cylindrical container in a rotation axis direction and an inner surface of the cap portion housing the tip portion. In the toner container, along with rotation of the cylindrical container, toner contained in the cylindrical container is discharged from an opening arranged on the tip portion of the cylindrical container to the inside of the cap portion and toner contained in the cap portion is discharged to the outside from a toner outlet formed on the cap portion. Furthermore, in the toner container, a plurality of die-cut holes, through which a plurality of hook mold members that are used for separately molding hook surfaces of the hook portions for hooking up on the outer circumferential projection can be separately pulled out from the inside to the outside of the cap portion, are molded on the cap portion by the hook mold members themselves in a process of molding the cap portion.

According to another embodiment, in the above-mentioned toner container, the cap portion has a two-stage cylindrical structure in which a large-diameter cylindrical portion, which is a structural body in the form of a cylinder with a relatively large diameter, and a small-diameter cylindrical portion, which is a structural body in the form of a cylinder with a relatively small diameter, are concentrically stacked in an axial direction. Furthermore, the cap portion has a receiving opening for receiving the tip portion of the cylindrical container from the large-diameter cylindrical portion side. Moreover, the hook portions are arranged in parallel in the circumferential direction on a circumferential surface of the large-diameter cylindrical portion. Furthermore, the die-cut holes, which correspond to the hook portions, respectively, are arranged in parallel on a virtual circle with the same diameter as a ring-shaped top wall that protrudes in a normal direction and in a ring shape from the small-diameter cylindrical portion at a position where the large-diameter cylindrical portion and the small-diameter cylindrical portion overlap each other in the axial direction. Moreover, the sealing member has a ring shape and is attached to an inner surface of the ring-shaped top wall.

According to still another embodiment, in the above-mentioned toner container, the cap portion has a two-stage cylindrical structure in which a large-diameter cylindrical portion, which is a structural body in the form of a cylinder with a relatively large diameter, and a small-diameter cylindrical portion, which is a structural body in the form of a cylinder with a relatively small diameter, are concentrically stacked in an axial direction. Furthermore, the cap portion has a receiving opening for receiving the tip portion of the cylindrical container from the large-diameter cylindrical portion side. Moreover, the hook portions are arranged in parallel in the circumferential direction on a circumferential surface of the large-diameter cylindrical portion. Furthermore, the die-cut holes, which correspond to the hook portions, respectively, are arranged in parallel on a circumferential wall of the large-diameter cylindrical portion. Moreover, the sealing member has a ring shape and is attached to an inner surface of a ring-shaped top wall that protrudes in a normal direction and in a ring shape from the small-diameter cylindrical portion at a position where the large-diameter cylindrical portion and the small-diameter cylindrical portion overlap each other in the axial direction.

According to still another embodiment, in the above-mentioned toner container, an inner diameter D1 of a circular orbit, in which the die-cut holes arrayed in parallel on the virtual plane with the same diameter as the ring-shaped top wall are arranged, is made greater than an inner diameter D2 of the small-diameter cylindrical portion.

According to still another embodiment, in the above-mentioned toner container, an inner diameter D8 of a circular orbit, in which a plurality of parting lines, which is generated on the inner surface of the ring-shaped top wall because of a boundary between the hook mold members and an inner mold used for molding the interior of the cap portion in a process of molding the cap portion, are located, is made greater than the inner diameter D2 of the small-diameter cylindrical portion.

According to still another embodiment, in the above-mentioned toner container, a reinforcing member is fixed to the sealing member.

According to still another embodiment, in the above-mentioned toner container, an outer diameter D3 of the ring-shaped sealing member is made greater than the inner diameter D2 of the small-diameter cylindrical portion 161Y, and an inner diameter D5 of the circular orbit in which the four hook portions are arranged is made greater than the outer diameter D3 of the ring-shaped sealing member.

According to still another embodiment, in the above-mentioned toner container, an outer diameter D6 of a tip of the cylindrical container is made smaller than the inner diameter D1 of the circular orbit, in which the die-cut holes arrayed in parallel on the virtual circle with the same diameter as the ring-shaped top wall are arranged, and an inner diameter D7 of the tip of the cylindrical container is made greater than the inner diameter D2 of the small-diameter cylindrical portion.

According to still another embodiment, in the above-mentioned toner container, an outer diameter D3 of the ring-shaped sealing member is made greater than the inner diameter D1 of the circular orbit, in which the die-cut holes arrayed in parallel on the virtual circle with the same diameter as the ring-shaped top wall are arranged.

According to still another embodiment, an image forming apparatus includes an image forming unit that forms an image with toner; and a toner container that contains toner to be supplied to the image forming unit and is detachably attached to a main body of the image forming apparatus, wherein the above-mentioned toner container is applied as the toner container.

According to still another embodiment, there is provided a method for manufacturing a toner container that is detachably attached to a main body of an image forming apparatus, the toner container including: a cylindrical container that has a cylindrical main body for containing toner, and has an outer circumferential projection arranged on an outer circumferential surface of the cylindrical main body in a circumferential direction; a cap portion that has a plurality of hook portions arranged in parallel on an inner circumferential surface thereof such that the hook portions are engaged with the outer circumferential projection to hold the cylindrical container so that the cylindrical container can rotate in a circular direction while the cap portion houses a tip portion of the cylindrical container; and a sealing member disposed between a tip portion of the cylindrical container in a rotation axis direction and an inner surface of the cap portion housing the tip portion, wherein, along with rotation of the cylindrical container, toner contained in the cylindrical container is discharged from an opening arranged on the tip portion of the cylindrical container to the inside of the cap portion and toner contained in the cap portion is discharged to the outside from a toner outlet formed on the cap portion. The method includes: a step of molding the cap portion by using a mold that has a plurality of hook mold members for separately molding hook surfaces of the hook portions for hooking up on the outer circumferential projection, wherein the step includes molding the hook surfaces inside the cap portion by the hook mold members; and molding, on the cap portion, die-cut holes for separately pulling out the hook mold members from the inside to the outside of the cap portion by the hook mold members themselves.

According to still another embodiment, there is provided a method for recycling a used toner container that is detachably attached to a main body of an image forming apparatus, the toner container including: a cylindrical container that has a cylindrical main body for containing toner, and has an outer circumferential projection arranged on an outer circumferential surface of the main body in a circumferential direction; a cap portion that has a plurality of hook portions arranged in parallel on an inner circumferential surface thereof such that the hook portions are engaged with the outer circumferential projection to hold the cylindrical container so that the cylindrical container can rotate in a circular direction while the cap portions houses a tip portion of the cylindrical container; and a sealing member disposed between a tip portion of the cylindrical container in a rotation axis direction and an inner surface of the cap portion housing the tip portion, wherein, along with rotation of the cylindrical container, toner contained in the cylindrical container is discharged from an opening arranged on the tip portion of the cylindrical container to the inside of the cap portion and toner contained in the cap portion is discharged to the outside from a toner outlet formed on the cap portion. The method includes: a step of pulling out the cylindrical container from the cap portion, on which a plurality of die-cut holes, through which a plurality of hook mold members that are used for separately molding hook surfaces of the hook portions for hooking up on the outer circumferential projection can be separately pulled out from the inside to the outside of the cap portion, are molded by the hook mold members themselves; a step of detaching the sealing member from the cylindrical container or the cap portion; a step of fixing a new sealing member to the cylindrical container or the cap portion; a step of filling the cylindrical container with toner; and a step of engaging the cylindrical container filled with the toner with the cap portion, thereby obtaining a recycled toner container.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A toner container that is detachably attached to a main body of an image forming apparatus such that a longitudinal direction of the toner container is parallel to a horizontal direction, the toner container comprising:

a cylindrical container body that has an opening on one end thereof in the longitudinal direction, and is configured to convey toner contained therein toward the opening;

a cap portion into which the opening of the container body is inserted, and which includes a toner outlet at a bottom portion thereof for discharging toner, which has been discharged from the opening of the container body, to the outside of the toner container in a vertically downward direction; and a shutter member that is held on the bottom portion of the cap portion, and moves along an outer periphery of the cap portion to thereby open and close the toner outlet, wherein the cap portion is formed by integral molding, the cap portion includes a plurality of claw members that engages with the container body to rotatably hold the container body; and a plurality of mold-processing holes arranged near the respective claw members for forming the claw members, each of the claw members and the mold-processing holes does not overlap the toner outlet formed on the cap portion when the cap portion alone is viewed in a projection plane perpendicular to the longitudinal direction, the container body includes a spiral-shaped projection on an inner circumferential surface thereof, and is held so as to rotate relative to the cap portion, a ring-shaped seal member, for sealing a gap between the cap portion and the container body, is attached to a portion of the cap portion so as to be provided at an opposed position to a circumference of the opening of the container body, and the cap portion includes a recess formed on an attachment surface, to which the seal member is attached, the recess being used when the seal member is to be separated from the cap portion.

2. The toner container according to claim 1, wherein the cap portion includes at least one of the toner outlet;

an incompatibly-shaped portion for identifying a type of the toner container, the incompatibly-shaped portion extending in the longitudinal direction in a convex shape or a concave shape at a position unique to the type on an outer circumferential surface of the cap portion;

a first hole that functions as a main guide for positioning the cap portion with respect to the image forming apparatus and a second hole that functions as a sub guide for positioning the cap portion with respect to the image forming apparatus, each of the first hole and the second hole extending in the longitudinal direction from an end face of the cap portion perpendicular to the longitudinal direction; and a pressed portion that protrudes on the outer circumferential surface of the cap portion, and is pressed in a direction of reaction to a force in an attachment direction when the cap portion is attached to the main body of the image forming apparatus.

3. The toner container according to claim 2, wherein each of the claw members and the mold-processing holes does not overlap the at least one of the incompatibly-shaped portion, the first hole, the second hole, and the pressed portion when the cap portion alone is viewed in a projection plane perpendicular to the longitudinal direction.

4. The toner container according to claim 1, wherein the recess is formed at a position that corresponds to an inner circumferential surface side of the seal member and that is other than a region where the seal member comes into contact with the container body.

5. The toner container according to claim 1, wherein the cap portion includes an insertion port for inserting a bar-shaped jig for separating the seal member from the cap portion, the insertion port being formed on an outer circumferential surface of the cap portion and at a position of facing a position of the recess.

6. The toner container according to claim 5, wherein the cap portion includes a concave portion that is formed in a portion of the insertion port, the concave portion being used as a pivot point of the jig.

7. The toner container according to claim 1, wherein the cap portion includes a cylindrical cavity that is formed inside of the cap portion and extends in the longitudinal direction; and a toner fall path that has a columnar shape with a constant flow passage area from a lower circumferential surface of the cavity to the toner outlet.

8. The toner container according to claim 1, wherein the shutter member includes a shutter main unit and a shutter deforming unit protruding from and being thinner than the shutter main unit, and wherein the shutter main unit includes rail engaging portions which engage a rail unit provided on the cap portion such that the shutter member moves linearly along the rail unit to open and close the toner outlet.

9. The toner container according to claim 8, wherein shutter sliders are formed on outer sides of the shutter main unit and shutter-rail engaging portions are formed on inner sides of the shutter main unit, and the shutter sliders engage with corresponding slide grooves of the cap portion, and shutter rails of the cap portion are each fitted and sandwiched between corresponding shutter-rail engaging portions and a shutter seal attached to a surface of the shutter member facing the toner outlet.

10. A toner container that is detachably attached to a main body of an image forming apparatus such that a longitudinal direction of the toner container is parallel to a horizontal direction, the toner container comprising:

a cylindrical container body that has an opening on one end thereof in the longitudinal direction, and is configured to convey toner contained therein toward the opening;

a cap portion into which the opening of the container body is inserted, and which includes a toner outlet at a bottom portion thereof for discharging toner, which has been discharged from the opening of the container body, to the outside of the toner container in a vertically downward direction; and a shutter member that is held on the bottom portion of the cap portion, and moves along an outer periphery of the cap portion to thereby open and close the toner outlet, wherein the cap portion is formed by integral molding, the cap portion includes a plurality of claw members that engages with the container body to rotatably hold the container body; and a plurality of mold-processing holes arranged near the respective claw members for forming the claw members, each of the claw members and the mold-processing holes does not overlap the toner outlet formed on the cap portion when the cap portion alone is viewed in a projection plane perpendicular to the longitudinal direction, the container body includes a spiral-shaped projection on an inner circumferential surface thereof, and is held so as to rotate relative to the cap portion, a ring-shaped seal member, for sealing a gap between the cap portion and the container body, is attached to a portion of the cap portion so as to be provided at an opposed position to a circumference of the opening of the container body, and a film member is attached to a surface of the seal member, the surface being attached to the cap portion.

11. The toner container according to claim 10, wherein the cap portion includes at least one of the toner outlet;

an incompatibly-shaped portion for identifying a type of the toner container, the incompatibly-shaped portion extending in the longitudinal direction in a convex shape or a concave shape at a position unique to the type on an outer circumferential surface of the cap portion;

a first hole that functions as a main guide for positioning the cap portion with respect to the image forming apparatus and a second hole that functions as a sub guide for positioning the cap portion with respect to the image forming apparatus, each of the first hole and the second hole extending in the longitudinal direction from an end face of the cap portion perpendicular to the longitudinal direction; and a pressed portion that protrudes on the outer circumferential surface of the cap portion, and is pressed in a direction of reaction to a force in an attachment direction when the cap portion is attached to the main body of the image forming apparatus.

12. The toner container according to claim 11, wherein each of the claw members and the mold-processing holes does not overlap the at least one of the incompatibly-shaped portion, the first hole, the second hole, and the pressed portion when the cap portion alone is viewed in a projection plane perpendicular to the longitudinal direction.

13. The toner container according to claim 10, wherein the cap portion includes a cylindrical cavity that is formed inside of the cap portion and extends in the longitudinal direction; and a toner fall path that has a columnar shape with a constant flow passage area from a lower circumferential surface of the cavity to the toner outlet.

14. The toner container according to claim 9, wherein the shutter member includes a shutter main unit and a shutter deforming unit protruding from and being thinner than the shutter main unit, and wherein the shutter main unit includes rail engaging portions which engage a rail unit provided on the cap portion such that the shutter member moves linearly along the rail unit to open and close the toner outlet.

15. The toner container according to claim 14, wherein shutter sliders are formed on outer sides of the shutter main unit and shutter-rail engaging portions are formed on inner sides of the shutter main unit, and the shutter sliders engage with corresponding slide grooves of the cap portion, and shutter rails of the cap portion are each fitted and sandwiched between corresponding shutter-rail engaging portions and a shutter seal attached to a surface of the shutter member facing the toner outlet.

* * * * *